US008485716B2

(12) United States Patent
Handa

(10) Patent No.: US 8,485,716 B2
(45) Date of Patent: Jul. 16, 2013

(54) AGITATION APPARATUS AND AGITATION METHOD

(75) Inventor: Haruhisa Handa, Takaishi (JP)

(73) Assignee: DIC Corporation, Tokyo (JP)

( * ) Notice: Subject to any disclaimer, the term of this patent is extended or adjusted under 35 U.S.C. 154(b) by 186 days.

(21) Appl. No.: 12/735,280

(22) PCT Filed: Oct. 28, 2009

(86) PCT No.: PCT/JP2009/068452

§ 371 (c)(1),
(2), (4) Date: Jun. 28, 2010

(87) PCT Pub. No.: WO2010/082391

PCT Pub. Date: Jul. 22, 2010

(65) Prior Publication Data

US 2011/0261643 A1 Oct. 27, 2011

(30) Foreign Application Priority Data

Jan. 16, 2009 (JP) ..... 2009-007498
Feb. 27, 2009 (JP) ..... 2009-045812

(51) Int. Cl.
*B01F 7/20* (2006.01)

(52) U.S. Cl.
USPC ..... 366/270; 366/329.2; 366/330.3

(58) Field of Classification Search
USPC ..... 366/262, 263, 265, 270, 325.1, 325.4, 366/325.5, 325.92, 330.1, 330.3, 329.1, 329.2, 366/329.3
See application file for complete search history.

(56) References Cited

U.S. PATENT DOCUMENTS 2,592,709 A * 4/1952 Kinnaird ..... 366/169.1
4,013,273 A * 3/1977 Danyliw ..... 366/327.1
4,310,124 A * 1/1982 Schwing et al. ..... 241/46.11
4,552,461 A * 11/1985 Ott et al. ..... 366/279
4,627,735 A * 12/1986 Rose et al. ..... 366/325.3
5,160,041 A * 11/1992 Taniguchi et al. ..... 210/205
5,382,092 A * 1/1995 Okamoto et al. ..... 366/320
5,625,008 A * 4/1997 Bronstert et al. ..... 525/333.1

(Continued)

FOREIGN PATENT DOCUMENTS

EP 63171 A2 * 10/1982
EP 0470493 A1 2/1992

(Continued)

OTHER PUBLICATIONS

IPER dated Aug. 16, 2011.*

*Primary Examiner* — Charles E Cooley
(74) *Attorney, Agent, or Firm* — Edwards Wildman Palmer LLP

(57) ABSTRACT

An agitation apparatus and an agitation method that ensure rapid and homogeneous agitation/mixing of fluids with a wide spectrum of viscosities from low to high levels and fluids with high thixotropy throughout an agitation vessel are provided. In an agitation apparatus, a lowest upper agitation blade is arranged to be vertically adjacent to a lower blade. As viewed from above, a line on a plane connecting a lower end portion of the lowest upper agitation blade to the center of an agitation shaft is arranged by a predetermined angle with respect to the center line of the lower blade in a blade radial direction. As viewed from the side, a horizontal cross section including the lower end portion of the lowest upper agitation blade is located below a horizontal cross section including an upper end portion of the lower blade.

6 Claims, 37 Drawing Sheets

U.S. PATENT DOCUMENTS

| | | | | | |
|---|---|---|---|---|---|
| 5,762,417 | A | * | 6/1998 | Essen et al. | 366/264 |
| 6,149,296 | A | * | 11/2000 | Asai et al. | 366/313 |
| 6,786,631 | B2 | * | 9/2004 | Lipp | 366/322 |
| 6,796,707 | B2 | * | 9/2004 | Gigas et al. | 366/327.1 |
| 7,172,337 | B2 | * | 2/2007 | Roszczenko et al. | 366/270 |
| 2003/0161216 | A1 | * | 8/2003 | Gigas et al. | 366/327.1 |
| 2005/0007874 | A1 | * | 1/2005 | Roszczenko et al. | 366/270 |
| 2011/0261643 | A1 | * | 10/2011 | Handa | 366/270 |

FOREIGN PATENT DOCUMENTS

| | | | | |
|---|---|---|---|---|
| EP | 2025719 | A1 | * | 2/2009 |
| EP | 2025719 | A1 | | 2/2009 |
| JP | 05-049890 | A | | 3/1993 |
| JP | 06-170202 | A | | 6/1994 |
| JP | 06170202 | A | * | 6/1994 |
| JP | 06198154 | A | * | 7/1994 |
| JP | 09-075699 | A | | 3/1997 |
| JP | 2002273188 | A | * | 9/2002 |
| JP | 2003200030 | A | * | 7/2003 |
| JP | 2004167386 | A | * | 6/2004 |
| JP | 2004351257 | A | * | 12/2004 |
| JP | 2006282729 | A | * | 10/2006 |
| JP | 2007-090265 | A | | 4/2007 |
| JP | 2007090265 | A | * | 4/2007 |
| JP | 2008007768 | A | * | 1/2008 |
| JP | 2008-036480 | A | | 2/2008 |
| JP | 2008036480 | A | * | 2/2008 |
| JP | 2010058027 | A | * | 3/2010 |
| JP | 2010162488 | A | * | 7/2010 |
| JP | 2010194525 | A | * | 9/2010 |
| WO | WO-2007/142185 | A1 | | 12/2007 |
| WO | WO 2007142185 | A1 | * | 12/2007 |
| WO | WO 2010082391 | A1 | * | 7/2010 |

* cited by examiner

AGITATION APPARATUS AND AGITATION METHOD

FIELD OF THE INVENTION

The present invention relates to an agitation apparatus used in agitation processes for purposes such as mixing, dissolution, crystallization, reaction, distillation, defoaming, solvent removal, emulsification, and particulation.

BACKGROUND OF THE INVENTION

Conventionally, small-sized blades such as turbine blades, paddle blades, and propeller blades are often used as agitation blades of an agitation apparatus to process fluids with low to middle viscosities. To process fluids with middle to high viscosities, anchor blades or helical ribbon blades are often used as the agitation blades.

However, it has been known that small-sized blades easily produce a flow boundary in an agitation vessel, which not only hampers generation of a vertically circulating flow throughout the vessel but also causes insufficient mixing when fluid with high viscosity is processed. Contrastingly, as has been known, the anchor blades or the ribbon blades cause insufficient mixing due to simultaneous revolution when fluid with low viscosity is processed.

Particularly, when the small-sized blades are employed to agitate a highly thixotropic fluid, the fluid is flowable only in the proximities of the blades but not in ranges spaced from the blades, which are the vicinities of the inner wall and the bottom portion of the agitation vessel, thus causing insufficient mixing. The anchor blades and the ribbon blades, which are arranged along the inner wall of the agitation vessel, ensure fluid flowability in the vicinities of the vessel wall and at the vessel bottom portion but cancel the flowability in a central portion of the agitation vessel. Also in this case, mixing becomes insufficient.

Accordingly, the aforementioned agitation blades all increase risks of insufficient mixing and incomplete reaction when such a chemical reaction that the viscosity of a substance to be processed greatly changes is brought about in the agitation vessel or a highly thixotropic substance to be processed is mixed and caused to react in the agitation vessel.

To solve this problem, as illustrated in FIGS. 29 to 31, an agitation apparatus 21 (see Patent Document 1) having upper blade sets 24 and lower blades 25 has been proposed. The upper blade sets 24 are inclined at elevation angles with respect to the rotating direction of an agitation shaft 23. The lower blades 25 are each arranged vertically (along the axial direction of the agitation shaft 23).

Each of the upper blade sets of the agitation apparatus are configured by arranging a first upper agitation blade 26*a* and a second upper agitation blade 26*b*, which are formed in quartered oval shapes, in such a manner that the first agitation blade 26*a* extends parallel to the second upper agitation blade 26*b* and a lower portion of the first upper agitation blade 26*a* is overlapped with an upper portion of the second upper agitation blade 26*b*, thus forming as an inclined and stepped semi-oval blade set 24. A pair of such inclined and stepped semi-oval blade sets 24 (the first upper agitation blades 26*a* and the second upper agitation blades 26*b*) are inclined upward with respect to the rotating direction of the agitation shaft 23 and fixed to the agitation shaft 23 in such a manner as to be located on opposite sides of the agitation shaft 23.

Each of the lower blades 25 is formed as a flat plate having an outer peripheral end extending to the proximity of a vessel wall. A distal portion (an outer peripheral end portion) of each lower blade 25 is bent rearward with respect to the rotating direction of the agitation shaft 23 (in the opposite direction to the rotating direction of the agitation shaft).

When the agitation blades are configured in the above-described manner, rotation of the agitation shaft 23 integrally rotates the inclined and stepped blade sets 24, which are attached to the agitation shaft 23. In this state, the fluid in an upper portion of the vessel is sent downward (toward the bottom) from the vicinity of an upper portion of each inclined and stepped blade set 24 (the proximity of a fluid level) along the inclined and stepped blade set 24. In this manner, the fluid in the upper portion of the vessel is displaced to a lower portion of the vessel (toward the lower blades 25). The fluid is then agitated radially outward in the vessel by the lower blades 25 and strikes the vessel wall, which sends the fluid upward, thus forming a vertically circulating flow in the vessel. As a result, fluids (liquids) with a wide spectrum of viscosities from low to high levels are agitated and mixed in a vertical direction.

As illustrated in FIGS. 32 to 34, an agitation apparatus 31 including upper blade sets 34, which are attached to an agitation shaft 33, and lower agitation blades 35 formed as flat plates, has been proposed (see Patent Document 2). The lower agitation blades 35 extend downward from the vicinities of the lower ends of the upper blade sets to the vicinities of the bottom surfaces of the vessel, projecting radially outward from the agitation shaft. Each of the upper blade sets 34 includes a set of upper agitation blades 36 at a plurality of levels, which are configured by arranging the upper agitation blades along a circumferential direction of the agitation shaft 33 to be spaced apart at predetermined intervals and inclining the upper agitation blades by a predetermined elevation angles with respect to the rotating direction of the agitation shaft. Corresponding ones of the upper agitation blades 36 at all levels are arranged at such positions that a highest upper agitation blade and a lowest upper agitation blade are axially overlapped with each other in such a manner that a lower side portion of the highest upper agitation blade is visible from a lower side portion of the lowest upper agitation blade. The angle about the agitation shaft between an upper side of a highest upper agitation blade and a lower side of a lowest upper agitation blade with respect to the rotational direction is less than 180°.

When the agitation blades are configured in the above-described manner, rotation of the agitation shaft 33 causes the upper blade sets 34 to move the liquid in an upper portion of the vessel toward the lower blades 35 (a lower portion of the vessel). The rotation angle of the agitation shaft 33 necessary for such movement is less than 180°. Accordingly, the fluid (the liquid) in the upper portion of the vessel is rapidly sent to the lower portion (the bottom portion) of the vessel by the small rotation angle.

Further, as illustrated in FIGS. 35 to 37, an agitation apparatus 41 having upper blade sets (auxiliary agitation blade sets) 44 and flat plate-like lower blades (main agitation blades) 45 has been proposed (see Patent Document 3). Each of the upper blade sets 44 includes scrapers and paddles. Each of the scrapers is arranged at a side of the upper blade set 44 corresponding to an inner wall of an agitation vessel and inclined in such a direction that the scraper scrapes up a substance to be processed with respect to the rotating direction of an agitation shaft 43. Each one of the paddles is connected to the corresponding one of the scrapers and inclined in such a direction that the paddle presses down the substance to be processed when rotation occurs. The lower blades 45 are arranged at the lowermost level of the agitation shaft.

Each upper blade set 44 of this agitation apparatus is configured by upper agitation blades at a plurality of levels, which are, for example, as illustrated in FIGS. 35 to 37, a highest upper agitation blade 46*a*, a middle upper agitation blade 46*b*, and a lowest upper agitation blade 46*c*. The scrapers, which are formed substantially in T shapes, are attached to the upper agitation blades 46*a*, 46*b*, 46*c* at the sides corresponding to the inner wall of the agitation vessel. The clearance between the inner wall surface of the vessel and the outer peripheral portion of each scraper is small. In each vertically adjacent pair of the upper agitation blades, the upper end of the upper agitation blade at a higher position is arranged in such a manner as to produce a phase difference with respect to the lower end of the upper agitation blade at lower position in the opposite direction to the rotating direction of the agitation shaft 43.

Each of the lower blades 45 is arranged in such a manner that the outer peripheral portion of each blade is spaced from the inner wall surface of the agitation vessel and that the lower blade 45 is located at the lowermost level of the agitation shaft. The upper end of each lower blade 45 is arranged in such a manner as to generate a phase difference with respect to the lower end of the corresponding lowest upper agitation blade, which is located adjacent to and above the lower blade 45, in the opposite direction to the rotating direction of the agitation shaft 43.

In the agitation apparatus 41 configured as described above, rotation of the agitation shaft 43 rotates the upper blade sets 44 and the lower blades 45, which are attached to the agitation shaft 43. In this state, the scraper portions of the upper agitation blades move the substance to be processed in the vicinity of the inner wall of the agitation vessel in an upward direction in scraping manners. Also, the inclined paddles, which are arranged inward from and connected to the scrapers, move the substance in the vicinity of the center of the agitation vessel in a downward direction toward the lower blades 45 in depressing manners. Then, the lower blades 45, which are located in the vicinity of the bottom portion of the agitation vessel, send the substance radially outward in the vessel, thus forming vertically circulating flows. As a result, fluids (liquids) with high viscosity and high thixotropy are efficiently agitated and mixed together.

Patent Document 1: Japanese Laid-Open Patent Publication No. 09-75699

Patent Document 2: Japanese Laid-Open Patent Publication No. 2007-90265

Patent Document 3: Japanese Laid-Open Patent Publication No. 06-170202

SUMMARY OF THE INVENTION

Problems that the Invention is to Solve

It is now highly demanded that chemical industrial products be water-based or solvent-free or low-VOC (volatile organic compounds). As a result, the viscosities of intermediary bodies and final products in production steps have become higher. Since the demand for highly functional or composite chemical industrial products is also high, there is a tendency that a water-based product produced in an agitation vessel is temporarily held in such a flowable state exhibiting high viscosity and high thixotropy in a certain production step. As a result, it is demanded to provide an agitation apparatus that is usable flexibly for highly efficient agitation of fluids with high viscosity and high thixotropy, dispersion and mixing of highly viscous fluids in powders or solids, agitation and mixing of fluids with a great difference in viscosity, change of the liquid level in an agitation vessel, and deep liquid agitation.

The conventional agitation apparatus 21 having the inclined and stepped blade sets 24 are effective for homogeneous mixing of liquids. However, the inclined and stepped blade sets 24 have increased blade surface areas. Accordingly, when powder is dispersed in and mixed with liquid using the agitation apparatus 21, some of the powder is adhered to the upper surfaces of the inclined and stepped blade sets 24, thus hampering the mixing. Even in cases of substances other than powders, when an agitated substance (a complete product or an intermediary product) is retracted from the agitation vessel, a great amount of substance adheres to the blades. This decreases the yield or makes it difficult to cleanse the apparatus. Also, the increased blade surface area raises the power required to agitate a highly viscous fluid, thus increasing the initial investment and the operating cost necessary for providing the agitation power (an electric motor). Further, since the upper blade sets are formed by the inclined and stepped semi-oval blade sets 24, it is difficult to see the vessel bottom surface, or particularly, the proximity of a bottom outlet valve, when the interior of the agitation vessel is viewed from above. This is disadvantageous for checking whether the content of the vessel has been discharged or carrying out maintenance work. Further, in the overlapped portion between the lower portion of each first upper agitation blade 26*a* and the upper portion of the corresponding second upper agitation blade 26*b* of the inclined and stepped blade set 24, an outward flow (a flow moving substantially in a horizontal direction from the agitation shaft toward the wall surface of the agitation vessel) is intense. This may cut a vertically circulating flow that runs throughout the agitation vessel, which prolongs the time needed for completing homogeneous mixing or greatly decreases the mixing efficiency for certain fluid level positions.

In the conventional agitation apparatus 31, characteristically, the angle about the agitation shaft between the upper side of each highest upper agitation blade and the lower side of the corresponding lowest upper agitation blade is less than 180° with respect to the rotating direction. Like the conventional agitation apparatus 21, the agitation apparatus 31 also has a plurality of problems including powder adhesion, increased power requirement, difficult maintenance work, which are caused by the great surface area of each upper blade set. Further, in the conventional agitation apparatus 31, as illustrated in FIG. 34, the upper agitation blades 36*a*, 36*b*, 36*c* are arranged compactly when viewed from above. This arrangement causes the fluid in the proximity of the upper blade sets to move like a solid, together with the moving blades, when the agitation blades are rotated. This tendency is pronounced particularly when low-viscosity fluid is dispersed in and mixed with high-viscosity fluid. Accordingly, the agitation apparatus 31 cannot sufficiently respond to the demand that highly functional or composite products be produced.

In the conventional agitation apparatuses 21, 31, which are illustrated in FIGS. 29 to 34, the clearance between the inner wall surface of the agitation vessel and the outer peripheral portion of each agitation blade is great. Accordingly, in steps handling fluid with high thixotropy, the flowability of the fluid is extremely deteriorated in the proximity of the inner wall surface of the agitation vessel in a disadvantageous manner.

The conventional agitation apparatus 41 with the scrapers, which are shown in FIGS. 35 to 37, are capable of efficiently agitating and mixing fluid with high viscosity and high thixotropy. However, there is no overlapped portion in the blades arranged at the multiple levels in the vertical direction. In other words, in certain ranges, no force acts in the vertical direction, which makes the agitation apparatus 41 difficult to tolerate change of the liquid level. Specifically, the problem is less pronounced for homogeneous fluids (continuous body) such as a non-water-based resin product that is diluted by solvent or does not contain solvent. However, many water-based resin products are non-homogeneous fluids (discontinuous body) in which originally non-water-soluble substances are emulsified and dispersed. Accordingly, there is a tendency that the water-based resin products have higher thixotropy than the homogenous fluids. As a result, if there is a range in which no vertical force acts, such range makes a critical defect for production of a water-based product. Particularly, in a step causing a great change in the amount of the processed fluid, or in other words, the fluid level position and the fluid viscosity, in the agitation vessel, such as an instillation/polymerization step or a transfer/emulsification step, various disadvantages, such as insufficient reaction or coarse particles of an emulsified product caused by insufficient mixing or adhesion of gels to agitation vessel wall surfaces, may occur.

Accordingly, to solve the above-described problems, it is an objective of the present invention to provide an agitation apparatus and an agitation method that allow rapid and homogeneous agitation and mixing of fluids with a wide spectrum of viscosities from low to high levels, highly thixotropic fluids, and highly viscous and highly thixotropic fluids throughout an agitation vessel, decrease insufficient mixing caused by powder adhered to a blade, prevent increase of power requirement even when agitating highly viscous fluid, perform flexibly in correspondence with a viscosity change or fluid level position change of fluid in an agitation vessel, mixing of fluids with different viscosities, and deep liquid agitation, and reliably responding to change of the fluid level position and change of viscosity in steps for producing a product.

Means for Solving the Problems

To achieve the foregoing objective, an agitation apparatus 1 according to the present invention includes an agitation vessel, an agitation shaft, and an upper blade and a lower blade fixed to the agitation shaft. The upper blade is configured by upper agitation blades arranged at a plurality of levels. As viewed from above, each of the upper agitation blades has cutout portions at positions forward and rearward in a rotating direction in a range between lines connecting two blade ends of the upper agitation blade to a center of the agitation shaft. Each upper agitation blade is inclined at an elevation angle with respect to the rotating direction. Each of highest upper agitation blades is arranged forward from an adjacent one of lowest upper agitation blades with respect to the rotating direction in such a manner that the highest upper agitation blade has an overlapped portion with respect to the lowest upper agitation blade. As viewed from the side, a horizontal cross section including a lower end of the highest upper agitation blade is located below a horizontal cross section including an upper end of the adjacent lowest upper agitation blade. Each of the lowest upper agitation blades is arranged vertically adjacent to the lower blade. As viewed from above, a line on a plane connecting a lower end portion of the lowest upper agitation blade to the center of the agitation shaft is arranged at a predetermined angle with respect to a center line of the lower blade in a blade radial direction. As viewed from the side, a horizontal cross section including the lower end portion of the lowest upper agitation blade being arranged below a horizontal cross section including an upper end portion of the lower blade. A lower end portion of the lower blade is arranged close to an inner bottom surface of the agitation vessel.

Further, to achieve the foregoing objective, an agitation apparatus 11 according to the present invention includes an agitation vessel, an agitation shaft, and an upper blade and a lower blade fixed to the agitation shaft. The upper blade is configured by upper agitation blades arranged at a plurality of levels. Each of the upper agitation blades is configured by an inner blade portion connected to the agitation shaft and an outer blade portion coupled to a side of the inner blade portion corresponding to an inner wall of the agitation vessel. As viewed from above, the inner blade portion of each upper agitation blade has cutout portions at positions forward and rearward in a rotating direction in a range between lines connecting two blade ends of the inner blade portion to a center of the agitation shaft. Each inner blade portion is inclined at an elevation angle with respect to the rotating direction. Each of the highest upper agitation blades are arranged forward from an adjacent one of the lowest upper agitation blades with respect to the rotating direction in such a manner that the highest upper agitation blade has an overlapped portion with respect to the lowest upper agitation blade. As viewed from the side, a horizontal cross section including a lower end of the highest upper agitation blade is located below a horizontal cross section including an upper end of the adjacent lowest upper agitation blade. As viewed from above, the outer blade portion of each upper agitation blade has cutout portions at positions forward and rearward in the rotating direction in a zone from an outer periphery of the inner blade portion toward the inner wall of the agitation vessel and in a range between lines connecting two blade ends of the outer blade portion to the center of the agitation shaft. Each outer blade portion is inclined at a downward angle with respect to the rotating direction, and wherein an outer periphery of the outer blade portion of the upper agitation blade is arranged close to and along the inner wall of the agitation vessel. Each of the lowest upper agitation blades is arranged vertically adjacent to the lower blade. As viewed from above, a line on a plane connecting a lower end portion of the outer blade portion of the lowest upper agitation blade to the center of the agitation shaft is arranged at a predetermined angle with respect to a center line of the lower blade in a blade radial direction. As viewed from the side, a horizontal cross section including a lower end of the lowest upper agitation blade is arranged below a horizontal cross section including an upper end of the lower blade as viewed from the side. A lower end portion of the lower blade is arranged close to an inner bottom surface of the agitation vessel.

Effects of the Invention

An agitation apparatus 1 according to the present invention generates a vortex flow through rotation of an agitation blade and produces a plurality of small vortex flows rotating (spinning) in the opposite direction to the rotating direction of the vortex flow. The agitation apparatus 1 also forms a vertically circulating flow having a curved section above a lower blade, which is a flow of a particular shape that cannot be observed in a conventional agitation apparatus, throughout an agitation vessel. Synergetic effects of these flows ensure rapid, efficient (low-power consuming), and homogeneous mixing of fluids with a wide spectrum of viscosities from low to high levels and fluids with a great difference in viscosity. Further, by avoiding the risk of insufficient mixing caused by adhesion of powder and decreasing adhesion of a substance to be agitated to a blade, yield is increased and cleansing and maintenance work are facilitated.

The agitation apparatus 11 according to the present invention generates a vortex flow through rotation of an agitation blade and produces a plurality of small vortex flows rotating (spinning) in the opposite direction to the rotating direction of the vortex flow. The agitation apparatus 11 also forms a vertically circulating flow having a curved section above a lower blade throughout an agitation vessel. An outer blade portion of an upper agitation blade brings about effects of scraping off and raising the fluid in the vicinity of an inner wall surface of the agitation vessel. An inner blade portion of the upper agitation blade exerts an effect of depressing the fluid in the vicinity of a central portion of the agitation vessel. The proximity of the joint portion between the inner blade portion and the outer blade portion causes effects of dividing, reversing, and merging outward flows. These effects and synergetic effects of the effects ensure rapid, efficient, and homogeneous mixing of fluids with a wide spectrum of viscosities from low to high levels, fluids with high thixotropy, fluids with high viscosity and high thixotropy, and fluids with a great difference in viscosity.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTIION OF THE PREFERRED EMBODIMENTS

Figure 1:
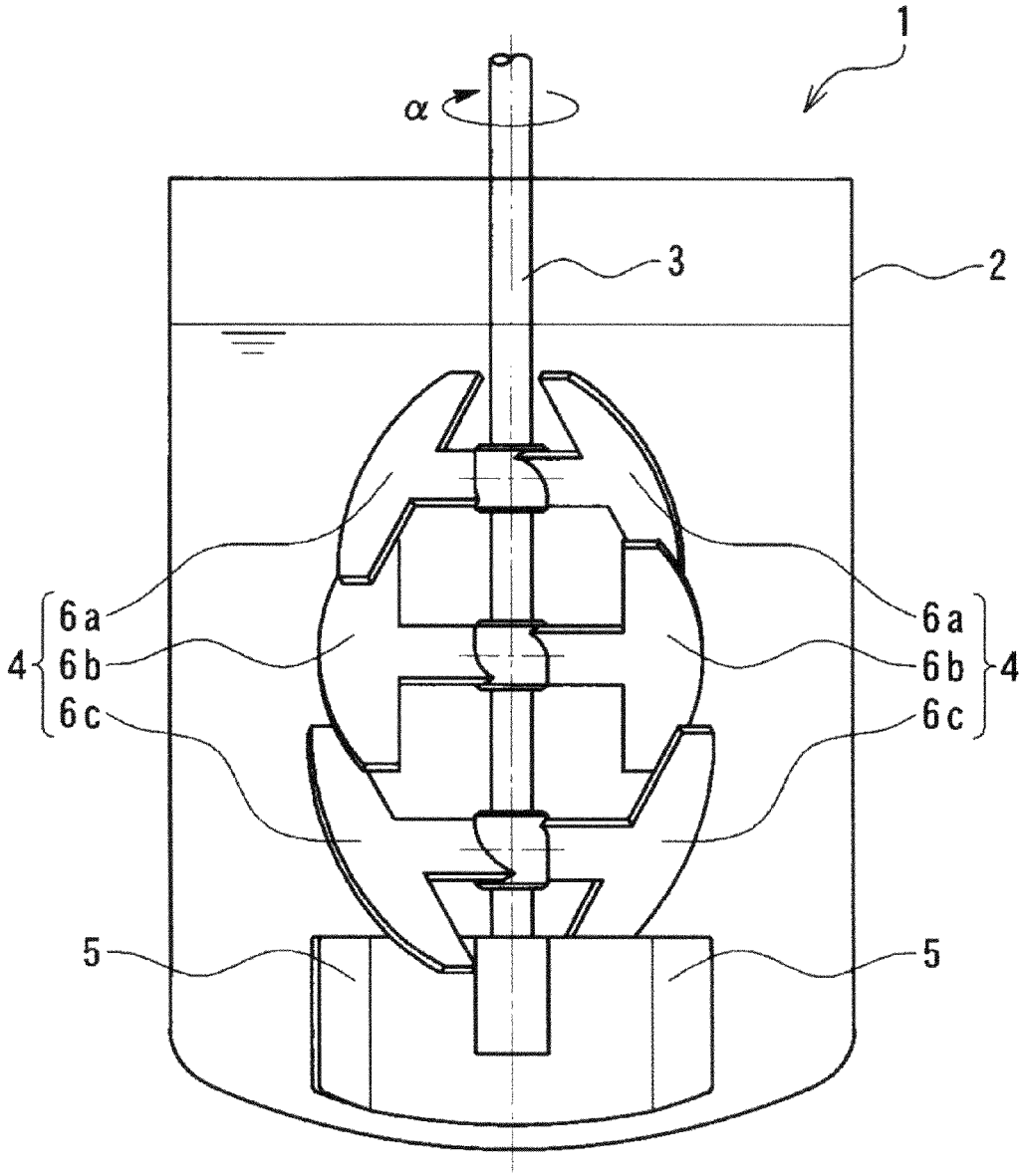
FIG. 1 is a front view showing an agitation apparatus 1 according to one embodiment of the present invention.

An agitation apparatus 1 according to the present invention includes an agitation vessel, an agitation shaft, and upper blade sets and lowers blade fixed to the agitation shaft. Each of the upper blade sets includes upper agitation blades arranged at a plurality of levels. As viewed from above, each of the upper agitation blades has cutout portions, which are located at positions forward and rearward in the rotating direction in a range between lines connecting two blade end portions of the upper agitation blade to the center of the agitation shaft. Each upper agitation blade is inclined at an elevation angle with respect to the rotating direction. A highest upper agitation blade is arranged forward from an adjacent lowest upper agitation blade with respect to the rotating direction in such a manner that the highest upper agitation blade has an overlapped portion with respect to the adjacent lowest upper agitation blade. As viewed from the side, the horizontal cross section including the lower end of the highest upper agitation blade is arranged below the horizontal cross section including the upper end of the adjacent lowest upper agitation blade. A lowest upper agitation blade among the upper agitation blades is arranged to be vertically adjacent to the corresponding one of the lower blades. As viewed from above, a line on a plane connecting the lower end portion of the lowest upper agitation blade to the center of the agitation shaft is arranged at a predetermined angle with respect to the center line of the lower blade in a blade radial direction. As viewed from the side, the horizontal cross section including the lower end portion of the lowest upper agitation blade is arranged below the horizontal cross section including the upper end portion of the lower blade, and the lower end portion of the lower blade is arranged close to the inner bottom surface of the agitation vessel.

In the above-described configuration, when the agitation shaft is rotated, each cutout portion formed in the upper agitation blade forms a small vortex flow (a descending flow), which rotates in the opposite direction to the rotating direction of the agitation shaft, at a position behind the upper agitation blade with respect to the rotating direction of the blade. The small vortex flow rides on a great vortex flow (a descending flow) rotating about the agitation shaft in the same direction as the rotating direction of the blade, which is formed through rotation of the agitation shaft, thus forming a flow that orbits while spinning.

When the upper agitation blades are arranged at a plurality of levels in the agitation vessel along the vertical direction, the small vortex flow is produced by each of the agitation blades at all levels.

Each small vortex flow, unlike the aforementioned great vortex flow, is not oriented in the vertical direction. The distal end (the lower end) of the small vortex flow is slightly retarded with respect to rotation of the corresponding blade, or in other words, has a shape that is slightly inclined rearward with respect to the rotating direction of each blade. Accordingly, if the multiple levels of the upper agitation blades are arranged in the agitation vessel, higher ones of the vertically adjacent upper agitation blades are arranged forward from lower ones with respect to the rotating direction of the blade and at a predetermined phase difference angle. The horizontal cross section including the lower end of each upper agitation blade at a higher position is arranged below the horizontal cross section including the upper end of the adjacent upper agitation vane at a lower position. As a result, the small vortex flows are connected together in the vertical direction. This produces an intense descending flow that extends from the vicinity of the fluid level in the upper portion of the agitation vessel to the vicinity of the corresponding lower blade.

The descending flow is transferred from the upper blade set to the corresponding lower blade. At this stage, since the upper side portion of each lower blade and the lower end portion of the corresponding lowest upper agitation blade are spaced apart at a sufficient interval in a horizontal direction, the descending flow is extended in the horizontal direction in the space formed by the upper end portion of the lower blade and the lower end portion of the lowest upper agitation blade. Then, the descending flow is drawn to the proximity of the vessel bottom surface in a manner wrapping around the lower blades, thus promoting mixing. In this manner, the descending flow is converted into an outward flow.

The outward flow produced by each lower blade hits the vessel wall surface and is thus converted into an ascending flow. Afterwards, the ascending flow reaches the vicinity of the fluid level in the upper portion of the agitation vessel without being cut by the outward flows generated by the upper blade sets. The ascending flow is then converted first into a flow toward the agitation shaft in the vicinity of the fluid level and then into a descending flow through operation of the highest upper agitation blade.

As has been described, the upper blade set forms the intense descending flow, which is caused by the small vortex flow and orbit while spinning. The intense descending flow is locally curved into the horizontal direction in the space formed by the lower end portion of the lowest upper agitation blade and the upper end portion of the lower blade. The flow is then converted into an intense and continuous vertically circulating flow. In this manner, unlike the conventional techniques, efficient agitation and mixing are brought about.

Figure 7:
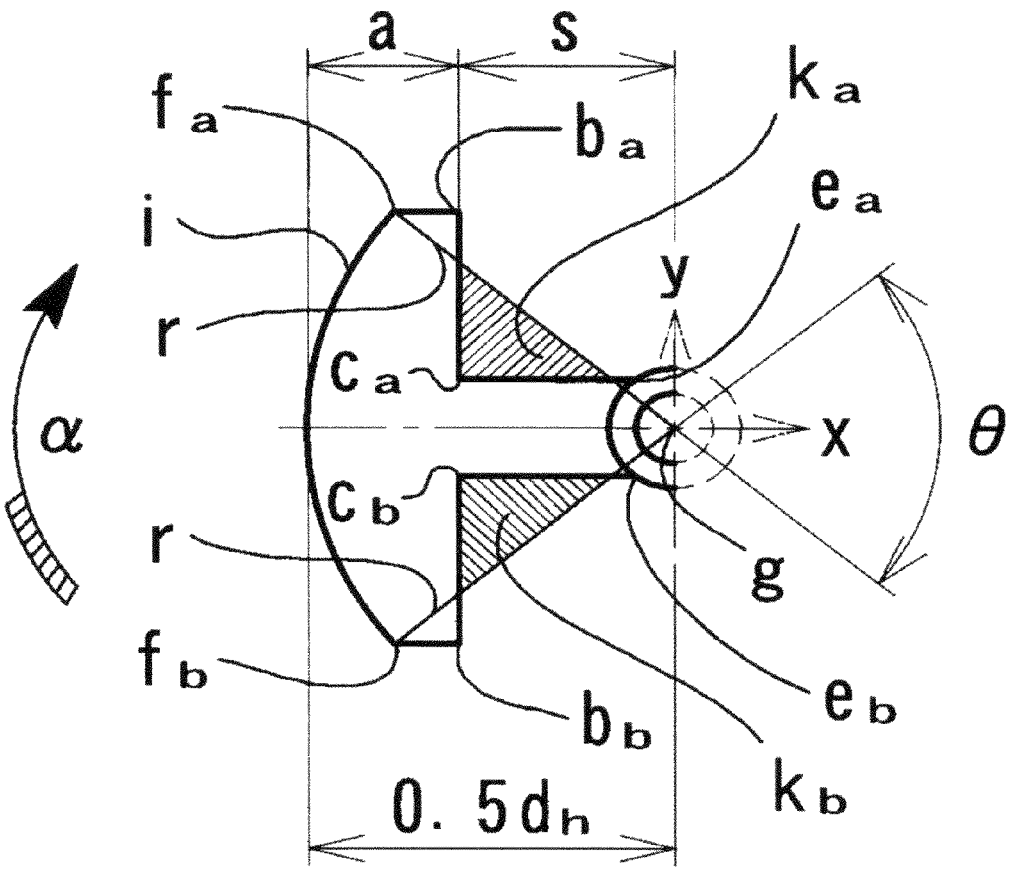
FIG. 7 is a schematic diagram illustrating an upper agitation blade of the agitation apparatus 1 of one embodiment as viewed from above.
Figure 8:
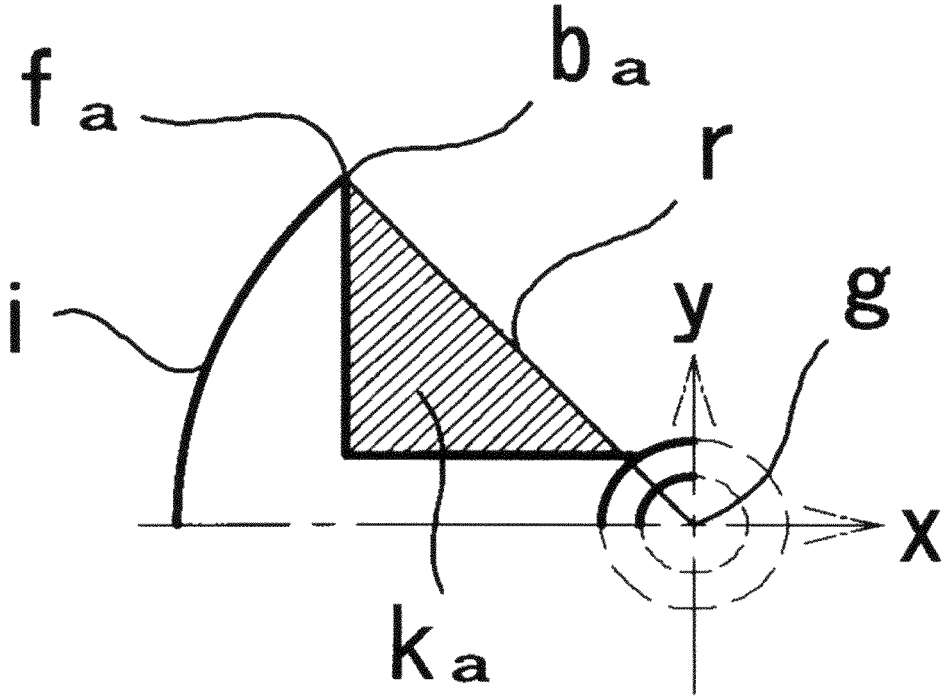
FIG. 8 is a schematic diagram illustrating the upper agitation blade of the agitation apparatus 1 of another embodiment as viewed from above.
Figure 9:
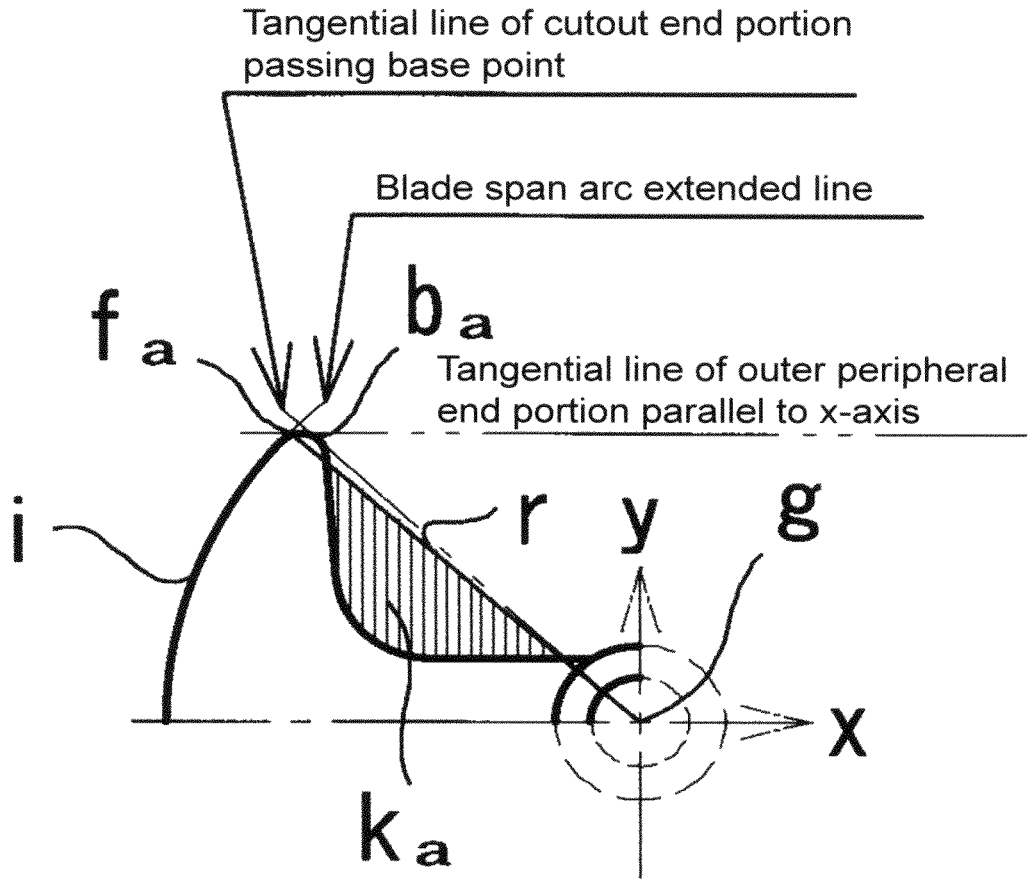
FIG. 9 is a schematic diagram illustrating the upper agitation blade of the agitation apparatus 1 of another embodiment as viewed from above.
Figure 10:
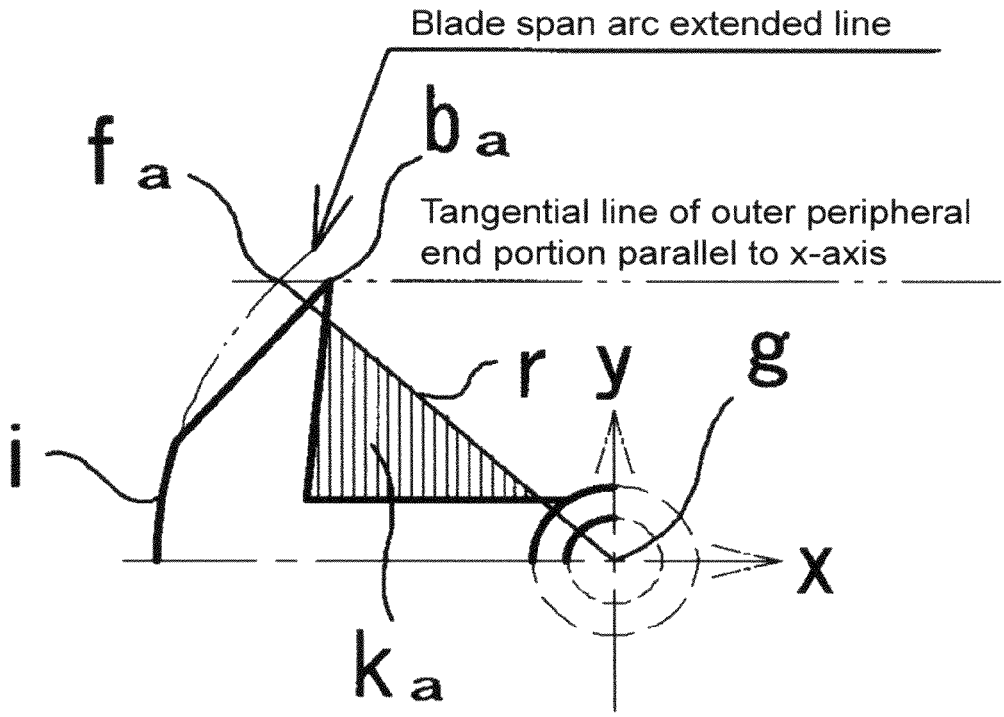
FIG. 10 is a schematic diagram illustrating the upper agitation blade of the agitation apparatus 1 of another embodiment as viewed from above.
Figure 11:
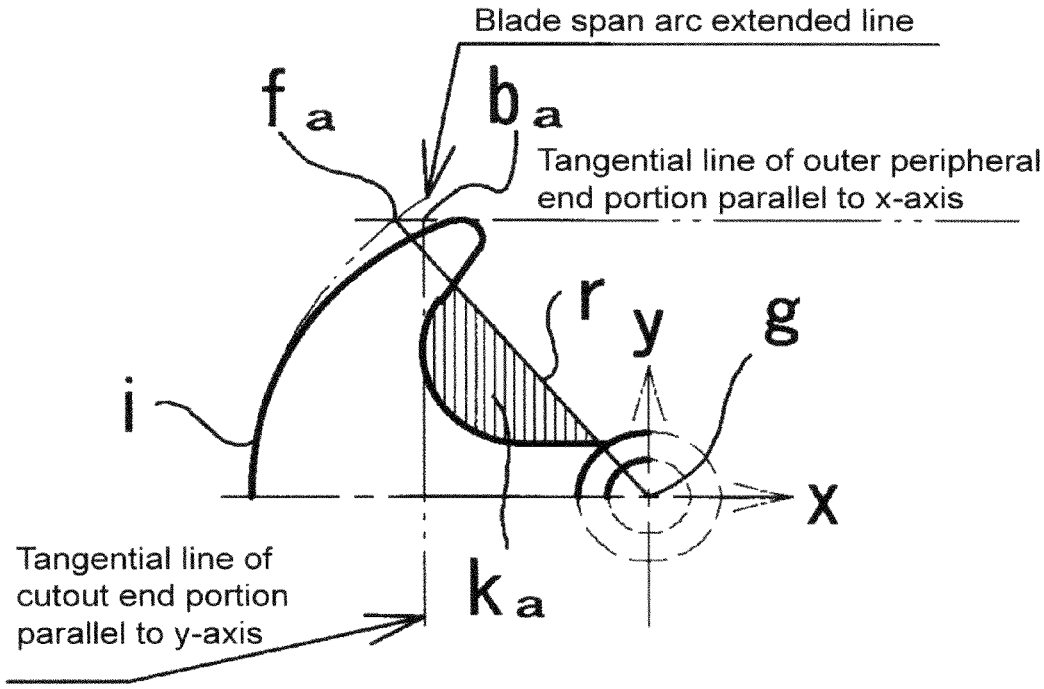
FIG. 11 is a schematic diagram illustrating the upper agitation blade of the agitation apparatus 1 of another embodiment as viewed from above.
Figure 12:
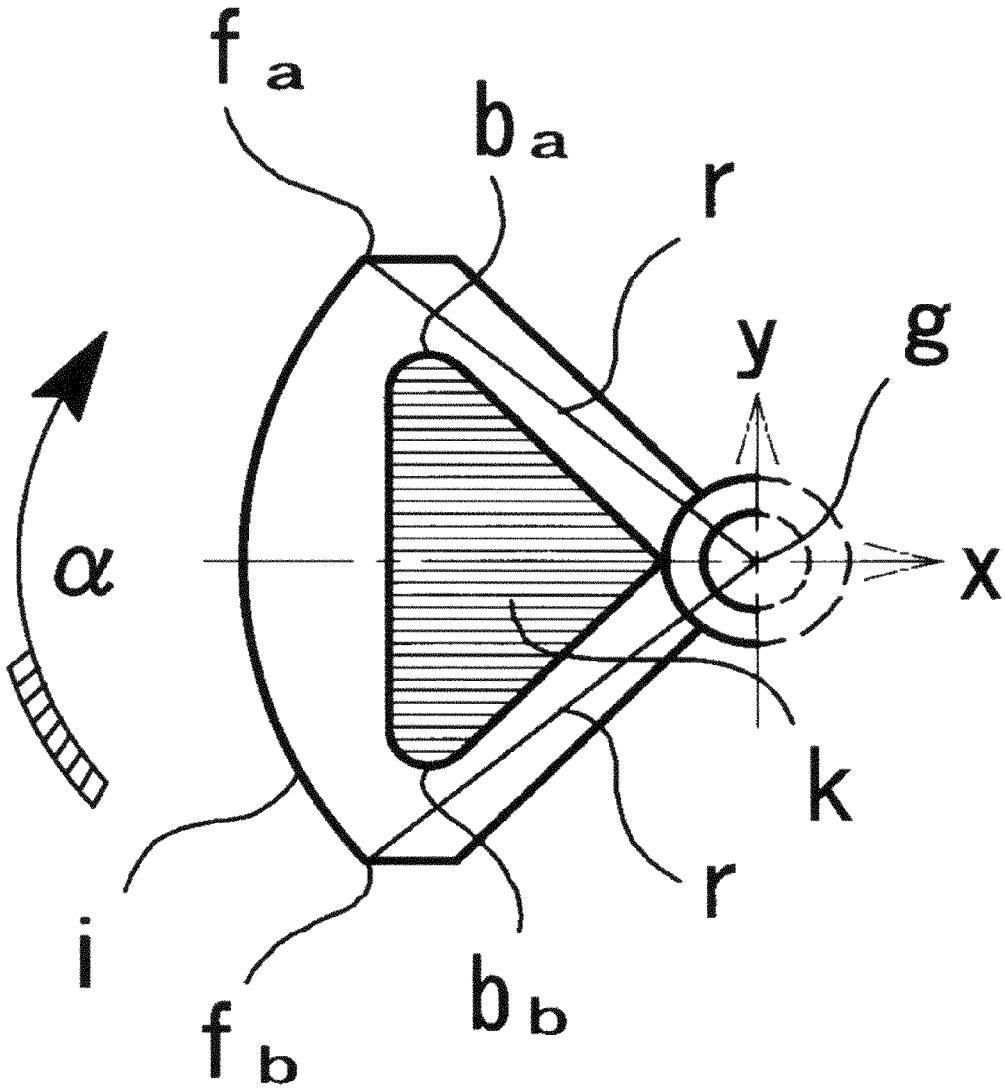
FIG. 12 is a schematic diagram illustrating the upper agitation blade of the agitation apparatus 1 of another embodiment as viewed from above.
Figure 13:
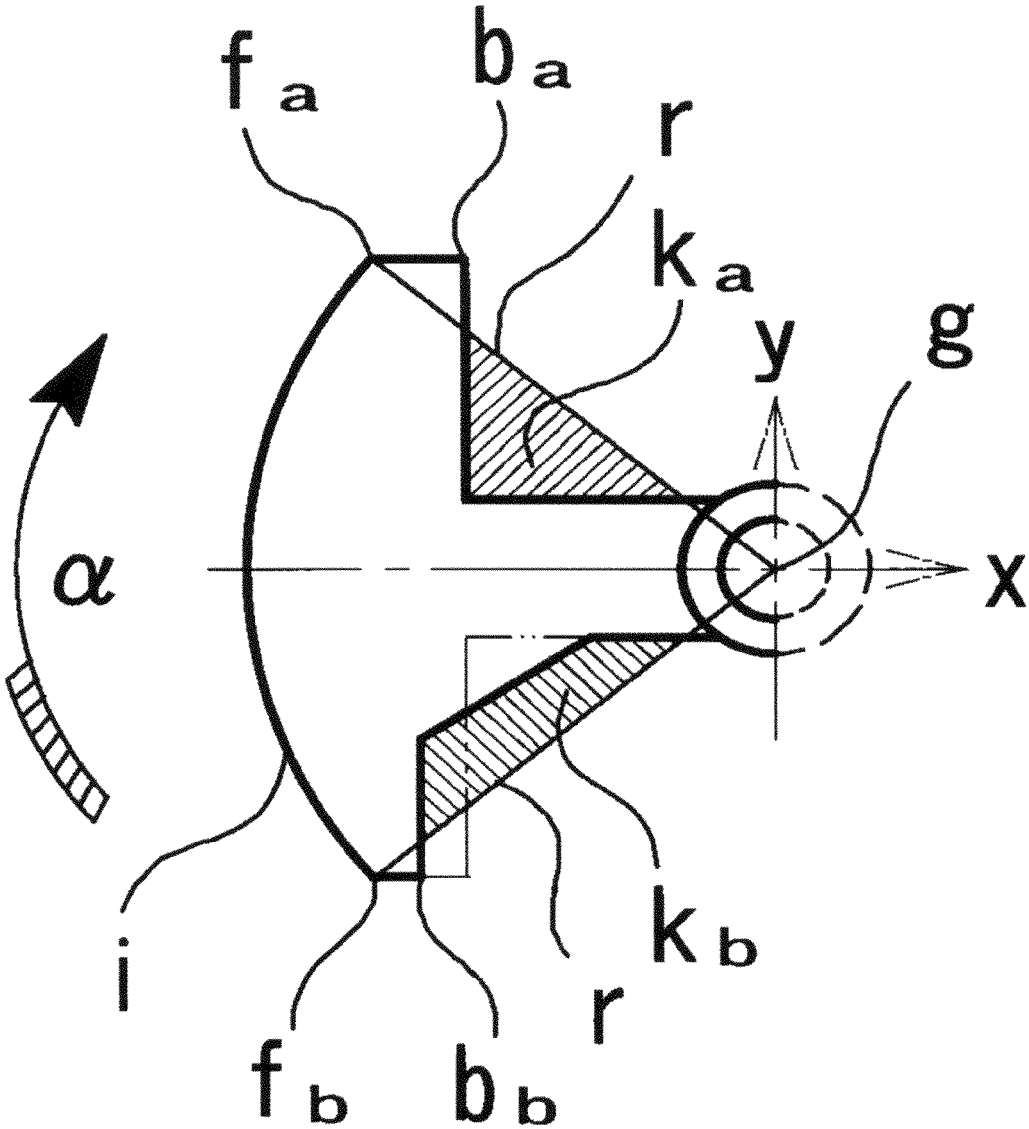
FIG. 13 is a schematic diagram illustrating the upper agitation blade of the agitation apparatus 1 of another embodiment as viewed from above.

With reference to FIG. 7, when the center of the agitation shaft as viewed from above is defined as the base point g and an x-y coordinate is defined with the center line of each blade (the symmetry axis in the case of a blade formed symmetrically and the design center if the blade is asymmetrical) as the x-axis, an outer peripheral portion i of the upper agitation blade as viewed from above is considered as an arc (a blade span arc), and the angle formed by an upper end portion point $f_a$ on the blade outer periphery i, a lower end portion point $f_b$, and the base point g is defined as an angle θ, the upper agitation blade is formed to preferably satisfy the expression: $30° \leqq \theta \leqq 150°$, and more preferably satisfy the expression: $60° \leqq \theta \leqq 120°$.

The above-described configuration reliably enlarges the range in which the upper agitation blades operate in both of the horizontal direction and the vertical direction. As a result, an intense descending flow is generated.

Further, each upper agitation blade is formed in such a manner that, as viewed from above, the proportion h of the total surface area k of the cutout portions (or the openings) with respect to an arcuate surface area j defined by the blade outer periphery i and the angle θ preferably satisfies the expression: $0.08 \leqq h \leqq 0.5$, and more preferably satisfies the expression: $0.1 \leqq h \leqq 0.3$.

Also, with reference to FIG. 7, the upper agitation blade is formed in such a manner that, on the x-y coordinate as viewed from above, the parallel distance $s_a$ ($s_b$) between the cutout portion upper (lower) end portion $b_a$ ($b_b$) and the y-axis satisfies the expression: $s_a$ ($s_b$)$\geqq$0.1D with respect to the agitation vessel inner diameter D and the distance $a_a$ ($a_b$) between a tangential line of the outer periphery i parallel with the y-axis and the cutout portion upper (lower) end portion $b_a$ ($b_b$), or in other words, the width of a longitudinal plate portion of the upper agitation blade, satisfies the expression: $a_a$ ($a_b$)$\geqq$0.05D, with respect to the agitation vessel inner diameter D.

In the above-described configuration, an appropriate space is formed around the agitation shaft. This reduces the rate by which the path of the descending flow is interfered by the blades. Accordingly, the descending flow, which is generated through operation of each upper blade, is allowed to efficiently flow toward the corresponding lower blade. Also, by arranging a number of effective surfaces of the upper blade at positions spaced from the agitation shaft, an intense descending flow (a vortex flow rotating in the same direction as the rotating direction of the agitation shaft) and a small vortex flow (a descending flow) rotating (spinning) in the opposite direction to the rotating direction of the agitation shaft are produced. By forming the appropriate space around the agitation shaft, the outward flow produced by each upper blade becomes relatively weak, thus preventing generation of a flow that cuts a vertically circulating flow. Further, since the surface area of each upper blade is reduced, risks of powder adhesion to blade upper surfaces, which hampers mixing, are decreased when powder is mixed with liquid. Also, since adhesion of a substance to be agitated to the blades is decreased, yield is improved and cleansing is facilitated. Further, the vessel bottom portion is easily visible from above the vessel. This facilitates maintenance work and reduces the power required for agitation to a low level.

Figure 4:
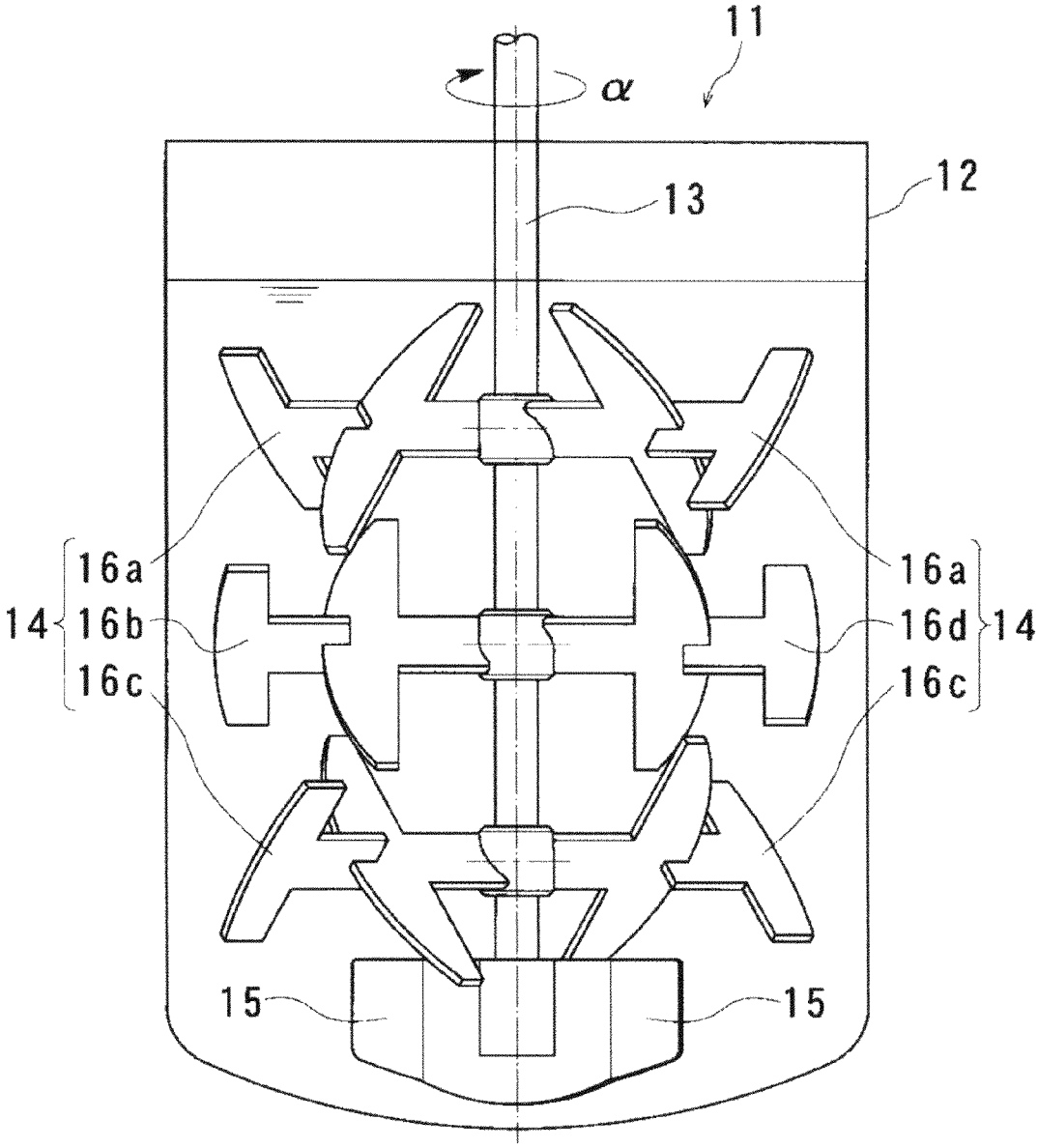
FIG. 4 is a front view showing an agitation apparatus 11 according to another embodiment of the present invention.

With reference to FIG. 4, the upper blade sets are formed in such a manner that the phase difference angle ψbetween the x-axis of the lower one of the vertically adjacent upper agitation blades and the x-axis of the higher one of the adjacent agitation blades, as viewed from above preferably satisfies the expression: $10° \leqq \psi \leqq 50°$, and more preferably satisfies the expression: $15° \leqq \psi \leqq 45°$, from the x-axis of the lower one of the adjacent upper agitation blades to the x-axis of the upper one, in the rotating direction of the agitation shaft.

In the above-described configuration, when the upper agitation blades are arranged at the multiple levels in the vertical direction, the small vortex flows (the descending flows) rotating in the opposite direction to the rotating direction of the agitation shaft, which are generated through the operation of the upper agitation blades, are allowed to be connected together continuously from the highest upper agitation blades to the lowest upper agitation blades.

Figure 15:
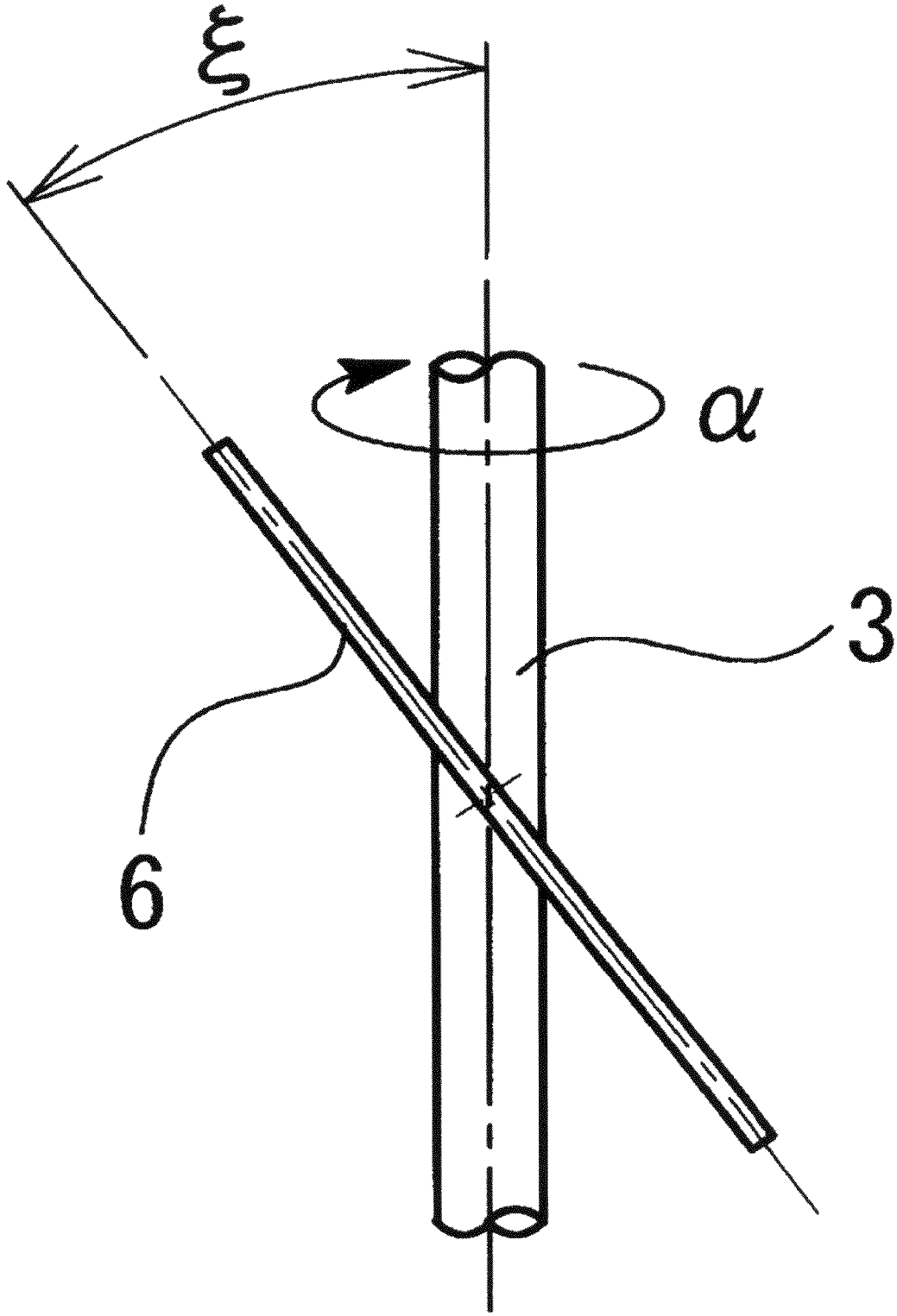
FIG. 15 is a side view showing an upper agitation blade of the agitation apparatus 1 of the embodiment, illustrating an elevation angle of the upper agitation blade with respect to the rotating direction of an agitation shaft.
Figure 16:
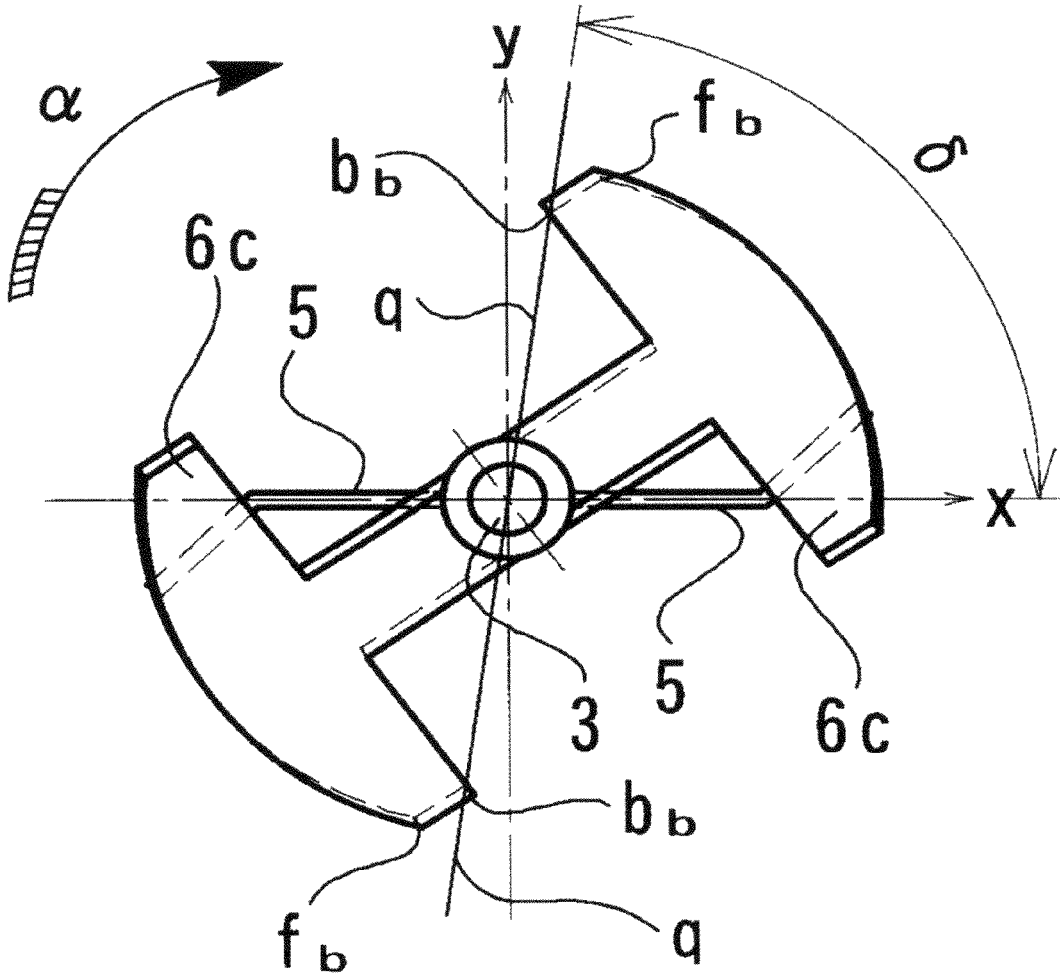
FIG. 16 is a plan view illustrating a horizontal interval and a phase difference angle between a lower end portion of a lowest upper agitation blade and an upper side portion of a lower blade of the agitation apparatus 1 of the embodiment.

With reference to FIG. 15, the predetermined elevation angle ξ of each upper agitation blade with respect to the rotating direction of the agitation shaft preferably satisfies the expression: $30° \leqq \xi \leqq 60°$ (more preferably satisfies $35.56° \leqq \xi \leqq 54.4°$).

In the above-described configuration, the small vortex flows (the descending flow) are efficiently produced through the operation of the upper agitation blades.

Figure 2:
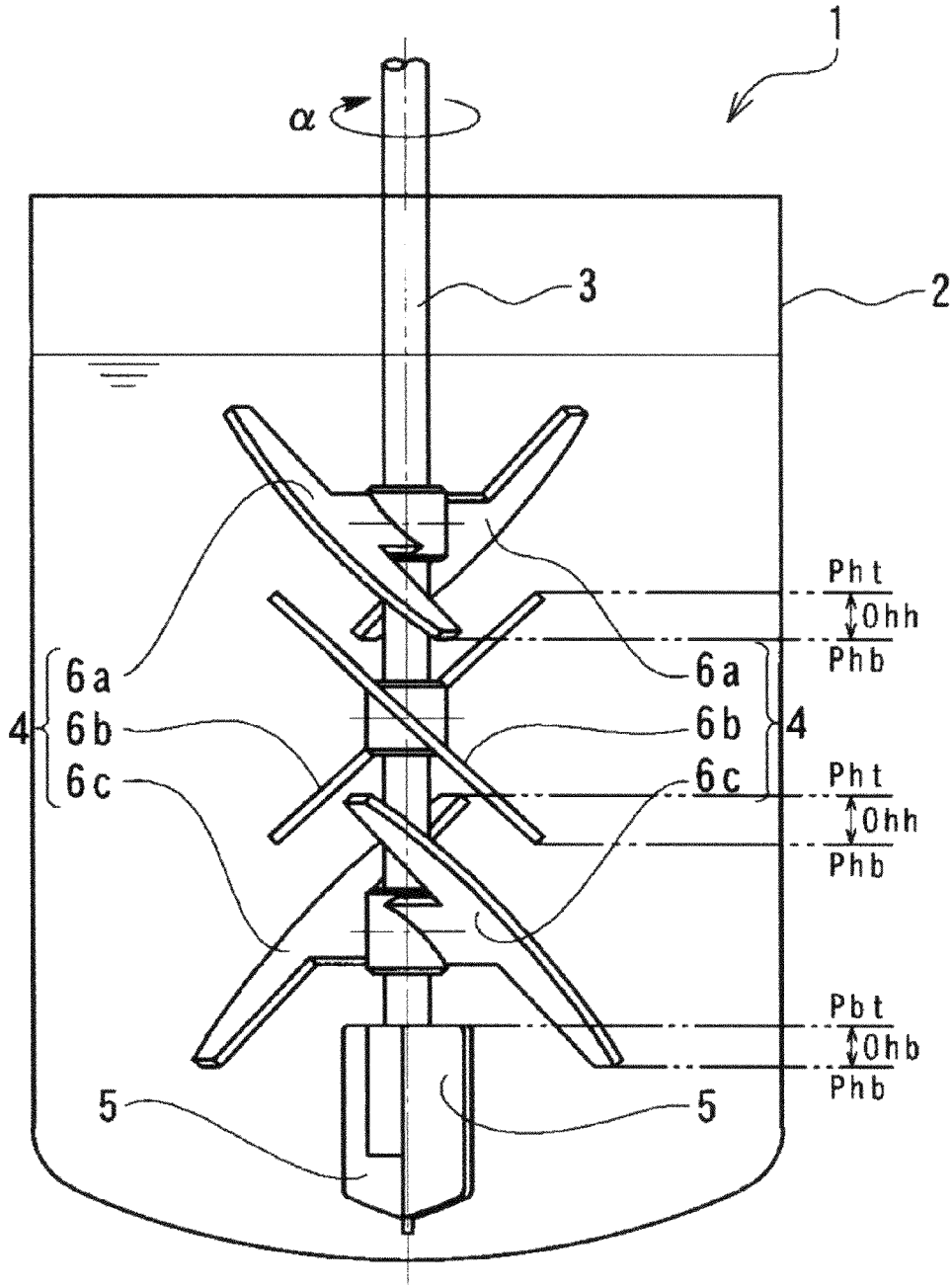
FIG. 2 is a side view showing the agitation apparatus 1 of the embodiment.

Further, as illustrated in FIG. 2, the upper blade sets are formed in such a manner that the horizontal cross section Phb including the lower end $f_b$ of the higher ones of the vertically adjacent upper agitation blades is arranged below the horizontal cross section Pht including the upper end $f_a$ of the adjacent lower upper agitation blade, and that the Phb-Pht distance Ohh preferably satisfies the expression: 0.005 D$\leqq$Ohh$\leqq$0.3 D, and more preferably satisfies the expression: 0.01 D$\leqq$Ohh$\leqq$0.15 D, with respect to the agitation vessel inner diameter.

In this manner, the operating range of the upper agitation blade at a higher position is overlapped with the operating range of the adjacent lower upper agitation blade. This allows the descending flow, which is generated by the higher upper agitation blade, to be transferred to the adjacent lower upper agitation blade without being cut. As a result, a continuous and intense descending flow extending from the vicinity of the upper end of the highest upper agitation blade (the proximity of the fluid level) to the vicinity of the lower end of the lowest upper agitation blade is formed.

Also, the horizontal cross section Phb including the lower end $f_b$ of the lowest upper agitation blade of each upper blade set is preferably arranged below the horizontal cross section Pbt including the upper end of the corresponding lower blade adjacent to and below the lowest upper agitation blade. The Phb-Pbt distance Ohb preferably satisfies the expression: 0.005 D$\leqq$Ohb$\leqq$0.3 D, and more preferably satisfies the expression: 0.01 D$\leqq$Ohb$\leqq$0.15 D, with respect to the agitation vessel inner diameter D.

Further, the lower blades are arranged in such a manner that, when an x-y coordinate is defined with the center of the agitation shaft serving as the base point and the center line of the lower blade extending from the agitation shaft toward the agitation vessel inner wall surface serving as the x-axis, as viewed from above, and the lowest upper agitation blades, which are vertically adjacent to the lower blades, are arranged on the x-y coordinate, the angle δ between the line q extending from the center of the agitation shaft to the lower end portion $b_b$ of the cutout portion of the lowest upper agitation blade and the x-axis preferably satisfies the expression: $60° \leqq \delta \leqq 110°$, and more preferably satisfies the expression: $70° \leqq \delta \leqq 100°$ from the x-axis toward the y-axis and in the opposite direction to the rotating direction of each blade.

In the above-described configuration, the descending flow formed by each upper blade set is transferred to the corresponding lower blade from the lowest upper agitation blade. A space is formed between the lower end portion of the lowest upper agitation blade and the upper end portion of the lower blade. Accordingly, without being directly transferred to the lower blade, the descending flow is extended in the horizontal direction in the space, in a manner wrapping around the lower blade. This forms a vertically circulating flow throughout the agitation vessel, which is shaped differently from the shapes of the flows generated by the conventional agitation apparatuses 21, 31, 41. As a result, highly efficient agitation covering a wide spectrum of viscosities and efficient agitation/mixing of fluids with different viscosities are brought about.

Further, the lower blades are wide retreating paddle blades. The blade diameter (the blade span) db of each lower blade preferably satisfies the expression $0.4D \leqq db \leqq 0.8D$, with respect to the agitation vessel inner diameter D. With reference to FIG. 7, the blade diameter (the blade span) dh of each upper blade set preferably satisfies the expression: $0.35D \leqq dh \leqq 0.75D$, and more preferably satisfies the expression: $0.4D \leqq dh \leqq 0.7D$, with respect to the agitation vessel inner diameter D.

In the above-described configuration, both of the lower blades and the upper blade sets ensure sufficient operating ranges in the agitation vessel with respect to fluid. As a result, each lower blade produces an intense outward flow hitting the vessel wall and converted into an ascending flow, and each upper blade set generates an intense descending flow extending from the vicinity of the fluid level in the upper portion of the vessel toward the vicinity of the upper end portion of the lower blade. Also, in this configuration, an appropriate space is formed between the agitation vessel wall surface and the outer peripheral portion of each blade. This sufficiently ensures the path of the ascending flow produced by each lower blade and decreases the risk that an outward flow generated by each upper blade set cuts the ascending flow produced by the lower blade.

An agitation apparatus 11 according to the present invention is an agitation apparatus having an agitation vessel, an agitation shaft, and upper blade sets and lower blades fixed to the agitation shaft. Each of the upper blade sets is configured by upper agitation blades that are arranged at a plurality of levels. Each of the upper agitation blades is constituted by an inner blade portion connected to the agitation shaft and an outer blade portion connected to the inner blade portion at the side corresponding to the inner wall of the agitation vessel. As viewed from above, the inner blade portion of each upper agitation blade has cutout portions, which are arranged at positions forward and rearward in the rotating direction in the range between the lines connecting the two blade end portions of the inner blade portion to the center of the agitation shaft. The inner blade portion is inclined at an elevation angle with respect to the rotating direction. A highest upper agitation blade is arranged forward from an adjacent lowest upper agitation blade in the rotating direction in such a manner that the highest upper agitation blade has overlapped portions with respect to the adjacent upper agitation blade at the lower. Further, as viewed from the side, the horizontal cross section including the lower end of the highest upper agitation blade is arranged below the horizontal cross section including the upper end of the adjacent lowest upper agitation blade. As viewed from above, the outer blade portion of each upper agitation blade has cutout portions, which are arranged and at positions forward and rearward in the rotating direction and from the outer periphery of the inner blade portion toward the inner wall of the agitation vessel in the space between the lines connecting the two blade end portions of the outer blade portion to the center of the agitation shaft. The outer blade portion is inclined at a downward angle with respect to the rotating direction. The outer periphery of the outer blade portion of each upper agitation blade is arranged close to and along the inner wall of the agitation vessel. Those located at the lowest level of the upper agitation blades are arranged adjacent to the lower blades in a vertical direction. As viewed from above, the line on a plane connecting the lower end portion of the outer blade portion of the lowest upper agitation blade to the center of the agitation shaft is arranged at a predetermined angle with respect to the center line of the lower blade in a blade radial direction. As viewed from the side, the horizontal cross section including the lower end of the lowest upper agitation blades is arranged below the horizontal cross section including the upper end of the lower blade. The lower end portion of the lower blade is arranged close to the inner bottom surface of the agitation vessel.

In other words, the agitation apparatus 11 according to the present invention is configured basically in accordance with the agitation apparatus 1 of the invention. In the agitation apparatus 11, an outer blade portion is added to each upper agitation blade of the agitation apparatus 1. The blade diameters of the upper blade sets and the lower blades, the phase difference angle between the blades, and the vertical overlapping amount are optimized in this embodiment.

In the above-described configuration, when the agitation shaft is rotated, the cutout portions formed in the inner blade portion of each upper agitation blade form a small vortex flow (a descending flow) rotating in the opposite direction to the rotating direction of each agitation blade at a position behind the upper agitation blade with respect to the blade rotating direction. The small vortex flow rides on a great vortex flow (a descending flow) that flows about the agitation shaft and rotates in the same direction as the rotating direction of the blade, which is formed through rotation of the agitation shaft. The small vortex flow thus forms a flow that orbits while spinning.

When the upper agitation blades are arranged at the multiple levels in the vertical direction in the agitation vessel, the small vortex flow is produced by each agitation blade of all levels.

The small vortex flow, unlike the aforementioned great vortex flow, is not oriented in the vertical direction. The distal end (the lower end) of the small vortex flow is slightly retarded with respect to rotation of the blades, or in other words, has a shape that is inclined slightly rearward with respect to the rotating direction of each blade. Accordingly, if the multiple levels of the upper agitation blades are arranged in the agitation vessel, the higher one of the vertically adjacent upper agitation blades is located forward from the adjacent lower upper agitation blade with respect to the rotating direction of the blade and at a predetermined phase difference angle. The horizontal cross section including the lower end of the higher upper agitation blade is arranged below the horizontal cross section including the upper end of the adjacent lower upper agitation blade. As a result, the small vortex flows are connected together in the vertical direction. This produces an intense descending flow that extends from the vicinity of the fluid level in the upper portion of the agitation vessel to the vicinity of the lower blade.

The descending flow is transferred from the upper blade set to the lower blade. At this stage, since the upper end portion of the lower blade and the lower end portion of the inner blade portion of the lowest upper agitation blade are spaced apart at a sufficient interval in a horizontal direction, the descending flow is extended in the horizontal direction in the space formed by the upper end portion of the lower blade and the lower end portion of the inner blade portion of the lowest upper agitation blade. Afterwards, the descending flow is drawn to the proximity of the vessel bottom surface in a manner wrapping around the lower blade, thus promoting mixing. In this manner, the descending flow is converted into an outward flow.

The outward flow produced by the lower blade hits the vessel wall surface and is converted into an ascending flow. Afterwards, the ascending flow reaches the vicinity of the fluid level in the upper portion of the agitation vessel, together with the ascending flow produced through operation of the outer blade portion of each upper agitation blade. The ascending flow is then converted into a flow toward the agitation shaft in the vicinity of the fluid level and then into a descending flow through operation of the inner blade portion of the highest upper agitation blade.

As has been described, each upper blade set forms an intense descending flow, which is caused by the small vortex flows that orbit while spinning. The intense descending flow is locally curved into the horizontal direction in the space formed by the lower end portion of the inner blade portion of the lowest upper agitation blade and the upper end portion of the lower blade. The flow is thus transferred smoothly to the lower blade and converted into an ascending flow caused by the outward flow produced by the lower blade. The flow is then merged into an ascending flow generated through scraping operation of the outer blade portion of the upper agitation blade, thus forming an intense and continuous vertically circulating flow. In this manner, unlike the conventional techniques, efficient agitation and mixing are brought about.

Figure 20:
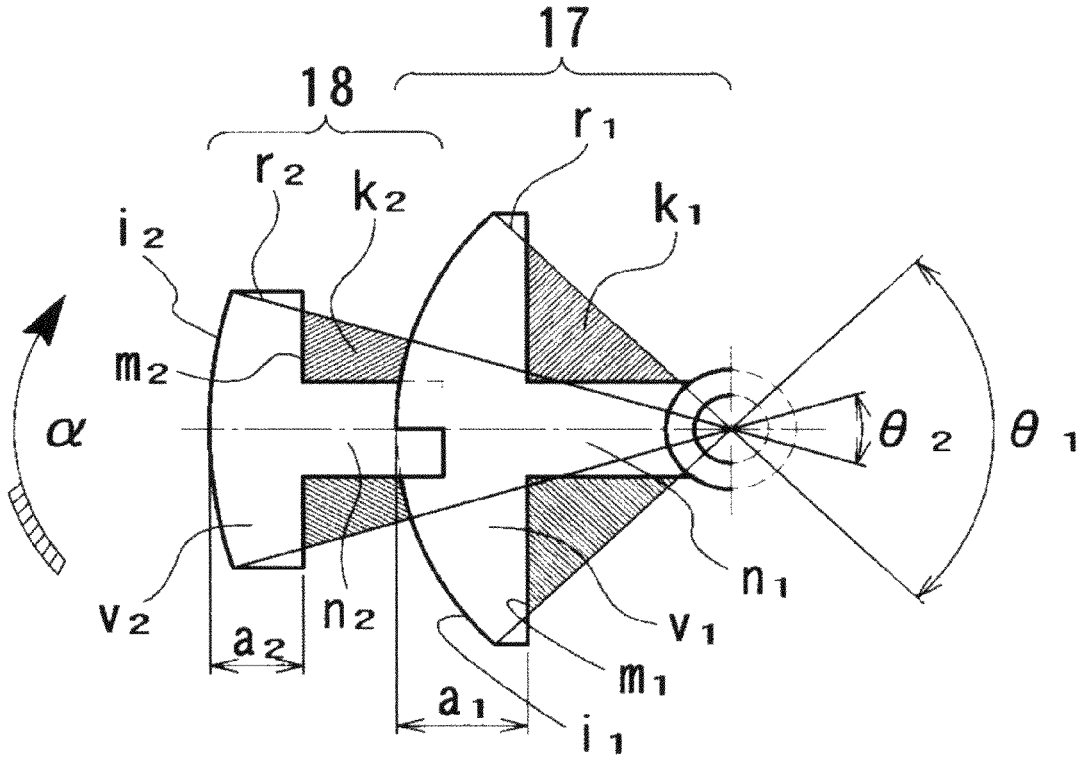
FIG. 20 is a plan view schematically showing the basic configuration of an upper agitation blade of the agitation apparatus 11 of the embodiment.

When the outer periphery $i_1$ of the inner blade portion of each upper agitation blade, as viewed from above, is considered as an arc, and the angle formed by the upper end and the lower end of the outer periphery $i_1$ and the center of the agitation shaft is defined as an angle $\theta_1$, the inner blade portion preferably satisfies the expression $60° \leqq \theta_1 \leqq 120°$ (see FIG. 20).

The above-described configuration reliably enlarges the range in which the inner blade portions of the upper agitation blades operate in both of the horizontal direction and the vertical direction. As a result, an intense descending flow is generated.

When the outer periphery $i_2$ of the outer blade portion of each upper agitation blade, as viewed from above, is considered as an arc and the angle formed by the upper end and the lower end of the outer periphery $i_2$ of the outer blade portion and the center of the agitation shaft is defined as an angle $\theta_2$, the outer blade portion preferably satisfies the expression $25° \leqq \theta_2 \leqq 50°$.

Further, in each upper agitation blade as viewed from above, the width $a_1$ of a longitudinal plate portion of the inner blade portion and the width $a_2$ of a longitudinal plate portion of the outer blade portion preferably satisfy the expression: $0.05\ D \leqq (a_2 \leqq a_1) \leqq 0.15\ D$.

In the above-described configuration, an appropriate space is formed around the agitation shaft. This reduces the rate by which the path of the descending flow is interfered by the blades. Accordingly, the descending flow, which is generated through the operation of the inner blade portion of each upper agitation blade, is allowed to efficiently flow toward the lower blade. Also, by arranging a number of effective surfaces of the inner blade portions of the upper agitation blades at positions spaced from the agitation shaft, or in other words, by arranging the longitudinal plate portions $v_1$ of the inner blade portions at the positions spaced from the agitation shaft, an intense descending flow (a vortex flow rotating in the same direction as the rotating direction of the agitation shaft) and a small vortex flow (a descending flow) rotating (spinning) in the opposite direction to the rotating direction of the agitation shaft are produced. Further, by connecting each outer blade portion to the corresponding inner blade portion at the side corresponding to the inner wall of the agitation vessel, a descending flow is produced by the inner blade portion and an ascending flow is produced by the outer blade portion with the fluid in the vicinity of the vessel wall surface scraped off by the outer blade portion. Also, the cutout portions $k_2$ formed in the outer blade portion provide an appropriate level of shearing operation to a substance to be processed. Further, the outward flow generated by the inner blade portion and the ascending flow produced by the outer blade portion are intertwined with each other in the space between the side (the longitudinal side portion) $m_2$ of the longitudinal plate portion $v_2$ of the outer blade portion at the side corresponding to the agitation shaft and the outer periphery $i_1$ of the inner blade portion, thus forming a complex flow. As in the case of a Kenics type static mixer element arranged in a pipe, which divides a flow and reverses and merges the divided flows together, the flow is divided, reversed, and merged into each other in the proximity of the joint portion between the inner blade portion and the outer blade portion of the upper agitation blade and the cutout portions of the outer blade portion, thus promoting mixing of substances to be processed.

Figure 21:
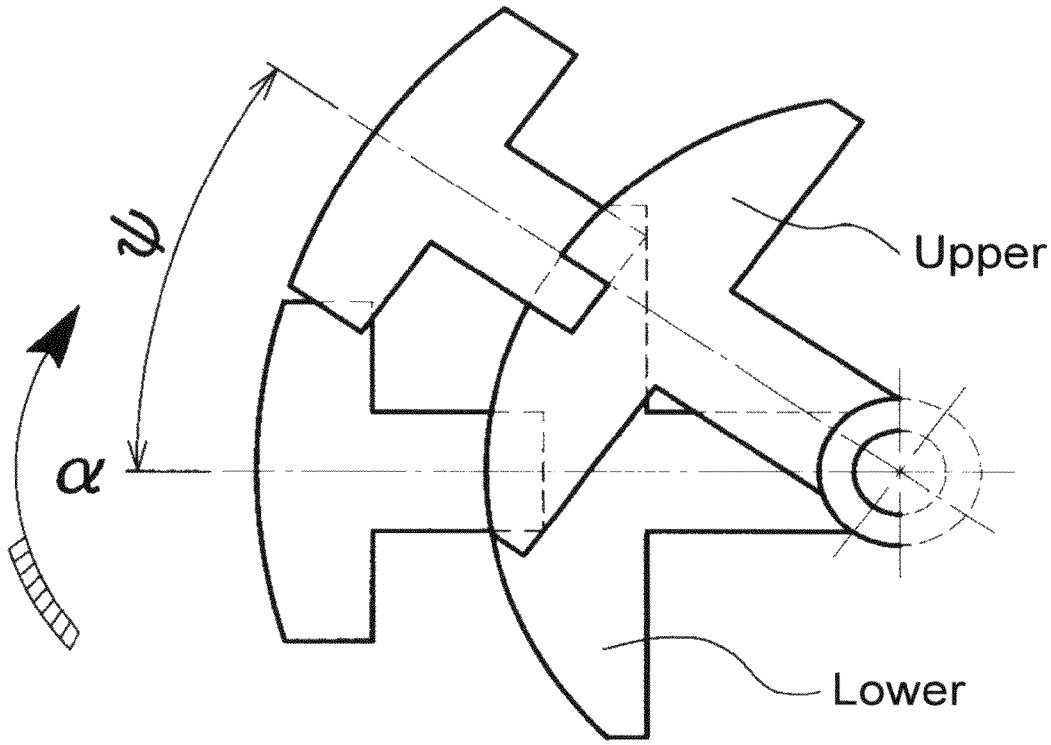
FIG. 21 is a schematic diagram illustrating a phase difference angle between vertically adjacent upper agitation blades of the agitation apparatus 11 of the embodiment as viewed from above.

The upper blade sets are formed in such a manner that, as viewed from above, the phase difference angle $\psi$ between the center line of the lower one of the vertically adjacent upper agitation blades and the center line of the adjacent higher upper agitation blade preferably satisfies the expression: $10° \leqq \psi \leqq 50°$, and more preferably satisfies the expression: $15° \leqq \psi \leqq 45°$, in the rotating direction of the agitation shaft, from the center line of the lower upper agitation blade to the center line of the adjacent higher upper agitation blade (see FIG. 21).

In the above-described configuration, when the multiple levels of the upper agitation blades are arranged in the vertical direction, the small vortex flows (the descending flows) that are generated through the operation of the upper agitation blades and rotate in the opposite direction to the rotating direction of the agitation shaft are allowed to be connected together continuously from the highest upper agitation blades to the lowest upper agitation blades.

Also, the predetermined elevation angle $\xi_1$ of the inner blade portion of each upper agitation blade with respect to the rotating direction of the agitation shaft preferably satisfies the expression: $30° \leqq \xi_1 \leqq 60°$, and the predetermined downward angle $\xi_2$ of the outer blade portion of the upper agitation blade with respect to the rotating direction of the agitation shaft preferably satisfies the expression: $30° \leqq \xi_2 \leqq 60°$ (see FIG. 22).

In the above-described configuration, the small vortex flows (the descending flows) are efficiently produced through operation of the inner blade portions of the upper agitation blades. Simultaneously, the ascending flows are efficiently generated in the vicinity of the inner wall of the agitation vessel through operation of the outer blade portions.

Figure 22:
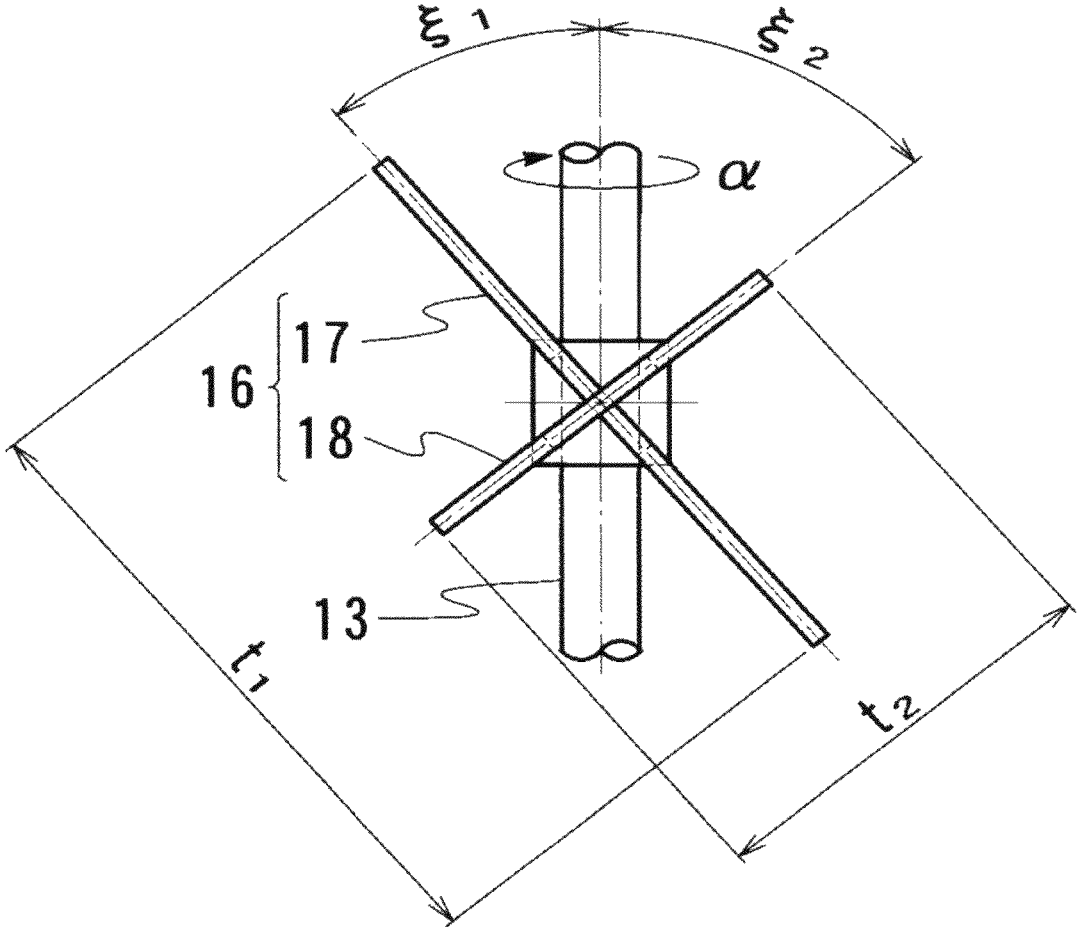
FIG. 22 is a side view illustrating an elevation angle of an inner blade portion and a downward angle of an outer blade portion of an upper agitation blade of the agitation apparatus 11 of the embodiment with respect to the rotating direction of the agitation shaft, as viewed from above.

In each upper agitation blade, as viewed from the side, the length $t_1$ of the longitudinal plate portion of the inner blade portion and the length $t_2$ of the longitudinal plate portion of the outer blade portion preferably satisfy the expression $t_2 \leqq t_1$ (see FIG. 22).

The above-described configuration decreases the resistance of the agitated fluid acting on the outer blade portion of each upper agitation blade, thus preventing increase of the power necessary for agitation. Also, the resistance (the force acting diagonally downward) of the agitated fluid applied to the outer blade portion and the resistance (the force acting diagonally upward) of the agitated fluid applied to the inner blade portion are easily equilibrated. In other words, the upper agitation blades receiving little twisting force. This makes it easy to ensure the mechanical strength of each upper agitation blade.

Further, the upper blade sets are formed in such a manner that the horizontal cross section Pcb including the lower end of the higher one of the vertically adjacent upper agitation blades is preferably arranged below the horizontal cross section Pct including the upper end of the adjacent lower upper agitation blade and that the Pcb-Pct distance Occ preferably satisfies the expression: 0.005 D≦Occ≦0.3 D, and more preferably satisfies the expression: 0.01 D≦Occ≦0.15 D, with respect to the agitation vessel inner diameter D (see FIG. 5).

In this manner, the operating range of the inner blade portion of the higher upper agitation blade is overlapped with the operating range of the inner blade portion of the adjacent lower upper agitation blade. This allows the descending flow, which is generated by the inner blade portion of the higher upper agitation blade, to be transferred to the inner blade portion of the adjacent lower upper agitation blade without being cut. As a result, a continuous intense descending flow extending from the vicinity of the upper end of the inner blade portion of each highest upper agitation blade (the proximity of the fluid level) to the vicinity of the lower end of the inner blade portion of each lowest upper agitation blade is formed.

Also, the horizontal cross section Pcb including the lower end of the lowest upper agitation blade of each upper blade set is preferably arranged below the horizontal cross section Pbt including the upper end of the corresponding lower blade adjacent to the lowest upper agitation blade. The Pcb-Pbt distance Ocb preferably satisfies the expression: 0.005 D≦Ocb≦0.3 D, and more preferably satisfies the expression: 0.01 D≦Ocb≦0.15 D, with respect to the agitation vessel inner diameter D.

Figure 23:
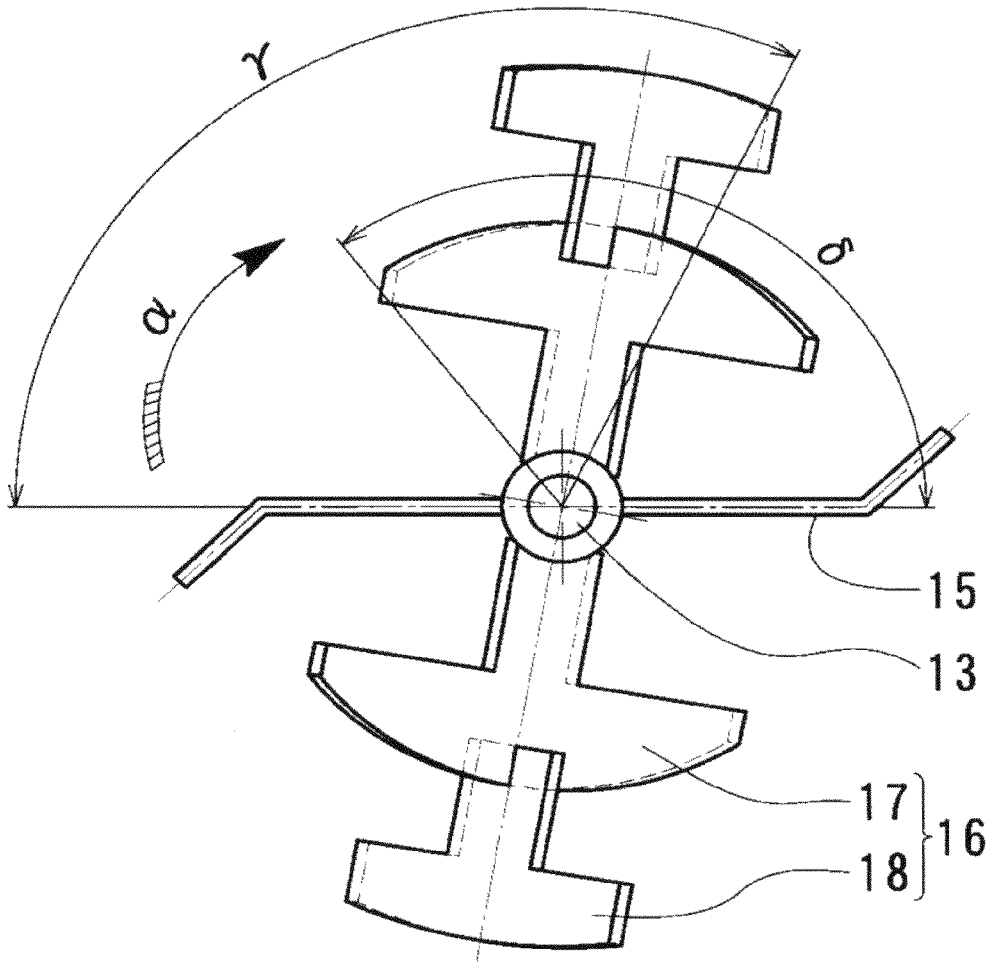
FIG. 23 is a plan view illustrating a phase difference angle between a lower end of an outer blade portion of a lowest upper agitation blade and a lower blade and a phase difference angle between a lower end of an inner blade portion of the lowest upper agitation blade and the lower blade of the agitation apparatus 11 of the embodiment.

Further, the lower blades are arranged in such a manner that, in each lower blade and the corresponding lowest upper agitation blade vertically adjacent to the lower blade, as viewed from above, the angle γ between the line extending from the center of the agitation shaft to the lower end portion of the outer blade portion of the lowest upper agitation blade and the center line of the lower blade as viewed from above preferably satisfies the expression: 10°≦γ≦130°, and more preferably satisfies the expression: 90°≦γ≦125°, in the opposite direction to the rotating direction of each blade from the lower end portion of the outer blade portion of the lowest upper agitation blade to the center line of the lower blade as viewed from above (see FIG. 23).

In the above-described configuration, the angle δ between the line extending from the center of the agitation shaft to the lower end portion of the cutout portion of the inner blade portion of the lowest upper agitation blade and the center line of the lower blade as viewed from above does not fall in the preferable range for the agitation apparatus 1 according to the present invention. That is, a more preferable range of the angle γ is, for example, 118°≦δ≦153°. When the angle falls in this range, a sufficient space is formed between the upper end portion of each lower blade and the lower end portion of the inner blade portion of the corresponding lowest upper blades.

In the above-described configuration, the descending flows formed by the upper blade sets are transferred smoothly from the lowest upper agitation blades to the lower blades. Particularly, when the lowest upper agitation blades and the lower blades are arranged in accordance with a more preferable range, a sufficient space is formed between the lower end portion of the inner blade portion of each lowest upper agitation blade and the upper end portion of the corresponding lower blade. The space acts to extend a descending flow in a horizontal direction. After this stage, the descending flow is smoothly transferred to the corresponding lower blade in a manner wrapping around the lower blade. This produces an intense vertically circulating flow throughout the agitation vessel, which is shaped differently from the shapes of the corresponding flows formed by the conventional agitation apparatuses 21, 31, 41. As a result, fluids with a wide spectrum of viscosity, thixotropic fluids, highly viscous and highly thixotropic fluids, and fluids with different viscosities are agitated and mixed with highly improved efficiency.

The lower blades are preferably wide retreating paddle blades. The blade diameter (the blade span) db of each lower blade preferably satisfies the expression: 0.5 D≦db≦0.9 D with respect to the agitation vessel inner diameter D. Also, the blade diameter (the blade span) dc of each upper blade preferably satisfies the expression: 0.7 D≦dc≦1.0 D with respect to the agitation vessel inner diameter D. Specifically, the outer periphery of the outer blade portion of each upper agitation blade is formed of smooth material such as Teflon (registered trademark) and thus held in tight contact with the inner wall of the agitation vessel. The substance to be processed adhered to the vessel inner wall is thus reliably scraped off and caused to flow. Accordingly, the upper limit of the blade diameter of the upper blade is set to 1.0 D In the above-described configuration, both of the lower blades and the upper blade sets ensure sufficient operating ranges in the agitation vessel with respect to fluid. As a result, each lower blade produces an intense outward flow that strikes the vessel wall and is converted into an ascending flow and the inner blade portion of each upper blade generates an intense descending flow extending from the vicinity of the fluid level in the upper portion of the vessel toward the vicinity of the upper end portion of the lower blade. Simultaneously, an ascending flow is formed with the outer blade portion of each upper agitation blade scraping the fluid off from the proximity of the vessel wall surface. Also, in this configuration, the ascending flow produced by each lower blade and the ascending flow generated by the corresponding upper agitation blade are merged together, thus forming an intense ascending flow. This decreases the risk that the outward flow generated by the inner blade portion of each upper agitation blade cuts the ascending flow.

Figure 3:
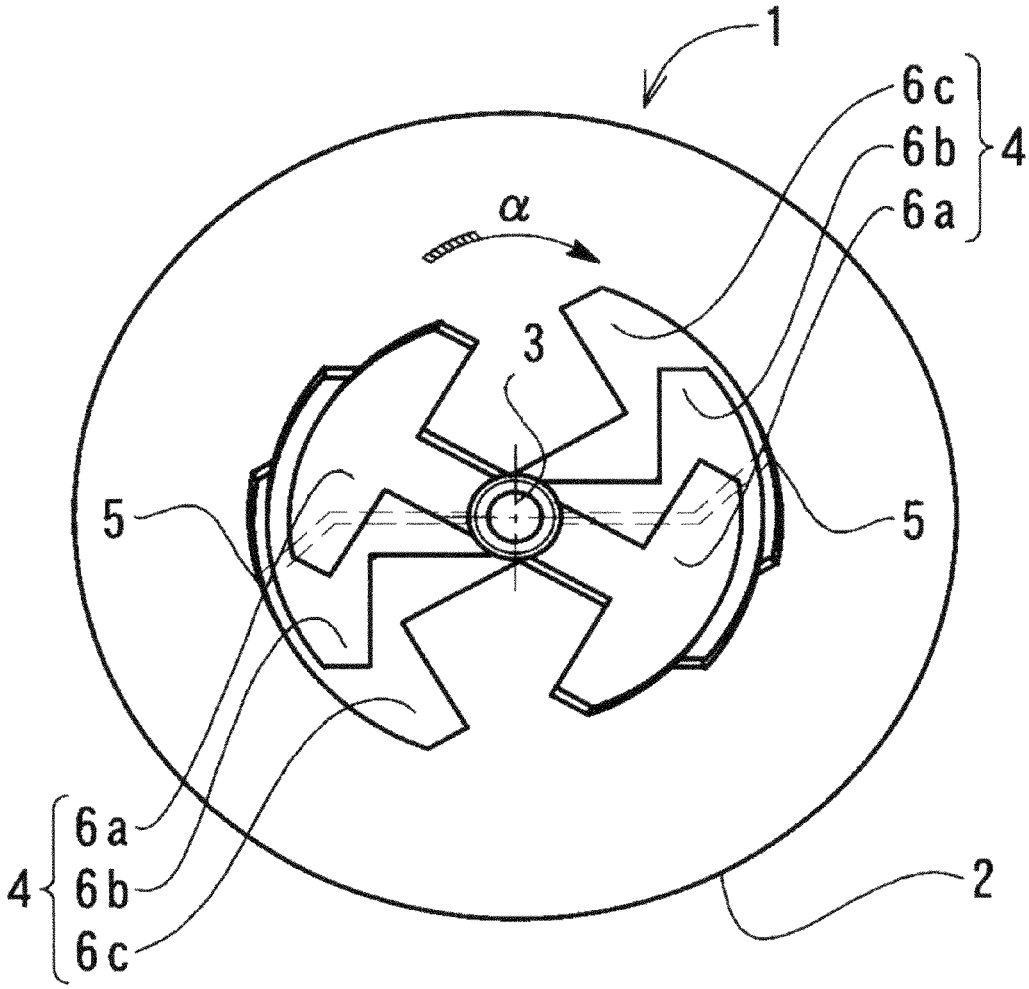
FIG. 3 is a plan view showing the agitation apparatus 1 of the embodiment.

The present invention will hereafter be described in more detail, with reference to the attached drawings. With reference to FIGS. 1 to 3, in the agitation apparatus 1, the agitation shaft 3 is rotatably supported at the central portion of the agitation vessel 2, which has a cylindrical shape. The agitation shaft 3 extends downward to the proximity of the vessel bottom. The upper end of the agitation shaft 3 is connected to a drive device (not shown) mounted on the top of the vessel through a coupling (not shown). The upper blade sets 4 and the lower blades 5 are attached to the agitation shaft 3.

The upper blade sets 4 are formed by arranging pairs of upper agitation blades 6, 6 at a plurality of levels to be spaced apart at constant intervals along the axis of the agitation shaft 3. In the present embodiment, there are three levels including a highest level, a middle level, and a lowest level. The levels of each upper blade set 4 are not restricted to the three levels as in the present embodiment but may be a single level or two levels or more than or equal to three levels.

Each of the upper agitation blades 6 is a flat plate-like agitation blade and substantially has a T shape. With reference to FIG. 7, as viewed from above, the outer periphery i of each upper agitation blade 6 is shaped as an arc about the agitation shaft center g, which is the center of the arc. The upper agitation blades 6, 6 are fixed to the agitation shaft 3 in such a manner as to be located on opposite sides of the agitation shaft 3 and inclined at a predetermined elevation angle with respect to the rotating direction (indicated by arrow α) of the agitation shaft 3. Although the agitation blades are attached to the agitation shaft 3 through a boss as illustrated in the drawing, the agitation blades may be attached directly to the agitation shaft without the boss.

In the present embodiment, each upper agitation blade 6 substantially has a T shape as viewed from above. However, it is unnecessary to restrict the shape of the upper agitation blade 6 to the illustrated shape. That is, as illustrated in FIGS. 8 to 13, the upper agitation blade may be shaped in any suitable manner as long as the cutout portions or the openings are formed in the vicinity of the agitation shaft 3 each by a predetermined proportion with respect to the arcuate shape formed by the upper end $f_a$ and the lower end $f_b$ of the outer periphery i and the agitation shaft center g.

The middle upper agitation blades 6*b* are arranged on the trailing side of the highest upper agitation blades 6*a*, which are vertically adjacent to the middle upper agitation blades 6*b*, with respect to the rotating direction (in the opposite direction to the direction indicated by arrow α). Similarly, the lowest upper agitation blades 6*c* are arranged on the trailing side of the middle upper agitation blades 6*b*, which are vertically adjacent to the lowest upper agitation blades 6*c*, with respect to the rotating direction. Like the highest upper agitation blades 6*a*, 6*a*, the middle upper agitation blades 6*b*, 6*b* and the lowest upper agitation blades 6*c*, 6*c* are fixed to the agitation shaft 3 in such a manner as to be located on opposite sides of the agitation shaft 3 and each inclined at a predetermined elevation angle with respect to the rotating direction of the agitation shaft 3.

In the present embodiment illustrated in FIGS. 1 to 3, the distances from the center of the agitation shaft to the outer peripheries i of the upper agitation blades 6*a*, 6*b*, 6*c*, as viewed from above, become smaller in the order of the lowest level, the middle level, and the highest level. However, the distances are not restricted to this but may be equal, for example.

In the present embodiment, the upper agitation blades 6*a*, 6*b*, 6*c* have similar figures. However, the shapes of the upper agitation blades 6*a*, 6*b*, 6*c* are not restricted to the embodiment but may have different shapes. Each upper agitation blade 6*a*, 6*b*, 6*c* may have any suitable shape other than the shape having a symmetry axis as viewed from above.

Figure 14:
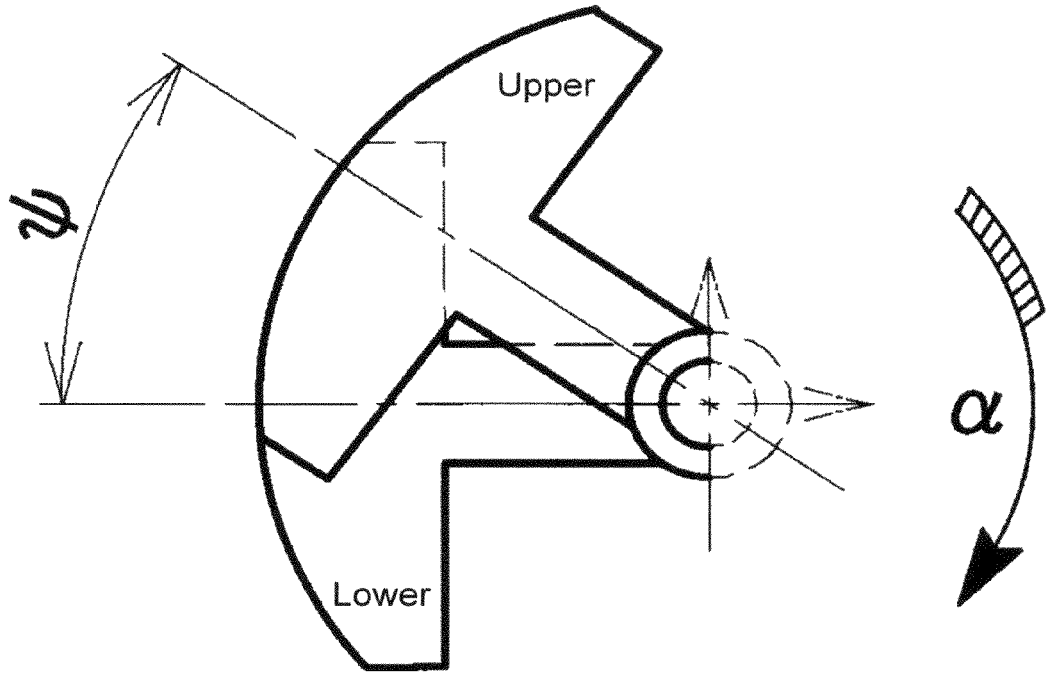
FIG. 14 is a schematic diagram illustrating a phase difference angle between vertically adjacent upper agitation blades of the agitation apparatus 1 of the embodiment as viewed from above.

In the present embodiment, as viewed from above, the attachment angle ψ (see FIG. 14) between each highest upper agitation blade 6*a* and the corresponding middle upper agitation blade 6*b* and the attachment angle ψ (see FIG. 14) between each middle upper agitation blade 6*b* and the corresponding lowest upper agitation blade 6*c* with respect to the rotating direction of the agitation shaft are equal in the corresponding levels. The elevation angle ξ (see FIG. 15) with respect to the rotating direction of the agitation shaft 3 is also the same in the highest, middle, and lowest levels. However, the invention is not restricted to this, and the angles may be set to different values.

The lower agitation blades 5, 5 are flat plate-like agitation blades arranged along the agitation shaft 3. The lower side portion of each lower agitation blade 5 is shaped along the bottom surface of the agitation vessel and arranged close to the vessel bottom surface. The portion of the lower agitation blade 5 is bent rearward with respect to the rotating direction of the agitation shaft 3.

Each lower agitation blade 5 is arranged forward in the rotating direction of the agitation shaft 3 from the lower end portion $b_b$ of the cutout portion of the corresponding lowest upper agitation blade 6*c*, which is vertically adjacent to the lower agitation blade 5.

As shown in FIG. 1, the upper agitation blades of all levels are arranged in such a manner as to form overlapped portions in the vertical direction. Also, the lower end portion of each lowest upper agitation blade and the upper end portion of the corresponding lower blade are arranged in such a manner as to form an overlapped portion in the vertical direction. The overlapping amounts do not necessarily have to be the same but may be different. However, with reference to FIG. 2, it is necessary to arrange the blades so as to prevent the vertically adjacent blades from contacting each other. Particularly, the lower end portion (the cutout lower end portion) $b_b$ of each lowest upper agitation blade 6*c* and the upper side portion of the corresponding lower agitation blade are spaced apart at a sufficient interval, as illustrated in FIG. 2.

The agitation apparatus of the present embodiment is configured as has been described. Next, the agitation characteristics of the agitation apparatus of the embodiment will be described with reference to FIGS. 17 to 19.

When the agitation shaft 3 is rotated in the direction indicated by arrow a (clockwise in the drawings as viewed from above), the upper blade sets 4 and the lower blades 5 are also rotated in the same direction. In this state, the highest upper agitation blades 6*a*, 6*a* generate such a flow that the fluid in the vicinity of the fluid level in the upper portion of the agitation vessel is drawn toward the vessel bottom. The highest upper agitation blades 6*a*, 6*b* are each inclined in the direction in which the upper agitation blade 6*a* depresses the fluid with respect to the agitation shaft 3. Accordingly, as has been described, each upper agitation blade 6*a*, 6*a* produces a descending flow in the agitation vessel. However, the highest upper agitation blade 6*a* is a rotary body rotating about the agitation shaft 3 as the rotary shaft and produces centrifugal force. This simultaneously generates a substantially horizontal outward flow moving from the agitation shaft 3 toward the vessel wall and a substantially horizontal revolving flow rotating in the same direction as the rotating direction of the agitation blade.

Each highest upper agitation blade 6*a* is shaped as the letter T rotated by 90°. Accordingly, a longitudinally elongated plate-like blade is arranged at a position twisted by the inclination angle ξ with respect to the agitation shaft 3. If the inclination angle ξ is 0°, the longitudinally elongated blade portion is arranged parallel to the agitation shaft 3. The longitudinally elongated blade portion is designed in such a manner as to have an outer periphery having an arcuate shape as viewed from above. The longitudinally elongated blade portion thus has a width becoming smaller in the upward and downward directions with respect to the joint portion with the rotary shaft 3. As a result, the outward flow generated by the upper agitation blade 6*a* does not have uniform intensity. That is, the intensity of the outward flow becomes smaller in the upward and downward directions with respect to the joint portion with the rotary shaft 3.

The intensity of the outward flow is distributed in the same manner as the above-described manner in the middle upper agitation blades 6*b* and the lowest upper agitation blades 6*c*.

As has been described, with reference to FIG. 1, the overlapped portions are formed in the vertical direction between each highest upper agitation blade 6*a* and the corresponding middle upper agitation blade 6*b* and between each middle upper agitation blade 6*b* and the corresponding lowest upper agitation blade 6*c*. As illustrated in FIG. 2, the vertically overlapped portions are not formed to cause the overlapping blades to contact each other. However, the overlapped portions are shaped in such a manner that a less intense section of an outward flow at the lower end portion of the highest upper agitation blade 6*a* is compensated by the upper end portion of the middle upper agitation blade 6*b* through a similar less intense outward flow. There is a similar relationship between the lower end portion of the middle upper agitation blade 6*b* and the upper end portion of the lowest upper agitation blade 6*c*. Further, in the present embodiment, the blade diameters of each upper blade set satisfy the expression: 6*a*<6*b*<6*c*, and the intensities of the outward flows generated by the upper agitation blades 6*a*, 6*b*, 6*c* satisfy the same expression. In this manner, the outward flow generated by each upper blade set 4 has appropriately distributed intensity but becomes less intense in an upward direction of the agitation vessel.

When the highest upper agitation blades 6*a* are rotated, positive pressure acts on a front surface of each upper agitation blade 6*a* and negative pressure acts on a rear surface of the upper agitation blade 6*a* with respect to the rotating direction of the agitation shaft 3, which is the advancing direction of each blade. Accordingly, a wrap-around flow moving from a positive pressure zone to a negative pressure zone is also produced.

In the longitudinally elongated blade portion of the highest upper agitation blade 6*a*, the wrap-around flow in a horizontal direction is generated by the outer peripheral portion and the longitudinal side portion of the blade at the side corresponding to the agitation shaft. Due to the difference in the linear velocity between the outer peripheral portion and the longitudinal side portion of the blade (since the blade outer peripheral portion is more spaced from the rotational axis, the linear velocity at the blade outer peripheral portion is greater), a small vortex flow A rotating (spinning) in the opposite direction to the rotating direction of the agitation shaft (in the present embodiment, counterclockwise) is produced at the rear surface of the longitudinally elongated blade portion with respect to the rotating direction.

Figure 18:
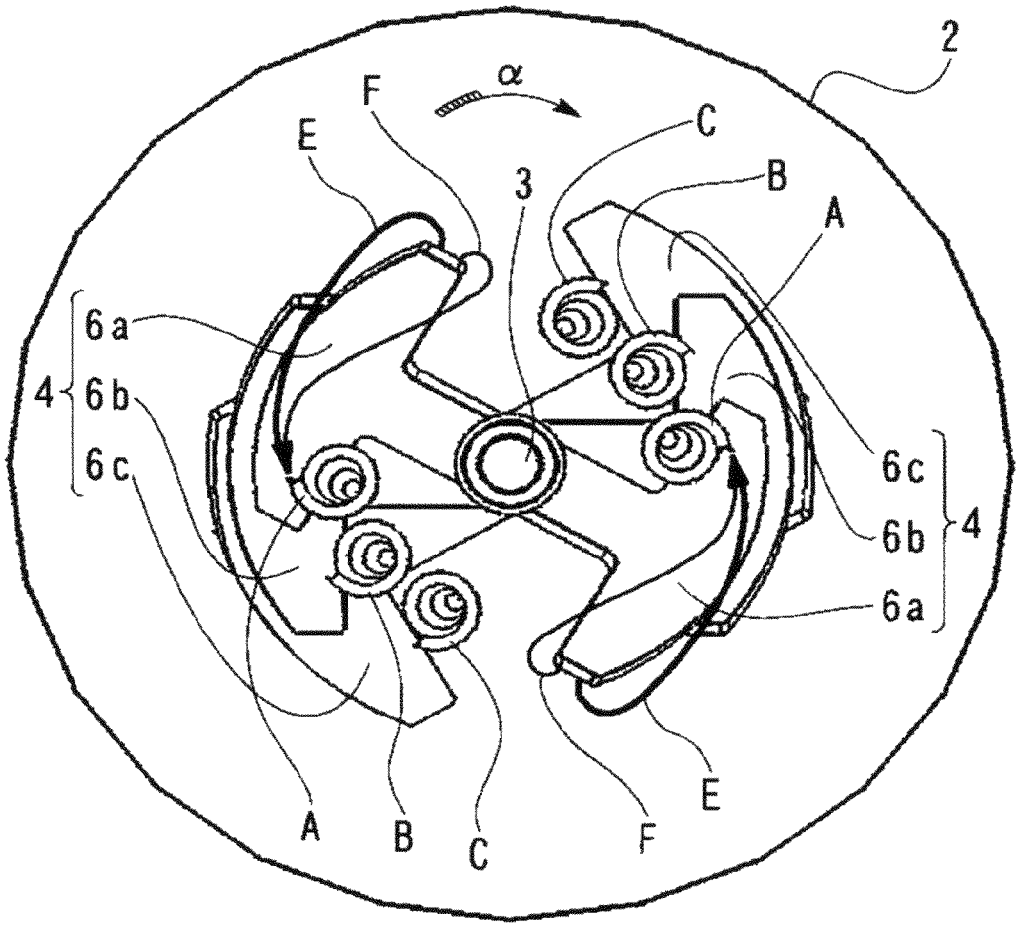
FIG. 18 is a plan view schematically illustrating a wrap-around flow in the vicinity of an upper agitation blade of the agitation apparatus 1 of the embodiment and a small vortex flow produced through a velocity difference of wrap-around flows.

To specify the above-described phenomenon in detail, with reference to FIG. 18, a wrap-around flow E produced by the outer peripheral portion of each upper agitation blade has greater intensity than a wrap-around flow F generated by the longitudinal side portion at the side corresponding to the agitation shaft. Accordingly, when the flows E and F are to be merged into each other at a position rearward in the rotating direction of the upper agitation blade, the velocity difference between the flows E and F causes a vortex flow.

In the present embodiment, the longitudinal side portion of the longitudinally elongated blade portion at the side corresponding to the agitation shaft maintains an appropriate distance from the agitation shaft 3 and has a sufficient length in the vertical direction. Accordingly, the small vortex flow A, which is generated through operation of the wrap-around flow produced by the longitudinal side portion at the side corresponding to the agitation shaft, spins in a manner following rotation of the highest upper agitation blade 6*a* and continues rotating along an orbital path about the agitation shaft 13, without moving toward the wall surface of the agitation vessel and disappearing.

The agitation shaft 3 is the revolution axis of the small vortex flow A. Accordingly, although the revolution axis faces in the vertical direction, the spin axis of the small vortex flow A is inclined with respect to the revolution axis. The inclination of the spin axis with respect to the revolution axis is nonconstant in the vertical direction of the agitation vessel and appropriately distributed due to equilibrium of intensities among the outward flow, the descending flow, and the wrap-around flow, which are produced by each upper blade. Nonetheless, basically, the spin axis is skew with a lower portion of the spin axis retreated with respect to the rotating direction of the agitation shaft 3.

Also when the middle upper agitation blades 6*b* and the lowest upper agitation blades 6*c* are rotated, a small vortex flow B and a small vortex flow C, which are caused through the above-described operating mechanisms, are generated by the rear surfaces of the blades with respect to the rotating direction.

In the present embodiment, the arrangement of the small vortex flows A, B, C is substantially the same as the arrangement of the upper agitation blades 6*a*, 6*b*, 6*c*. In other words, the lower the position of a small vortex flow, the further rearward the small vortex is located with respect to the rotating direction of the agitation shaft 3. Further, as has been described, the lower portion of the spin axis of the small vortex flow is retreated with respect to the rotating direction of the agitation shaft 3. Specifically, the lower end section of the small vortex flow A advances toward the upper section of the small vortex flow B and the lower end section of the small vortex flow B advances toward the upper section of the small vortex flow C. As a result, the descending flows caused by the small vortex flows are connected together continuously from the small vortex flow A to the small vortex flow C.

In the present embodiment, each pair of upper agitation blades 6*a*, 6*b*, 6*c* are arranged on opposite sides of the agitation shaft 3. This arrangement produces two descending flows, which are caused by the small vortex flows and extend continuously from the highest upper agitation blades 6*a* to the lowest upper agitation blades 6*c*. Further, when each upper blade set 4 is rotated, descending flows (vortex flows each rotating in the same direction as the rotating direction) about the agitation shaft 3, which extend from the highest upper agitation blades 6*a* to the lowest upper agitation blades 6*c*, are also generated in the agitation vessel. In other words, in the present embodiment, three pairs of such descending flows are produced in the agitation vessel, thus providing an intense descending flow unlike the conventional agitation apparatuses 21, 31, 41.

Further, since multiple descending flows having different rotating directions and different spin axes are formed, mixing performance unachievable by a single descending flow is obtained. Specifically, when the fluid moves from the vicinity of the fluid level in the upper portion of the agitation vessel to the vicinity of the lower blades, horizontal mixing action is brought about. This decreases the risk of insufficient mixing caused by movement of the fluid following movement of the agitation blades, or in other words, integral rotation of the fluid with the agitation blades, to an extremely low extent.

Figure 29:
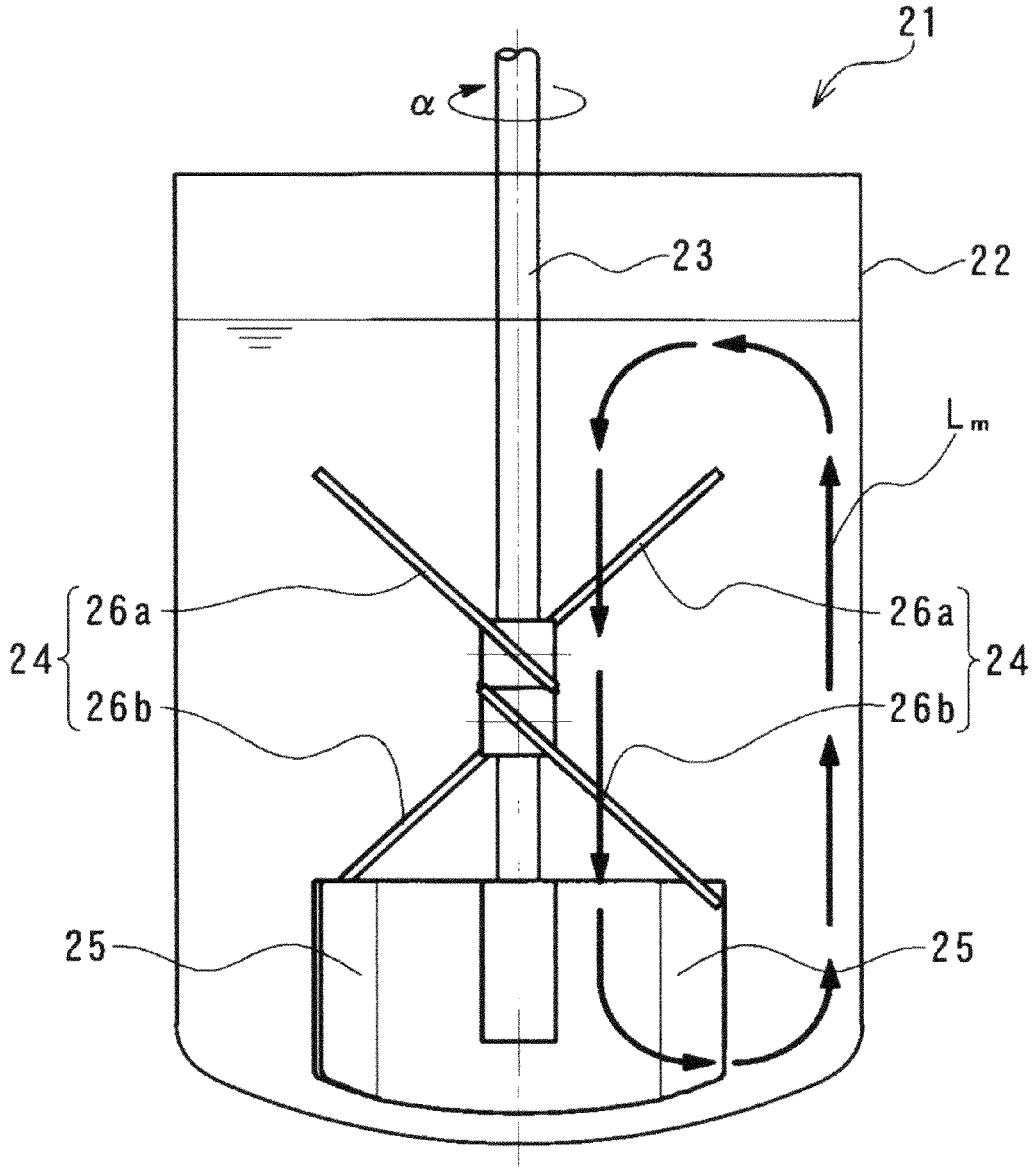
Fig.29(Prior Art)
FIG. 29 is a front view showing an agitation apparatus having a conventional upper blade and a conventional lower blade.
Figure 30:
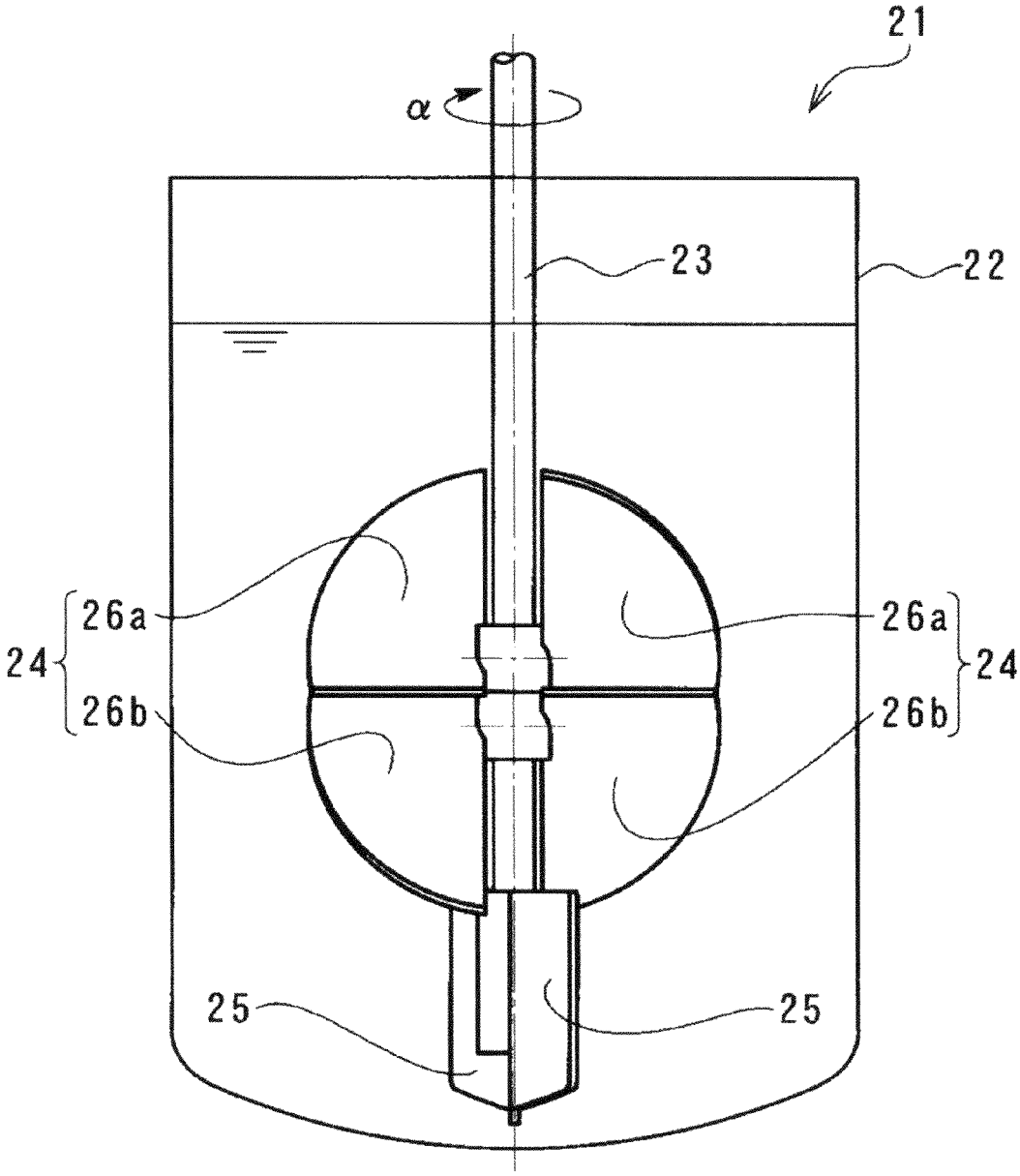
Fig.30(Prior Art)
FIG. 30 is a side view showing the agitation apparatus having the conventional upper blade and the conventional lower blade.
Figure 31:
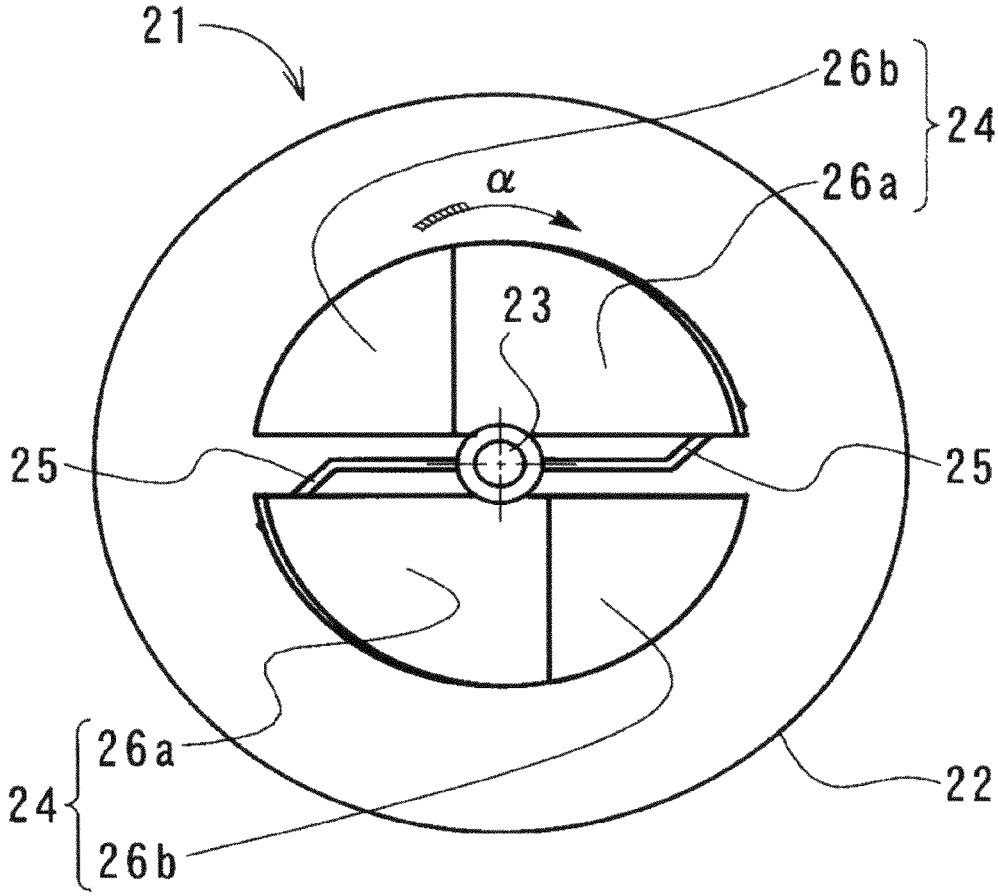
Fig.31(Prior Art)
FIG. 31 is a plan view showing the agitation apparatus having the conventional upper blade and the conventional lower blade.
Figure 32:
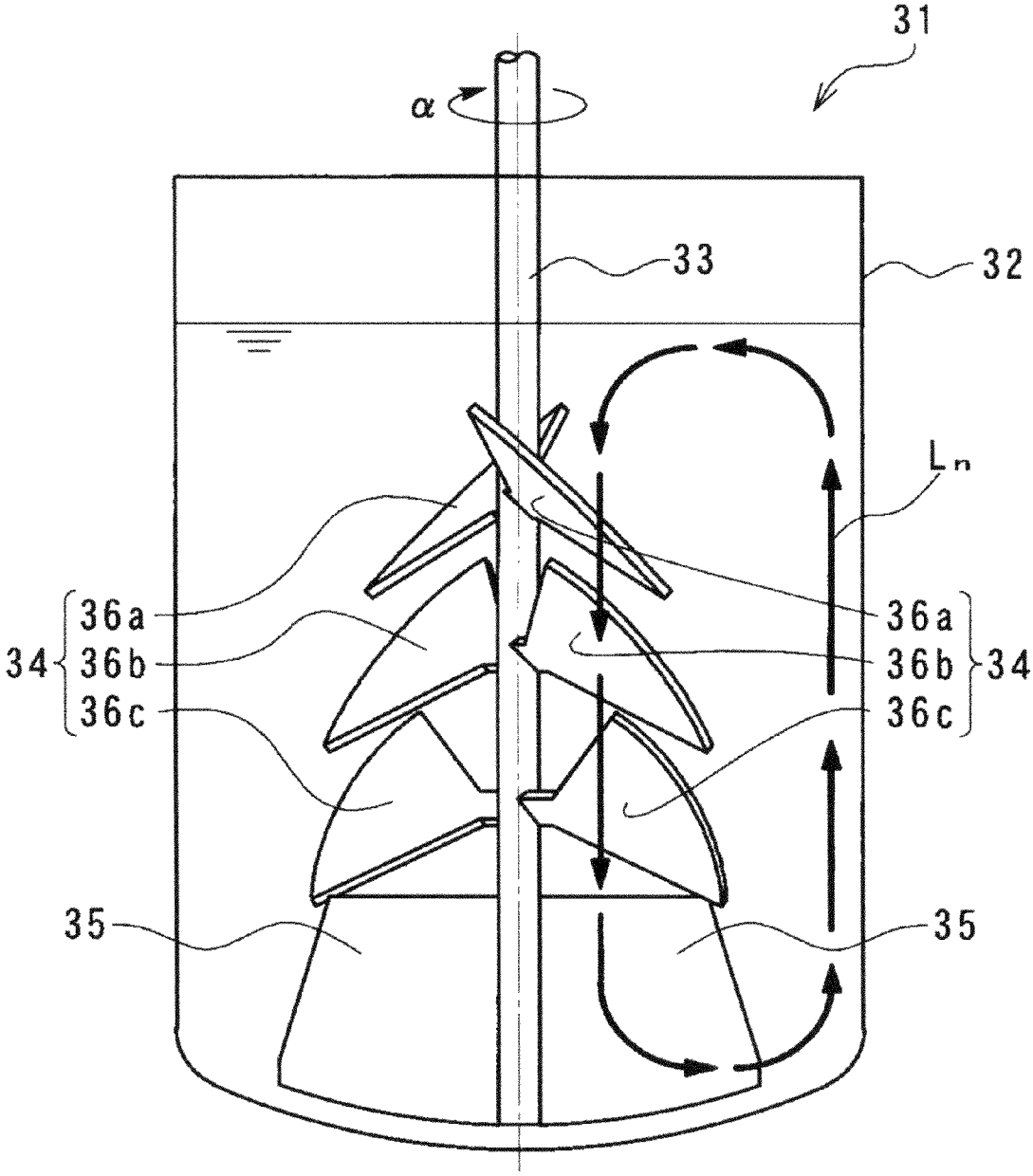
Fig.32(Prior Art)
FIG. 32 is a front view showing an agitation apparatus having another conventional upper blade and another conventional lower blade.
Figure 33:
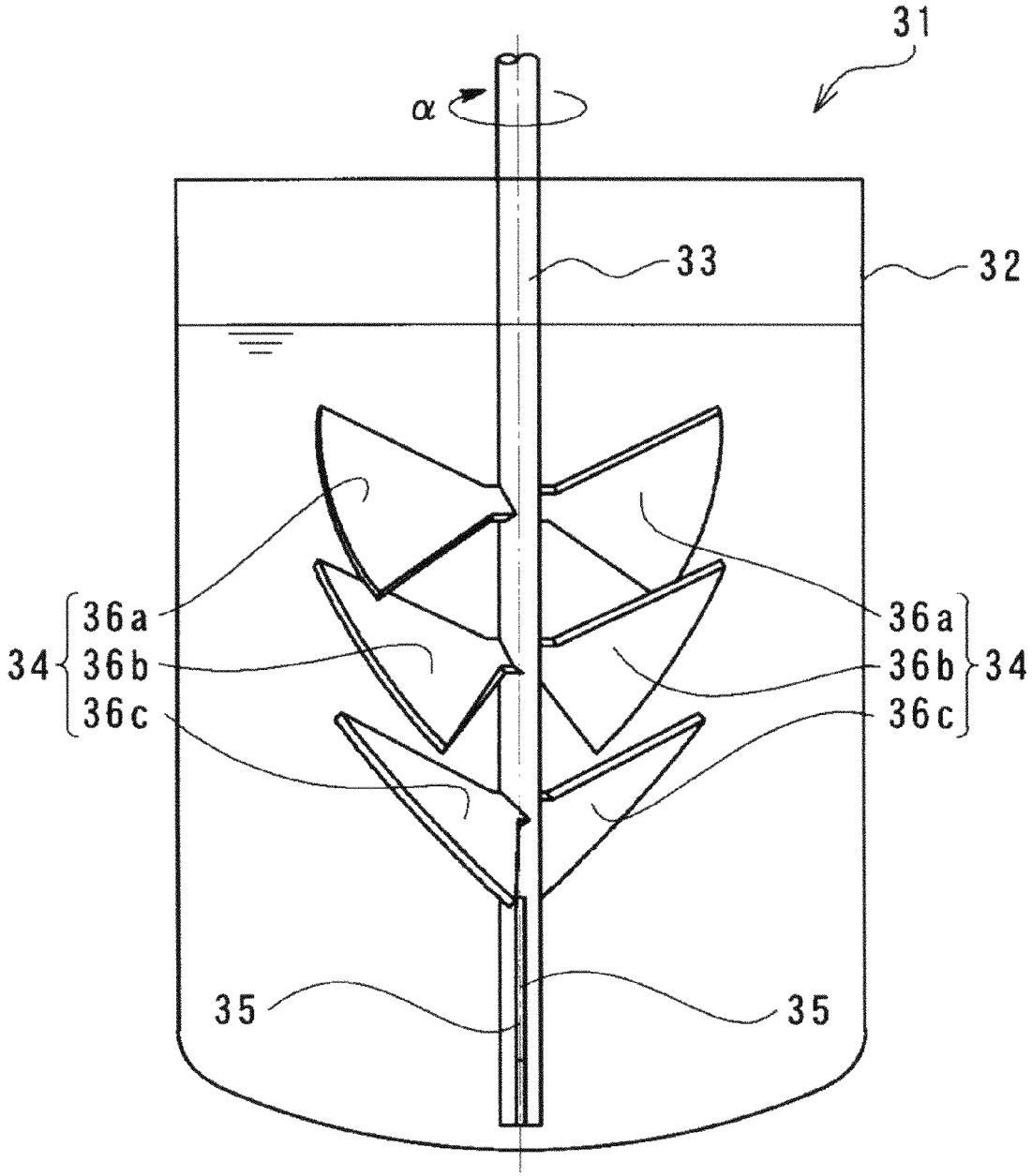
Fig.33(Prior Art)
FIG. 33 is a side view showing the agitation apparatus having the conventional upper blade and the conventional lower blade.
Figure 34:
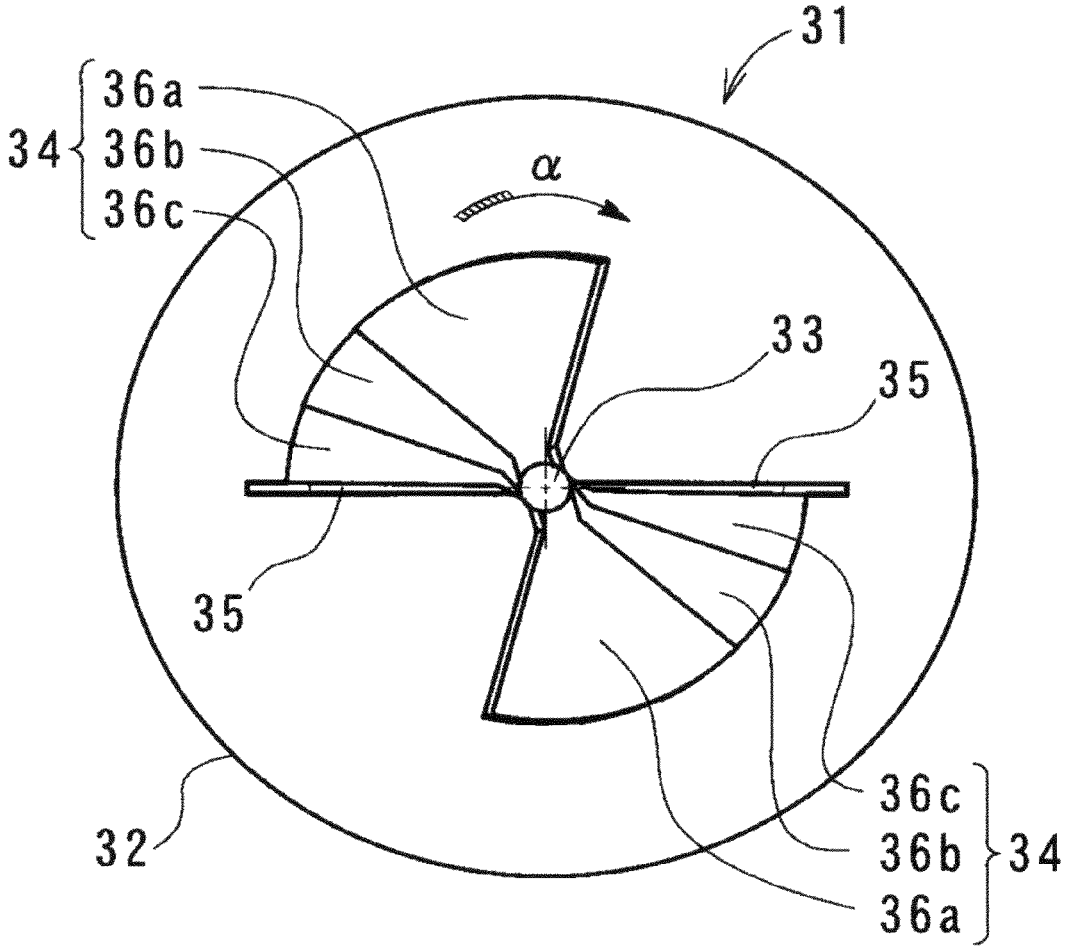
Fig.34(Prior Art)
FIG. 34 is a plan view showing the agitation apparatus having the conventional upper blade and the conventional lower blade.
Figure 35:
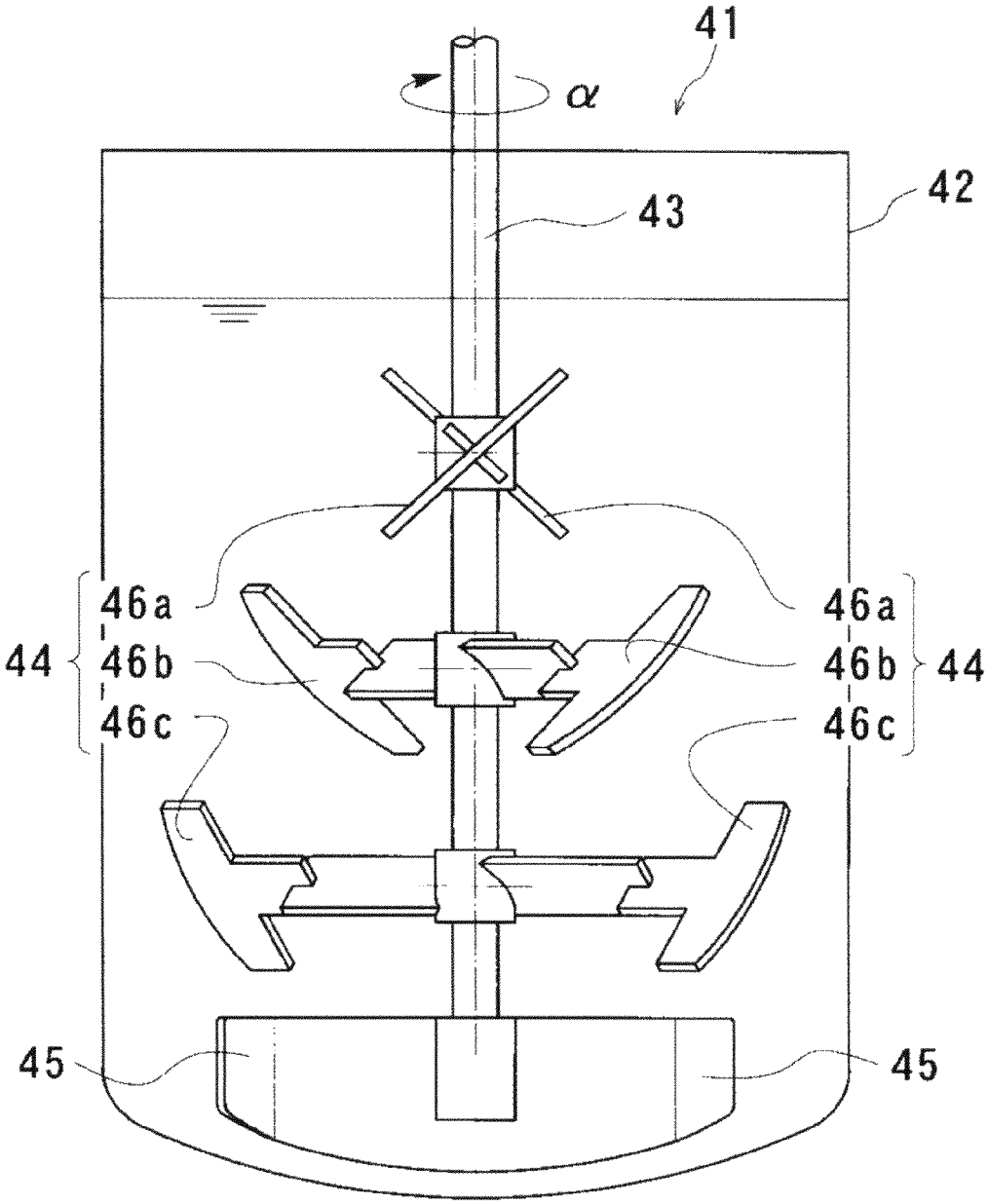
Fig.35(Prior Art)
FIG. 35 is a front view showing an agitation apparatus having another conventional upper blade and another conventional lower blade.
Figure 36:
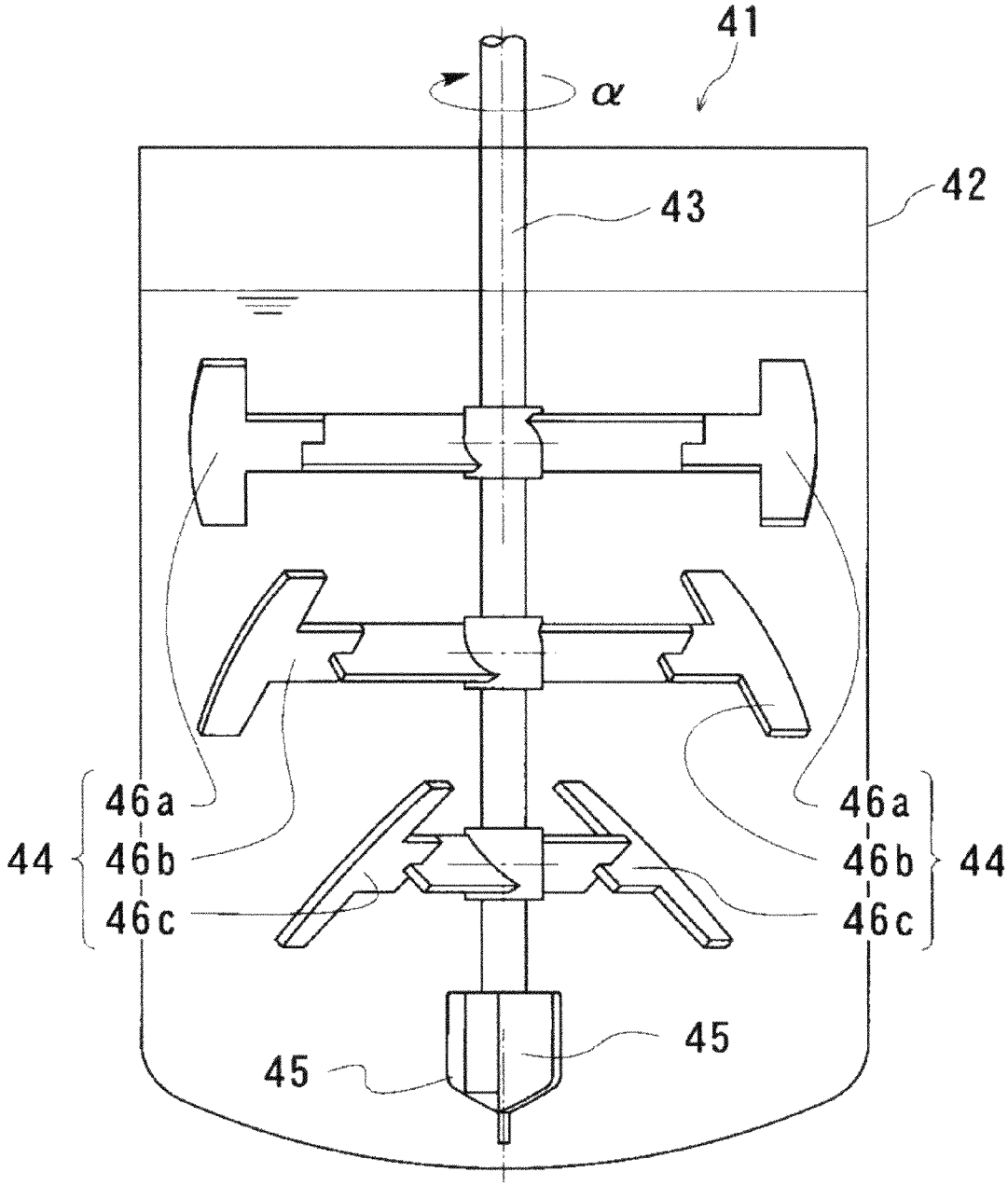
Fig.36(Prior Art)
FIG. 36 is a side view showing the agitation apparatus having the conventional upper blade and the conventional lower blade.
Figure 37:
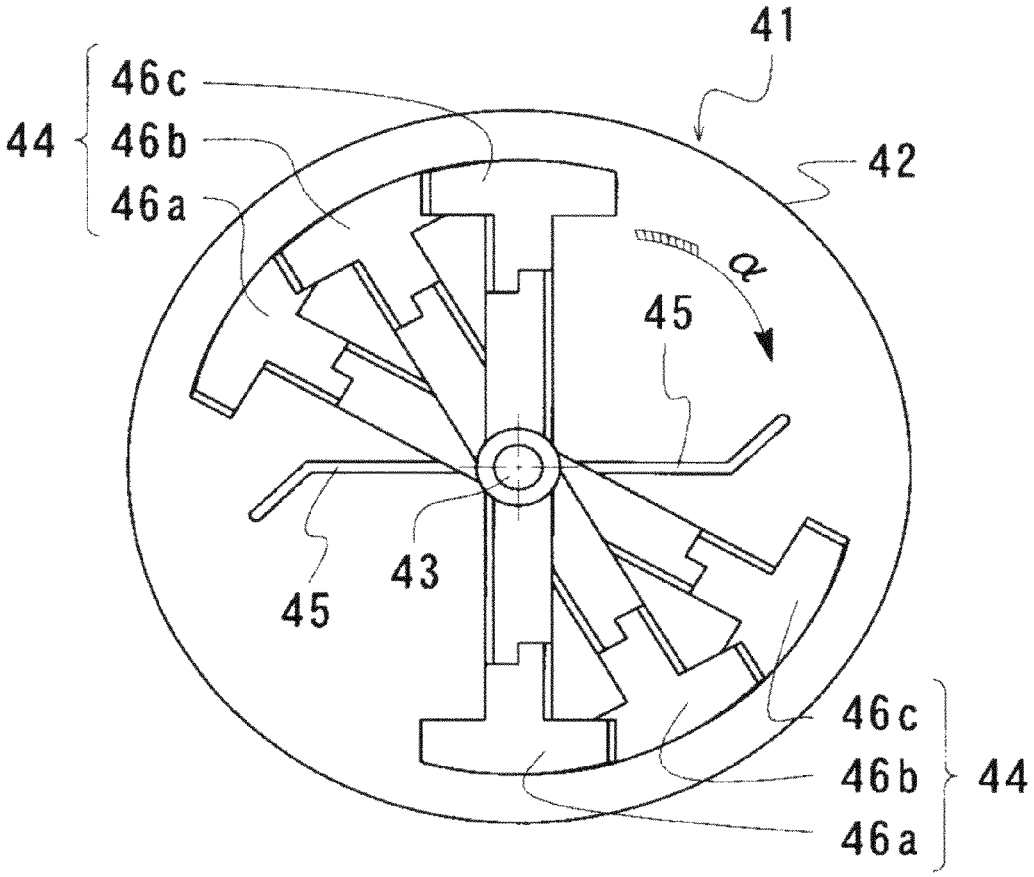
Fig.37(Prior Art)
FIG. 37 is a plan view showing the agitation apparatus having the conventional upper blade and the conventional lower blade.

Also in the conventional agitation apparatus 21 illustrated in FIGS. 29 to 31 and the conventional agitation apparatus 31 illustrated in FIGS. 32 to 34, a small vortex flow shaped similarly to the small vortex flow A of the present embodiment may be produced by the uppermost end portion of each highest upper agitation blade.

However, in the conventional agitation apparatus 21, the longitudinal side portion of each highest upper agitation blade at the side corresponding to the agitation shaft, which is skew with respect to the agitation axis of the upper agitation blade, is located in the vicinity of the agitation shaft. Accordingly, a wrap-around flow caused by the longitudinal side portion has a limited influence. As a result, even if a small vortex flow is produced by the uppermost end portion of the highest upper agitation blade, the small vortex flow moves along such a path that the small vortex flow is sent outward in a direction toward the wall surface of the agitation vessel. This prevents formation of a continuous descending flow that is caused by the small vortex flow and extends from an upper portion to a lower portion in the agitation vessel.

Contrastingly, the conventional agitation apparatus 31 illustrated in FIGS. 32 to 34 does not include a longitudinal side portion that is skew with respect to the agitation shaft. If it is considered that portions corresponding to the longitudinal side portion of the upper agitation blade of the present embodiment that is skew with respect to the agitation shaft are the upper side and the lower side of the arcuate shape of the agitation apparatus 31, a wrap-around flow is produced also by these positions. Accordingly, it is likely that a small vortex flow, which is generated through the velocity difference between this wrap-around flow and a wrap-around flow produced at the outer periphery of the upper agitation blade, may occur only at the upper end portion and the lower end portion of the corresponding upper agitation blade in the agitation apparatus 31.

However, even if a small vortex flow caused by a wrap-around flow is produced by the upper end portion of the upper agitation blade, the wrap-around flow produced by the upper side of the arcuate shape becomes smaller in size in a downward direction from the upper end portion. Also, the horizontal interval between the wrap-around flow produced by the upper side portion and the wrap-around flow generated by the outer peripheral portion becomes greater in a downward direction from the upper end portion. This makes it impossible to maintain the small vortex flow produced by the upper end portion in a downward direction. As a result, the conventional agitation apparatus 31 also does not produce a continuous descending flow that is caused by the small vortex flow and extends from the upper portion to the lower portion of the agitation vessel.

Figure 17:
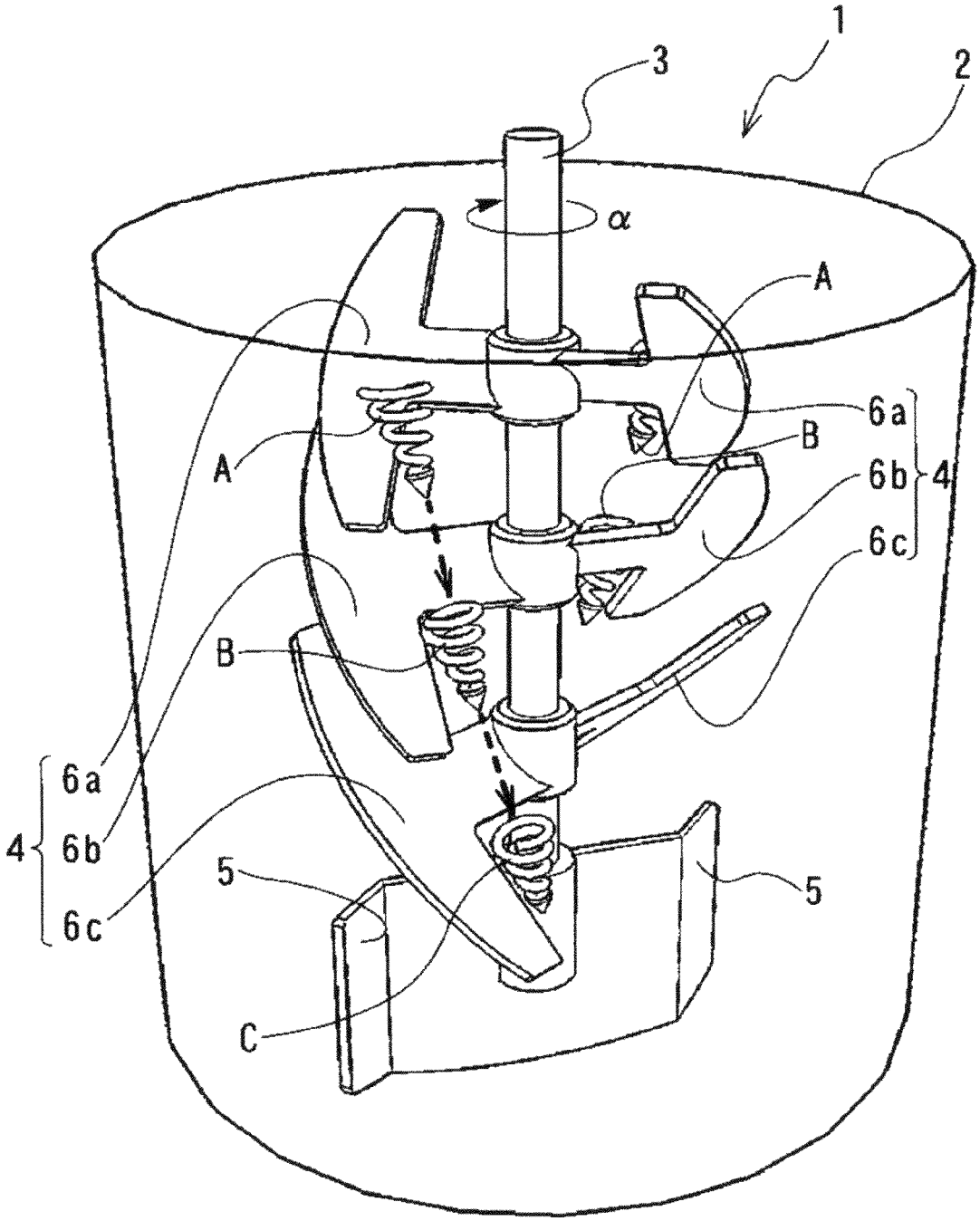
FIG. 17 is a perspective view schematically illustrating a small vortex flow produced through operation of an upper blade of the agitation apparatus 1 of the embodiment.
Figure 19:
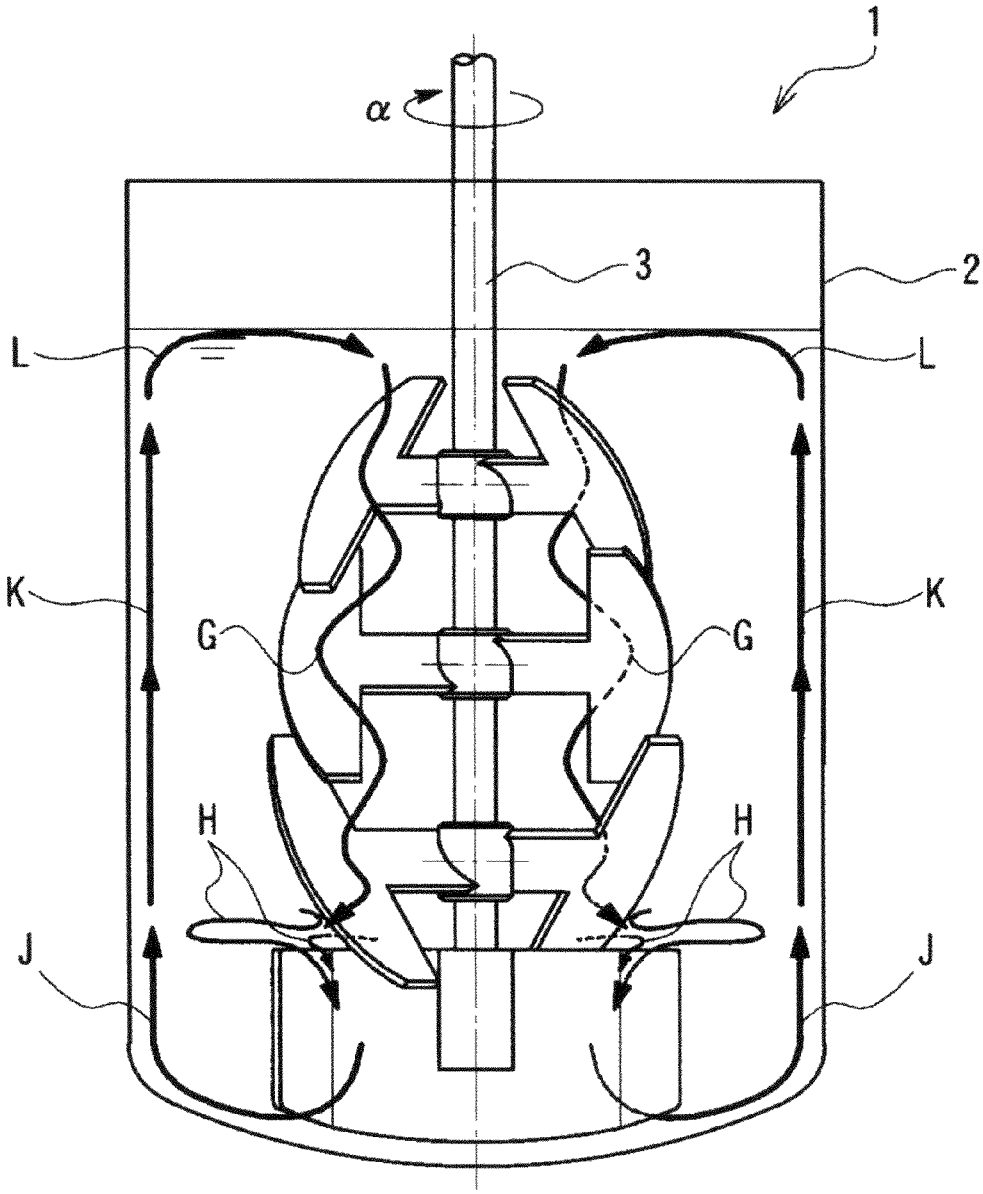
FIG. 19 is a front view schematically showing a vertically circulating flow having a greatly curved flow in the vicinity of an upper side portion of a lower blade of the agitation apparatus 1 of the embodiment.

With reference to FIGS. 17 to 19, the agitation characteristics of the present embodiment will hereafter be described.

In the present embodiment, the paths of the multiple descending flows generated through operation of the upper blade sets 4 are greatly curved in the vicinity of the upper end portions of the lower agitation blades 5. Specifically, such a curved flow is caused by a sufficient horizontal interval between the lower end portion of each lowest upper agitation blade 6*c* and the upper side portion of the corresponding lower agitation blade.

If the lower end portions of the lowest upper agitation blades are located in the vicinities of the upper side portions of the lower agitation blades as in the cases of the conventional agitation apparatuses 21, 31, which are illustrated in FIGS. 29 to 34, the descending flow (the vortex flow rotating in the same direction as the rotating direction of the agitation shaft) formed by each upper blade is smoothly transferred to the corresponding lower blade, thus forming a smooth vertically circulating flow. However, such smoothness of the vertically circulating flow hampers horizontal movement of a substance and decreases mixing efficiency.

Contrastingly, in the present embodiment, the lower end portion of each lowest upper agitation blade 6*c* is horizontally spaced from the upper side portion of the corresponding lower agitation blade. Accordingly, it appears that the descending flow cannot be passed smoothly to the lower blades. However, this consideration is only about the descending flow caused by the vortex flow rotating in the same direction as the rotating direction of the agitation shaft 3.

In the present embodiment, since a total of three pairs of descending flows of two types are formed through the operation of the upper blade sets 4 as has been described, the above-described consideration does not necessarily apply to the embodiment. Particularly, since the descending flows caused by the small vortex flows rotating in the opposite directions to the rotating direction of the agitation shaft greatly improve the mixing efficiency in the present embodiment, it is necessary to equilibrate the descending flows in order to transfer the descending flows to the lower agitation blades.

To satisfy this need, in the present embodiment, the lower end portions of the lowest upper agitation blades 6*c* are horizontally spaced from the upper side portions of the corresponding lower agitation blades 5. As a result, the descending flow caused by each small vortex flow flows along the path H that is greatly curved in a horizontal direction in the vicinity of the upper portion of the corresponding lower blade before being transferred to the negative pressure zone formed on the rear surface of the lower agitation blade 5 with respect to the rotating direction. As a result, in the present embodiment, an vertically circulating flow G-H-J-K-L having a particular shape, which is greatly curved into the horizontal direction at the upper side portion of the corresponding lower blade, is formed.

The vertically circulating flow having the horizontal curved section H is not as smooth as the vertically circulating flows having substantially oval paths $L_m$, $L_n$ formed by the conventional agitation apparatuses 21, 31. However, the vertically circulating flow of the present embodiment is formed by combining a horizontal mixing effect with an vertically circulating flow in an appropriate manner. Accordingly, the vertically circulating flow of the embodiment has highly improved mixing characteristics compared to the vertically circulating flows that substantially has the oval paths.

The outward flows J of the present embodiment, which are produced by the corresponding lower agitation blades 5, 5 in the bottom portion of the agitation vessel, change their directions when hitting the wall surface of the agitation vessel, thus becoming the ascending flows K, which flow in the vicinities of the wall surface of the agitation vessel.

The curved section H of the descending flow at the upper side portion of each lower agitation blade of the present embodiment does not interfere with or cut the ascending flow caused by the corresponding outward flow J. In order to prevent the outward flow from being excessively intensified, each upper agitation blade at each level of the upper blade sets 4 has a minimized blade surface area. This allows each ascending flow K in the proximity of the wall of the agitation vessel to reach the proximity of the fluid level in the upper portion of the agitation vessel without being cut by the outward flows caused by the upper agitation blades.

The ascending flow is changed to a flow L toward the agitation shaft 3 in the vicinity of the fluid level. The direction of the flow L is changed by the corresponding highest upper agitation blade 6*a* so that the flow L becomes a descending flow G.

In this manner, in the present embodiment, each descending flow G flowing in the vicinity of each upper blade set 4 starting from the proximity of the fluid level in the upper portion of the agitation vessel is changed to the curved flow H, which is formed in the space between the lower end portion of the corresponding lowest upper agitation blade 6*c* and the upper side portion of the lower agitation blade 5. The curved flow H is then transferred to the lower agitation blade 5 and becomes the outward flow J caused by the lower agitation blade 5. The outward flow J then strikes the vessel wall surface and changes to the ascending flow J. The ascending flow J then reaches the proximity of the fluid level in the upper portion of the agitation vessel as the ascending flow K, which flows in the proximity of the vessel wall surface. The ascending flow K changes to the flow L, which advances toward the agitation shaft 3, in the proximity of the fluid level. In this manner, an vertically circulating flow flowing throughout the agitation vessel is formed. This ensures highly effective agitation characteristics in the entire agitation vessel.

As has been described, the agitation apparatus 1 of the present embodiment generates a vortex flow produced through rotation of the agitation blades and a plurality of small vortex flows rotating (spinning) in the opposite direction to the rotating direction of the vortex flow, thus forming an vertically circulating flow that has a greatly curved section in the proximity of the upper side of each lower blade and flows throughout the agitation vessel. Synergetic effects of these flows allow rapid, efficient (low-power consuming), and homogeneous mixing of fluids with a wide spectrum of viscosities from low to high levels or a plurality of fluids having a great difference in viscosity.

Figure 5:
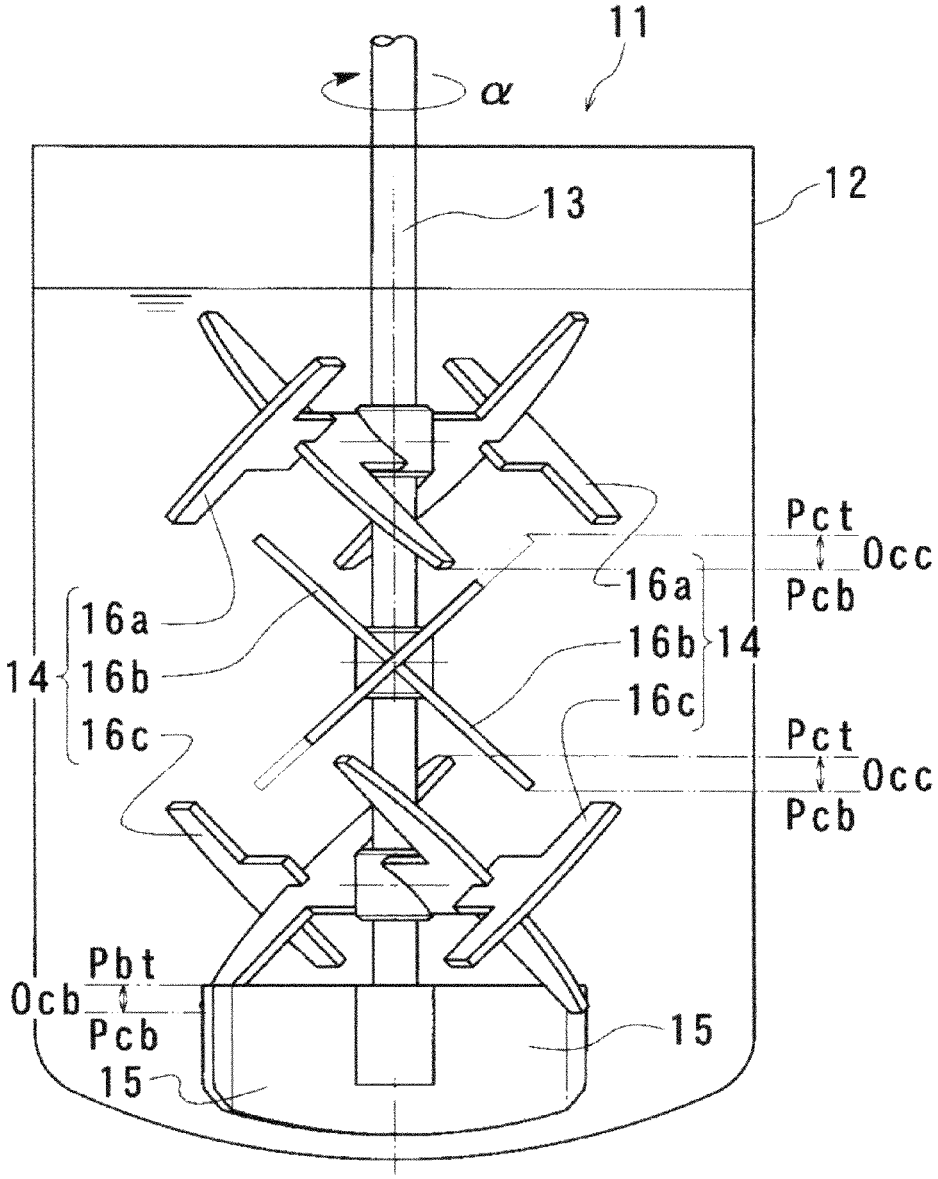
FIG. 5 is a side view showing the agitation apparatus 11 of the embodiment.
Figure 6:
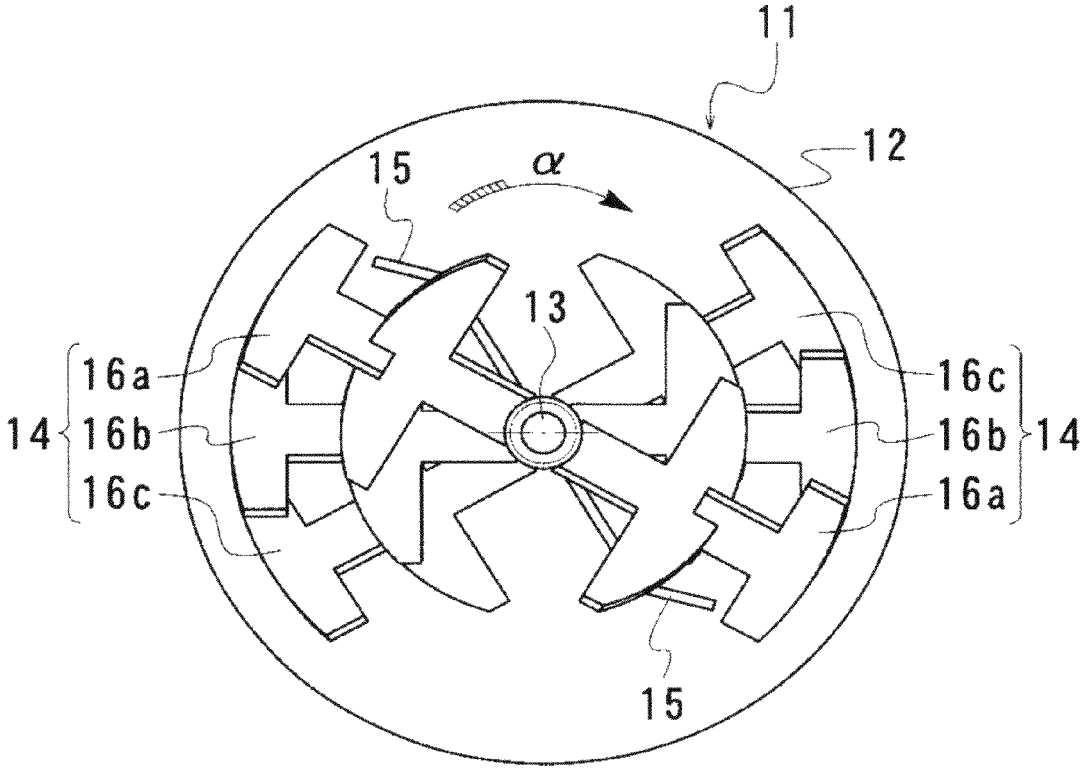
FIG. 6 is a plan view schematically showing the agitation apparatus 11 of the embodiment.

In the agitation apparatus 11 of the present embodiment illustrated in FIGS. 4 to 6, the agitation shaft 13 is rotatably supported at the central portion of the agitation vessel 12, which has a cylindrical shape. The lower end of the agitation shaft 13 extends downward to the vicinity of the vessel bottom. The upper end of the agitation shaft 13 is connected to the drive device (not shown), which is arranged on the top of the vessel, through the coupling (not shown). The upper blade sets 14 and the lower blades 15 are attached to the agitation shaft 13.

The upper blade sets 14 are configured by arranging each pair of upper agitation blades 16, 16 at a plurality of levels to be spaced apart at uniform intervals along the axis of the agitation shaft 13. In the present embodiment, each upper blade set 14 is configured by three levels, which are a highest level 16*a*, a middle level 16*b*, and a lowest level 16*c*. However, the arrangement of the upper blade set 14 is not restricted to the three levels of the present embodiment. That is, the upper blade set 14 may be arranged at a single level or two levels or more than or equal to three levels.

An upper agitation blade 16 is a flat plate-like agitation blade and configured by a substantially T-shaped inner blade portion 17 and a substantially T-shaped outer blade portion 18. The inner blade portion 17 is configured by a longitudinal plate portion $v_1$ and a lateral plate portion $n_1$. The outer blade portion 18 is configured by a longitudinal plate portion $v_2$ and a lateral plate portion $n_2$. With reference to FIG. 20, as viewed from above, the longitudinal plate portion outer periphery $i_1$ of the inner blade portion 17 and the longitudinal plate portion outer periphery $i_2$ of the outer blade portion 18 of each upper agitation blade 16 are each shaped as an arc about the center of the agitation shaft, which is the center of the arc. The upper agitation blades 16, 16 are fixed to the agitation shaft 13 in such a manner as to be located on opposite sides of the agitation shaft 13 through the lateral plate portions $n_1$ of the inner blade portions 17 and each inclined at a predetermined elevation angle with respect to the rotating direction (indicated by arrow $\alpha$) of the agitation shaft 13. In each outer blade portion 18, the lateral plate portion $n_2$ is connected to the portion of the corresponding inner blade portion at the side corresponding to the wall surface of the agitation vessel, which is the longitudinal plate portion $v_1$, as inclined at a predetermined downward angle with respect to the rotating direction $\alpha$ of the agitation shaft 13. Although the lateral portion $n_1$ of the inner blade portion is attached to the agitation shaft 13 through a boss as illustrated in the drawing, the inner blade portion may be attached directly to the agitation shaft without the boss.

In the present embodiment, the inner blade portion 17 and the outer blade portion 18 of each upper agitation blade are each substantially T-shaped, as viewed from above. However, it is unnecessary to restrict the shapes of the inner and outer blade portions 17, 18 to the illustrated shapes. That is, the inner blade portion 17 and the outer blade portion 18 may be shaped in any suitable manners as long as the cutout portions or the openings are formed at the positions forward and rearward in the rotating direction of the agitation shaft 13, with respect to the arc formed between the upper end and the lower end of the outer periphery $i_1$, $i_2$ and the center of the agitation shaft.

The middle upper agitation blades 16*b* are arranged on the trailing side of the highest upper agitation blades 16*a*, which are vertically adjacent to the middle upper agitation blades 16*b*, with respect to the rotating direction (in the opposite direction to the direction indicated by arrow $\alpha$). Similarly, the lowest upper agitation blades 16*c* are arranged on the trailing side of the middle upper agitation blades 16*b*, which are vertically adjacent to the lowest upper agitation blades 16*c*, with respect to the rotating direction. Like the highest upper agitation blades 16*a*, 16*a*, the middle upper agitation blades 16*b*, 16*b* and the lowest upper agitation blades 16*c*, 16*c* are fixed to the agitation shaft 13 so as to be located on opposite sides of the agitation shaft 13, that the associated inner blade portions are inclined each at a predetermined elevation angle with respect to the rotating direction of the agitation shaft 13 and fixed to the agitation shaft 13, and that the outer blade portions are inclined each at a predetermined downward angle with respect to the rotating direction of the agitation shaft 13 and fixed to the corresponding inner blade portions.

In each of the upper agitation blades 16*a*, 16*b*, 16*c* of the present embodiment illustrated in FIGS. 4 to 6, the distance between the center of the agitation shaft and the outer periphery $i_1$ of the inner blade portion and the distance between the center of the agitation shaft and the outer periphery $i_2$ of the outer blade portion are equal in all levels. However, the embodiment is not restricted to the illustrated distances. That is, for example, the distances between the center of the agitation shaft and the outer peripheries $i_1$ of the inner blade portions may be gradually increased from the highest level to the lowest level through the middle level and the distances between the center of the agitation shaft and the outer peripheries $i_2$ of the outer blade portions may be uniform.

In the present embodiment, each upper agitation blade 16*a*, 16*b*, 16*c* have similar figures. However, the shapes of the upper agitation blades 16*a*, 16*b*, 16*c* are not restricted to the embodiment but may be changed. Further, each upper agitation blade 16*a*, 16*b*, 16*c* may have any suitable shape other than the shape having a symmetry axis as viewed from above.

In the present embodiment, the attachment angle $\psi$ (see FIG. 21) as viewed from above between each highest upper agitation blade 16*a* and the corresponding middle upper agitation blade 16*b* and the attachment angle $\psi$ (see FIG. 21) between each middle upper agitation blade 16*b* and the corresponding lowest upper agitation blade 16*c* with respect to the rotating direction of the agitation shaft are equal in the corresponding levels. The elevation angle $\xi_1$ (see FIG. 22) of the inner blade portion of each upper agitation blade and the elevation angle $\xi_2$ (see FIG. 22) of the outer blade portion of the upper agitation blade with respect to the rotating direction of the agitation shaft 13 are also equal in the highest, middle, and lowest levels. However, the invention is not restricted to the embodiment, and the angles may be set to different values.

The lower agitation blades 15, 15 are flat plate-like agitation blades arranged along the agitation shaft 13. The lower side portion of each lower agitation blade 15 is shaped along the bottom surface of the agitation vessel and arranged close to the vessel bottom surface. The portion of the lower agitation blade 15 at the side corresponding to the vessel wall is bent rearward with respect to the rotating direction of the agitation shaft 13.

The upper end portion of the outer periphery of each lower agitation blade 15 is arranged not to be close to the lower end of the outer blade portion of the corresponding lowest upper agitation blade 16*c*, which is vertically adjacent to the lower agitation blade 15.

Further, the lower agitation blades 15 are arranged in such .a manner that a sufficient space is formed between the upper end portion of each lower agitation blade and the lower end portion of the inner blade portion of the corresponding lowest upper agitation blades 16*c*, which is vertically adjacent to the lower agitation blade 15.

As shown in FIG. 4, the upper agitation blades of all levels are arranged in such a manner as to form vertically overlapped portions. Also, the lower end portion of each lowest upper agitation blade and the upper end portion of the corresponding lower blade are arranged in such a manner as to form a vertically overlapped portion. The overlapping amounts do not necessarily have to be equal but may be different. However, with reference to FIGS. 5 and 6, it is necessary to arrange the blades so as to prevent each vertically adjacent pair of the blades from contacting each other.

The agitation apparatus 11 of the present embodiment is configured as has been described. The agitation characteristics of the agitation apparatus of the embodiment will hereafter be described with reference to FIGS. 24 to 28.

When the agitation shaft 13 is rotated in the direction indicated by arrow a (clockwise in the drawings as viewed from above), the upper blade sets 14 and the lower blades 15 are also rotated in the same directions. In this state, the inner blade portions of the highest upper agitation blades 16*a*, 16*a* generate such a flow that the fluid in the vicinity of the fluid level in the upper portion of the agitation vessel is drawn in the direction toward the vessel bottom. The inner blade portions of the highest upper agitation blades 16*a*, 16*a* are each inclined with respect to the agitation shaft 13 in the direction in which the upper agitation blade 16*a* depresses the fluid. Accordingly, as has been described, the upper agitation blades 16*a*, 16*a* produce descending flows in the agitation vessel. However, each highest upper agitation blade 16*a* is a rotary body rotating about the agitation shaft 13 as the rotary shaft and produces centrifugal force. This simultaneously generates a substantially horizontal outward flow advancing from the agitation shaft 13 to the inner wall of the agitation vessel and a substantially horizontal revolving flow rotating in the same direction as the rotating direction of the agitation blade.

The inner blade portion of each highest upper agitation blade 16*a* is shaped as the letter T rotated by 90°. Accordingly, a longitudinally elongated plate-like blade (the longitudinal plate portion $v_1$) is arranged at a position twisted by the inclination angle $\xi_1$ with respect to the agitation shaft 13. If the inclination angle $\xi_1$ is 0°, the longitudinal plate portion $v_1$ of the inner blade portion is arranged parallel to the agitation shaft 13. The longitudinal plate portion $v_1$ is designed in such a manner as to have the outer periphery $i_1$ having the arcuate shape as viewed from above. The longitudinal plate portion $v_1$ thus has a width becoming smaller in the upward and downward directions with respect to the joint portion with respect to the rotary shaft 13. As a result, the outward flow generated by, particularly, the inner blade portion of the upper agitation blade 16*a* does not have uniform intensity. That is, the intensity of the outward flow becomes smaller in the upward and downward directions separately from the joint portion with respect to the rotary shaft 13, which is the lateral plate portion $n_1$ of the inner blade portion.

The intensity of the outward flow is distributed in the same manner as the above-described manner in the middle upper agitation blades 16*b* and the lowest upper agitation blades 16*c*.

As has been described, as illustrated in FIG. 4, the overlapped portions are formed in the vertical direction between the inner blade portion of each highest upper agitation blade 16*a* and the inner blade portion of the corresponding middle upper agitation blade 16*b* and between the inner blade portion of each middle upper agitation blade 16*b* and the inner blade portion of the corresponding lowest upper agitation blade 16*c*. As illustrated in FIG. 5, the vertically overlapped portions are not formed to cause the overlapping blades to contact each other. However, the overlapped portions are shaped in such a manner that a less intense section of an outward flow at the lower end portion of the inner blade portion of the highest upper agitation blade 16*a* is compensated by the upper end portion of the inner blade portion of the middle upper agitation blade 16*b* through a similar less intense outward flow. There is a similar relationship between the lower end portion of the inner blade portion of each middle upper agitation blade 16*b* and the upper end portion of the inner blade portion of the corresponding lowest upper agitation blade 16*c*.

When the highest upper agitation blades 16*a* are rotated, positive pressure acts on a front surface of each upper agitation blade 16*a* and negative pressure acts on a rear surface of the upper agitation blade 16*a* with respect to the rotating direction of the agitation shaft 13, which is the advancing direction of each blade. Accordingly, a wrap-around flow moving from a positive pressure zone to a negative pressure zone is also produced.

In the longitudinal plate portion v1 of the inner blade portion of each highest upper agitation blade 16*a*, as illustrated in FIG. 20, the wrap-around flow in a horizontal direction is generated by the outer periphery $i_1$ of the longitudinal plate portion of the inner blade portion and the longitudinal side portion m1 at the side corresponding to the agitation shaft. Due to the difference in linear velocity between the outer periphery $i_1$ and the longitudinal side portion $m_1$ of the inner blade portion (since the blade outer peripheral portion is more spaced from the rotational axis, the linear velocity at the blade outer peripheral portion is greater), a small vortex flow rotating (spinning) in the opposite direction $\beta$ to the rotating direction $\alpha$ of the agitation shaft (in the present embodiment, counterclockwise) is produced at the rear surface of the longitudinal plate portion $v_1$ with respect to the rotating direction.

Figure 24:
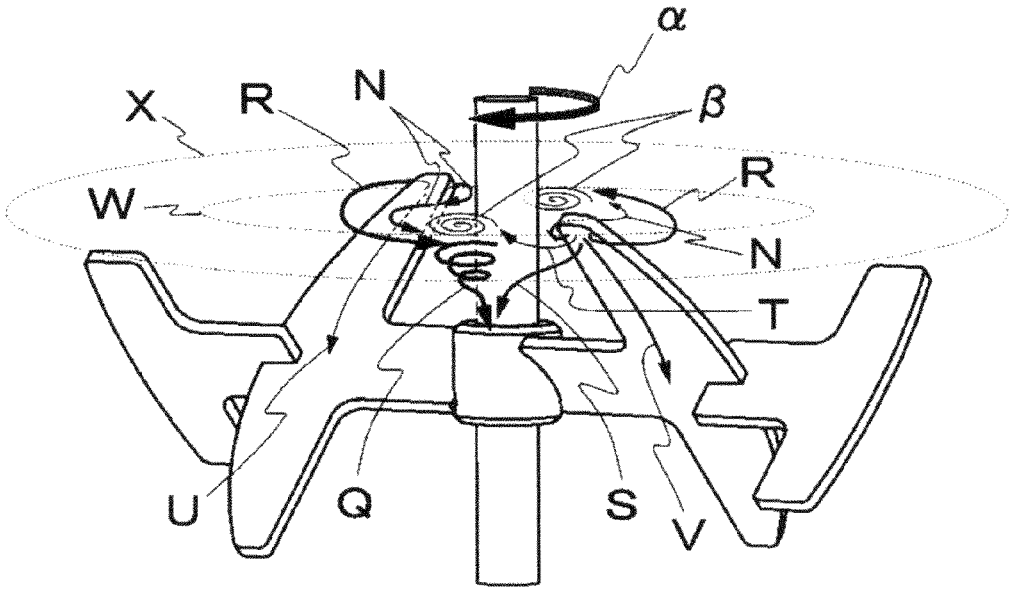
FIG. 24 is a perspective view schematically showing the proximity of an upper agitation blade of the agitation apparatus 11 of the embodiment, illustrating a small vortex flow rotating (spinning) in the opposite direction to the rotating direction of the agitation shaft, which is produced through a velocity difference between horizontal wrap-around flows generated by a longitudinal plate portion of the inner blade portion of the upper agitation blade and a merger flow of the wrap-around flows.

To specify the above-described phenomenon in detail with reference to FIG. 24, a wrap-around flow R (a flow moving at the outer side of the inner blade portion and advancing toward the rear surface of the inner blade portion) produced by the outer periphery $i_1$ of the inner blade portion of each upper agitation blade has a greater intensity than a wrap-around flow N (a flow wrapping around the gap between the longitudinal side portion of the inner blade portion at the side corresponding to the agitation shaft and the agitation shaft, advancing toward the rear surface of the inner blade portion) generated by the longitudinal side portion $m_1$ at the side corresponding to the agitation shaft. Accordingly, when the two flows are to be merged into each other at a position rearward in the rotating direction of the upper agitation blade, the velocity difference between the flows produces a small vortex flow Q.

The small vortex Q merges with not only the substantially horizontal wrap-around flows R, N, which are produced by the longitudinal plate portion of the inner blade portion of each upper agitation blade, but also the substantially horizontal flow T, which is pressed along the rotating direction by the positive pressure zone of the front surface of the longitudinal plate portion of the inner blade portion in the rotating direction, and the flow S, which is depressed forward in the rotating direction by the positive pressure zone of the longitudinal plate portion. This produces an intense descending flow.

In the present embodiment, the longitudinal side portion $m_1$ of the longitudinal plate portion $v_1$ of the inner blade portion at the side corresponding to the agitation shaft maintains an appropriate distance from the agitation shaft 13 and has a sufficient length in the vertical direction. Accordingly, the small vortex flow Q, which is generated through operation of the wrap-around flows R, N produced by the longitudinal side portion, spins in a manner following rotation of the highest upper agitation blade 16*a* and continues rotating along an orbital path about the agitation shaft 13, without moving toward the wall surface of the agitation vessel and disappearing.

The agitation shaft 13 is the revolution axis of the small vortex flow Q. Accordingly, although the revolution axis is oriented in the vertical direction, the spin axis of the small vortex flow Q is inclined with respect to the revolution axis. The inclination of the spin axis with respect to the revolution axis is nonconstant in the vertical direction of the agitation vessel and appropriately distributed through equilibrium of intensities among the outward flows, the revolving flows, and the descending flows and the wrap-around flows, which are produced by the inner blade portions of the upper agitation blades, and equilibrium of intensity with respect to the ascending flow produced by the outer blade portions. Nonetheless, basically, the spin axis is skew with a lower section of the spin axis located slightly retreated with respect to the rotating direction of the agitation shaft 13.

Also, when the middle upper agitation blades 16*b* and the lowest upper agitation blades 16*c* are rotated, small vortex flows caused through the above-described operating mechanisms are generated at the rear surfaces of the blades with respect to the rotating direction.

In the present embodiment, arrangement of the small vortex flows generated behind the inner blade portions of the upper agitation blades is substantially the same as arrangement of the upper agitation blades 16*a*, 16*b*, 16*c*. In other words, the lower the position of a small vortex flow, the further rearward the small vortex flow is located with respect to the rotating direction of the agitation shaft 13. Further, as has been described, the lower section of the spin axis of each small vortex flow is retreated with respect to the rotating direction of the agitation shaft 13. Specifically, the lower end portion of the small vortex flow produced through operation of the inner blade portion of each highest upper agitation blade 16*a* advances toward the upper portion of the small vortex flow generated through operation of the inner blade portion of the corresponding middle upper agitation blade 16*b*. Similarly, the lower end portion of the small vortex flow caused by the inner blade portion of each middle upper agitation blade 16*b* advances toward the upper portion of the small vortex flow produced by the inner blade portion of the corresponding lowest upper agitation blade 16*c*. As a result, with reference to FIG. 25, a continuous descending flow G caused by the small vortex flows is formed.

In the present embodiment, the respective pairs of upper agitation blades 16*a*, 16*b*, 16*c* are arranged in such a manner as to be located on opposite sides of the agitation shaft 13. This arrangement produces two continuous descending flows G, which are caused by the small vortex flows and extend from the highest upper agitation blades 16*a* to the lowest upper agitation blades 16*c*. Further, when each upper blade set 14 is rotated, a descending flow (a vortex flow rotating in the same direction as the rotating direction) about the agitation shaft 13, which extends from each highest upper agitation blade 16*a* to the corresponding lowest upper agitation blade 16*c*, is also generated in the agitation vessel. In other words, in the present embodiment, the three descending flows (vortex flows) are produced in the agitation vessel, thus providing an intense descending flow, unlike the conventional agitation apparatuses 21, 31, 41, which are illustrated in the corresponding ones of FIGS. 29 to 34 and 35 to 37.

Further, since multiple vortex flows rotating about different spin axes in different rotating directions are formed, mixing performance unachievable by a single vortex flow is obtained. Specifically, when the fluid moves from the vicinity of the fluid level in the upper portion of the agitation vessel to the vicinity of the lower blades, horizontal mixing action is brought about. This lowers the risk of insufficient mixing caused by movement of the fluid following movement of the agitation blades, or in other words, integral rotation of the fluid with the agitation blades, to an extremely small extent.

Also in the agitation apparatus 1 illustrated in FIGS. 1 to 3, each upper blade set 4 operates to generate a vortex flow rotating about the agitation shaft in the same direction as the rotating direction of the agitation shaft 3 and a small vortex flow that is produced at a position rearward in the rotating direction of the upper agitation blade and rotates in the opposite direction to the rotating direction of the agitation shaft. These vortex flows form a continuous descending flow extending from the upper portion to the lower portion of the agitation vessel.

With reference to FIGS. 24 to 28, the agitation characteristics of the present embodiment will be further described.

Figure 25:
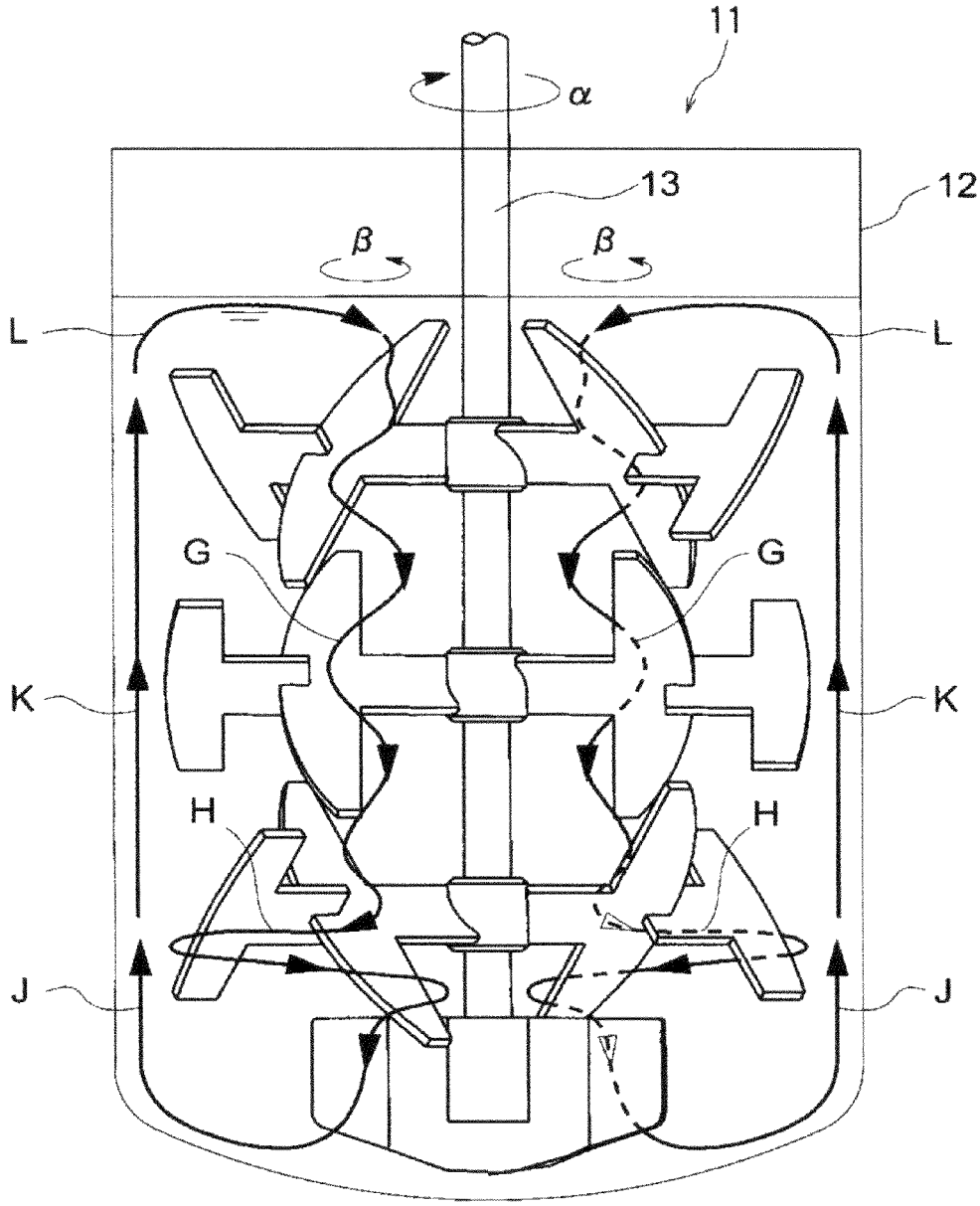
FIG. 25 is a front view schematically illustrating a vertically circulating flow having a great curved section at a position above a lower blade of the agitation apparatus 11 of the embodiment.

In the present embodiment, the paths of the multiple descending flows generated through operation of the upper blade sets 14 are greatly curved in the vicinity of the upper end portions of the lower agitation blades 15 (see FIG. 25). Specifically, such a curved flow is caused by a sufficient horizontal interval between the lower end portion of the inner blade portion of each lowest upper agitation blade 16*c* and the upper end portion of the corresponding lower blade.

Figure 26:
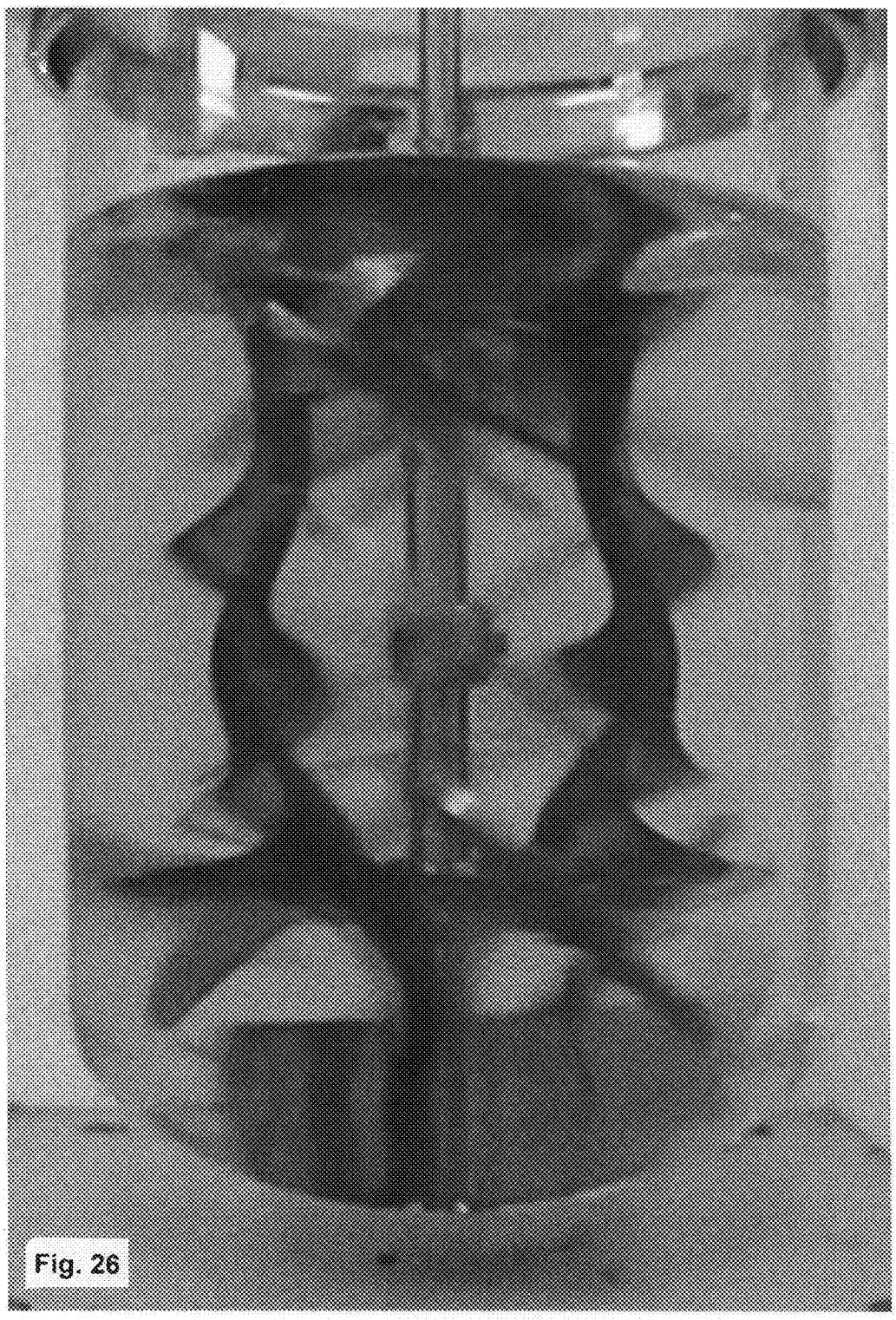
FIG. 26 is a photograph showing a vertically circulating flow having a greatly curved section at a position above a lower blade of the agitation apparatus 11 of the embodiment, which is formed by adjusting the phase difference angle between the lower blade and the corresponding lowest upper agitation blade to a preferable value and visualized through a coloration test.

When the phase difference angle γ (see FIG. 23) between each lowest upper agitation blade 16*c* and the corresponding lower blade 15 with respect to the agitation shaft 13 is set in accordance with a more preferable condition, or in other words, the blades are arranged as in FIG. 25, for example, the curved section H of each descending flow above the lower blade is clearly observed through a test, as shown by the photograph of FIG. 26. Specifically, FIG. 25 is an illustration and FIG. 26 is a photograph, both showing the state of the vertically circulating flows in the same blade arrangement.

Figure 27:
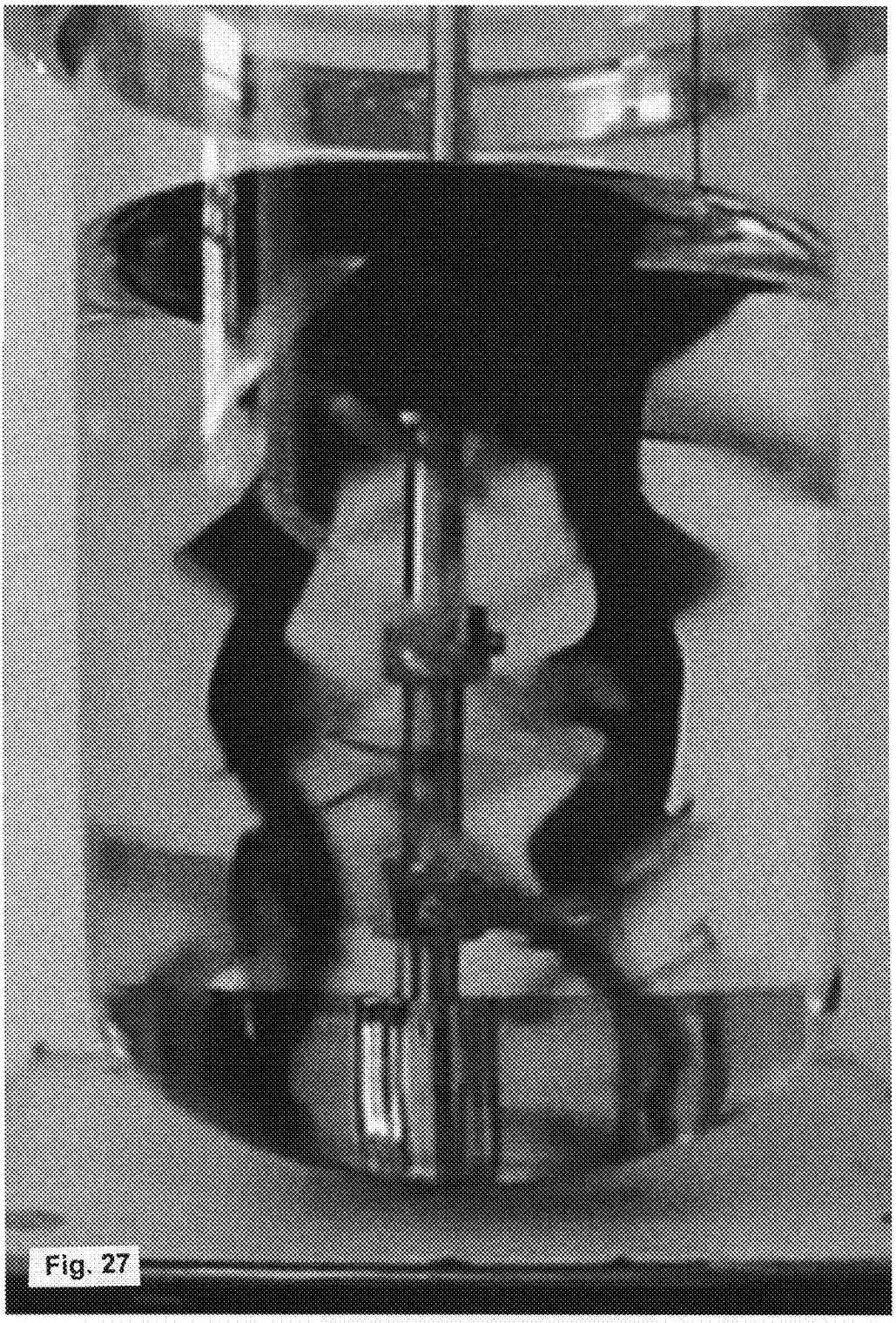
FIG. 27 is a photograph showing a vertically circulating flow without a greatly curved section at the position above the lower blade of the agitation apparatus 11 of the embodiment, which is formed by adjusting the phase difference angle between the lower blade and the lowest upper agitation blade and visualized through the coloration test.

Contrastingly, when the phase difference angle γ between each lower blade 15 and the corresponding lowest upper agitation blade 16*c* is adjusted to such an extent that mixing performance as a whole is maintained, a descending flow caused by a sequence of small vortex flows generated through operation of the inner blade portions of the corresponding upper agitation blades is transferred to the lower blade without being curved in a horizontal direction at a position above the lower blade, as shown in the photograph of FIG. 27. Although it appears that the descending flow is transferred to the lower blade more smoothly and mixing is promoted, this prediction may not be accurate. Specifically, if a vertically circulating flow is excessively smooth, the flow interferes with horizontal movement of a substance. Accordingly, as illustrated in FIGS. 25 and 26, the vertically circulating flow having the section greatly curved into the horizontal direction is more advantageous to promote mixing. However, in this case, it is a precondition that the descending flows are transferred smoothly from the upper blades to the lower blades. That is, if the greatly curved section of each descending flow hinders such smooth transfer of the descending flow to the lower blades, the configuration will end up going against its own objective. As a result, as in the case shown in FIGS. 25 and 26 of the present embodiment, it is essential to form a curved section in each descending flow in such a manner that the descending flow is smoothly transferred to the corresponding lower blade.

The outward flows J of the present embodiment, which are produced by the lower agitation blades 15, 15 in the bottom portion of the agitation vessel, change their directions when hitting the wall surface of the agitation vessel and become the ascending flows J, which flow in the vicinities of the wall surface of the agitation vessel.

As long as the phase difference angle γ between each lowest upper agitation blade 16*c* and the corresponding lower blade 15 with respect to the agitation shaft 13 is appropriate, the curved section H of each descending flow above the corresponding lower blade of the present embodiment is prevented from interfering with or cutting the corresponding ascending flow J caused by the outward flow J. Further, through scraping action of the outer blade portions of the highest, middle, and lowest upper agitation blades 16*a*, 16*b*, 16*c*, the ascending flow J caused by the downward flow J is reaccelerated in an upward direction in the vicinity of the wall surface of the agitation vessel. The ascending flow J thus reliably reaches the vicinity of the fluid level in the upper portion of the agitation vessel as the ascending flow K.

The ascending flow K is changed to the flow L toward the agitation shaft 13 in the vicinity of the fluid level. The direction of the flow L is changed by the inner blade portion of the corresponding highest upper agitation blade 16*a* so that the flow L becomes the descending flow G.

In this manner, in the present embodiment, each descending flow G flowing along the path in the vicinities of the inner blade portions of each upper blade set 14 starting from the proximity of the fluid level in the upper portion of the agitation vessel is changed to the curved flow H, which is formed in the space between the lower side of the inner blade portion of the lowest upper agitation blade 16*c* and the upper end portion of the corresponding lower agitation blade 15. The curved flow H is then transferred to the lower agitation blade 15 and becomes the outward flow J caused by the lower agitation blade 15. The outward flow J strikes the vessel wall surface and changes to the ascending flow J. The ascending flow J is reaccelerated through the scraping action of the outer blade portions of the upper agitation blades and reaches the proximity of the fluid level in the upper portion of the agitation vessel as the ascending flow K, which flows in the proximity of the vessel wall surface. The ascending flow K changes to the flow L, which advances toward the agitation shaft 13, in the proximity of the fluid level. In this manner, a vertically circulating flow L-G-H-J-K-L flowing throughout the agitation vessel is formed. This ensures highly effective agitation/mixing characteristics in the entire agitation vessel.

Figure 28:
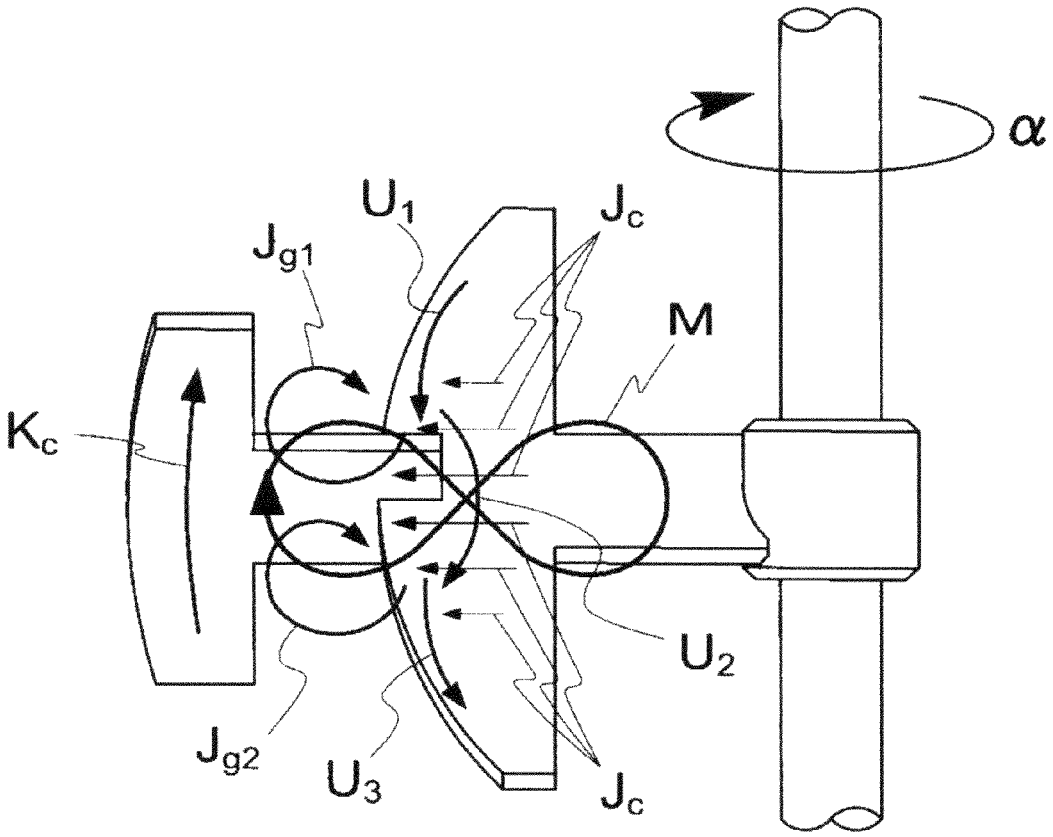
FIG. 28 is a side view schematically illustrating a particular locally circulating flow produced in the vicinity of a joint portion between an inner blade portion and an outer blade portion of an upper agitation blade of the agitation apparatus 11 of the embodiment.

In the present embodiment, the outward flows and the descending flows generated by the inner blade portions, the ascending flows produced by the outer blade portions and the wrap-around flows caused by the longitudinal plate portions of the inner blade portions and the outer blade portions intertwine in a complex manner in the vicinities of the joint portions between the inner blade portions and the outer blade portions of the upper agitation blades. A locally circulating flow M shaped like a Mobius strip, as illustrated in FIG. 28, is also generated.

An outward flow $J_c$, which is produced by the inner blade portion of each upper blade, has intensity distributed in correspondence with the width of the longitudinal plate portion of the inner blade portion. That is, the intensity of the outward flow $J_c$ becomes smaller from the center of the blade toward the upper end and the lower end of the blade. The outward flow $J_c$ is divided into an upward flow and a downward flow at the joint portion between the inner blade portion and the outer blade portion. At this stage, the outward flow $J_c$ is influenced by descending flows U1, U2, U3 in the operating range of the inner blade portion. After each divided outward flow moves to the outer side of the inner blade portion (the side corresponding to the vessel inner wall), the flow subsequently enters the operating range of the outer blade portion and is influenced by an ascending flow $K_c$ produced by the outer blade portion. Additionally, the flow is influenced by horizontal wrap-around flows (none is shown) produced by the longitudinal side portion of the longitudinal plate portion of the outer blade portion at the side corresponding to the agitation shaft and the outer periphery of the inner blade portion. This converts the outward flow $J_c$ into small locally circulating flows such as flows $J_{g1}$, $J_{g2}$ and the flows $J_{g1}$, $J_{g2}$ are sent back to the operating range of the inner blade portion. When the longitudinal plate portion of the outer blade portion scrapes the fluid in the vicinity of the wall surface of the agitation vessel in an upward direction, a flow (not shown) of the fluid falling from the longitudinal plate portion of the outer blade portion through a cutout portion $k_2$ (see FIG. 20) at the side corresponding to the agitation shaft is also produced. The cutout portion $k_2$ of the outer blade portion is arranged closer to the inner wall of the agitation vessel than the outer periphery $i_1$ of the inner blade portion. Accordingly, the flow of the fluid falling from the longitudinal side portion $m_2$ of the longitudinal plate portion of the outer blade portion occurs at a position closer to the inner wall of the agitation vessel than the outer periphery $i_1$ of the inner blade portion. Also, the flow of the falling fluid interferes with the scraping action of the fluid at the joint portion between the outer blade portion and the inner blade portion. Further, the small circulating flows $J_{g1}$, $J_{g2}$ interfere with a small vortex flow (not shown) produced through operation of the inner blade portion. As a result, the particular locally circulating flow M shaped like a Mobius strip is formed.

The locally circulating flow M and the small locally circulating flows $J_{g1}$, $J_{g2}$ are not intense locally circulating flows such as those observed in a small-sized blade like a turbine blade. Particularly, the flow M is an unstable flow that appears and disappears at certain cycles. By the locally circulating flow M, horizontal movement of a substance is applied to the general circulating flow L-G-H-J-K-L as an appropriate extent of vibration. This further improves agitation/mixing efficiency.

As has been described, the agitation apparatus 11 of the present embodiment generates a vortex flow produced through rotation of the agitation blades and a plurality of small vortex flows rotating (revolving) in the opposite direction to the rotating direction of the vortex flow, thus forming a vertically circulating flow that has a greatly curved section at a position above each lower blade and flows throughout the agitation vessel. Effects of scraping off and sending up the fluid in the vicinity of the inner wall surface of the agitation vessel are brought about by the outer blade portions of the upper agitation blades. An effect of depressing the fluid in the central portion of the agitation vessel is caused by the inner blade portions of the upper agitation blades. Effects of dividing, reversing, and merging the outward flows in the vicinities of the joint portions between the inner blade portions and the outer blade portions are also obtained. These effects and synergetic effects of the effects allow rapid, efficient, and homogeneous mixing of fluids with a wide spectrum of viscosities from low to high levels, highly thixotropic fluids, highly viscous and highly thixotropic fluids, and a plurality of fluids having a great difference in viscosity.

EXAMPLE 1

<Decoloration Test by Iodine Reduction Method using Starch Syrup Solution Prepared by Acid Saccharification>

A solution of starch syrup at 5 Pa·s colored with iodine was decolorized with a solution of sodium thiosulfate prepared with the viscosity equal to that of the starch syrup solution and using starch syrup. The time (a mixing completion time) until the color of the iodine completely disappeared was measured. Specifically, 2 L of the aforementioned colored starch syrup solution was poured into a flask with the inner diameter ϕ130 mm. The agitation apparatus 1 of the present embodiment, as illustrated in FIGS. 1 to 3, was set and the number of rotation was adjusted so that the agitation power was 1.5 kW/m$^3$. Specifically, the number of rotation was 150 rpm. The starch syrup solution of sodium thiosulfate, by the amount corresponding to 1.1 equivalent of the iodine used for coloration, was poured into the starch syrup solution that was agitated. The time was then measured until the color of the iodine completely disappeared. As a result, the mixing completion time was 4.5 minutes.

COMPARATIVE EXAMPLE 1

Using the conventional agitation apparatus 21 illustrated in FIGS. 29 to 31, the decoloration test was conducted using a solution of starch syrup under the same conditions as those of Example 1. The test was carried out with the number of rotation set to 140 rpm so that the agitation power was 1.5 kW/m$^3$. As a result, the mixing completion time was 22 minutes.

EXAMPLE 2

<Decoloration Test By Iodine Reduction Method using Starch Solution Prepared by Malt Reduction Method>

A solution of starch syrup at 5 Pa·s colored with iodine was decolorized by a solution of sodium thiosulfate prepared at the viscosity equal to that of the starch syrup solution and using starch syrup. The time (the mixing completion time) until the color of the iodine completely disappeared was measured. Specifically, 2 L of the aforementioned colored starch syrup solution was poured into a flask with the inner diameter ϕ130 mm. The agitation apparatus 1 used in Example 1 was set and the number of rotation was adjusted so that the agitation power was 1.5 kW/m$^3$. Specifically, the number of rotation was 150 rpm. The starch syrup solution of sodium thiosulfate, by the amount corresponding to 1.1 equivalents of the iodine used for coloration, was poured into the starch syrup solution that was agitated. The time was then measured until the color of the iodine completely disappeared. As a result, the mixing completion time was 33 minutes.

EXAMPLE 3

Using the agitation apparatus 11 of the present embodiment illustrated in FIGS. 4 to 6, the decoloration test was conducted using a solution of starch syrup under the same conditions as those of Example 2. The test was carried out with the number of rotation set to 90 rpm so that the agitation power was 1.5 kW/m$^3$. As a result, the mixing completion time was 6.5 minutes.

COMPARATIVE EXAMPLE 2

Using the conventional agitation apparatus 21 illustrated in FIGS. 29 to 31, the decoloration test was carried out using a solution of starch syrup under the same conditions as those of Example 2. The test was performed with the number of rotation set to 140 rpm so that the agitation power was 1.5 kW/m$^3$. As a result, the color of the iodine did not completely disappear even after 120 minutes had elapsed.

EXAMPLE 4

<Solvent Dilution Test of High-Viscosity Resin (Liquid-Liquid Mixing Test of Fluids with Different Viscosities)>

A mixing test was carried out on fluids with different viscosities using the agitation apparatus 1 employed in Example 1. Specifically, high-viscosity urethane resin with the viscosity of 110 Pa·s at 25° C. was diluted by DMF (N,N-dimethylformamide) of 0.8 mPa·s at 25° C. The ratio (the weight ratio) between the resin and the solvent was 83:17 and the total liquid amount was 2L using the ϕ130 mm flask. The number of rotation was adjusted so that the initial agitation power before solvent dilution was 3 kW/m$^3$. A predetermined amount of solvent was then added to the resin and the time until the solvent and the resin were completely mixed was measured. The rotation number for agitation was 48 rpm and maintained constant until the resin and the solvent were completely mixed. A mixed state was determined by observing the shape of a vortex formed in the level of the solution. In other words, when mixing was insufficient and the solvent was maintained in the vicinity of the level of the fluid, the level of the fluid was substantially horizontal. In contrast, after the mixing was completed, the level of the fluid in the vicinity of the agitation shaft sank to a great extent. Accordingly, the mixed state was determined through observation of the shape of the level of the fluid. After the resin and the solvent were completely mixed in accordance with the aforementioned ratio, the viscosity of the solution was 30 Pa·s. As a result, the time until the solvent disappeared from the level of the fluid, the vortex was formed sufficiently, and it was determined that the mixing had been completed was 370 seconds in the agitation apparatus 1 of the present embodiment illustrated in FIGS. 1 to 3. The agitation power after completion of the mixing was 0.75 kW/m$^3$.

EXAMPLE 5

Using the agitation apparatus 11 of the present invention illustrated in FIGS. 4 to 6, a solvent dilution test of high viscosity resin was performed under the same conditions as those of Example 4. The number of rotation was adjusted so that the initial agitation power before dilution with solvent was 3 kW/m$^3$. A predetermined amount of solvent was then added to the resin and the time until the solvent and the resin were completely mixed was measured. The number of rotation for agitation was 32 rpm and maintained constant until the resin and the solvent were completely mixed. As a result, the time until the solvent disappeared from the level of the fluid, a vortex was formed sufficiently, and determination that mixing was completed was made was 270 seconds for the agitation apparatus 11 of the present embodiment, which is illustrated in FIGS. 4 to 6. The agitation power after the mixing was completed was 0.92 kW/m$^3$.

COMPARATIVE EXAMPLE 3

Using the conventional agitation apparatus 21 illustrated in FIGS. 29 to 31, a solvent dilution test of high viscosity resin was carried out under the same conditions as those of Example 4. The number of rotation was set to 46 rpm so that the initial agitation power was 3 kW/m$^3$. As a result, the conventional agitation apparatus 11 consumed 1070 seconds until mixing was completed. The agitation power after the mixing was completed was 0.96 kW/m$^3$.

Industrial Usability

Using the agitation apparatus 1 of the present embodiment, various industrial products are produced in the agitation vessel. Highly efficient agitation/mixing is ensured for any industrial product flowable in the agitation vessel including, for example, resin products having various flow characteristics from low to high viscosities and water dispersion products of the resin products, pigments, inks, medicines, cosmetics, and food. This improves production efficiency, stabilizes product qualities, and provides high-value-added products. The agitation characteristics are particularly enhanced for industrial products with middle to high viscosities, which have readily caused insufficient mixing in the conventional techniques. Also, by decreasing the agitation power, the initial cost and the running cost of a drive device (a motor) are reduced. Further, since the blade surface area is comparatively small, the agitation apparatus is cleansed and maintained with greatly improved easiness compared to the conventional techniques. This increases yield of products and decreases a cost loss caused by, for example, cleansing the apparatus.

Use of the apparatus 11 of the present embodiment particularly improves the agitation characteristics for industrial products with middle to high viscosities, which have easily caused insufficient mixing in the conventional techniques, and industrial products with high thixotropy and high viscosity and intermediate products of these products. As a result, a highly efficient production system can be established.

DESCRIPTION OF REFERENCE NUMERALS

1 Agitation Apparatus
2 Agitation Vessel
3 Agitation Shaft
4 Upper Blade set
5 Lower Blade
6 Upper Agitation Blades
6*a* Highest Upper Agitation Blade
6*b* Middle Upper Agitation Blade
6*c* Lowest Upper Agitation Blade
11 Agitation Apparatus
12 Agitation Vessel
13 Agitation Shaft
14 Upper Blade set
15 Lower Blade
16 Upper Agitation Blade
16*a* Highest Upper Agitation Blade
16*b* Middle Upper Agitation Blade
16*c* Lowest Upper Agitation Blade
17 Inner Blade Portion of Upper Agitation Blade
18 Outer Blade Portion of Upper Agitation Blade
$\alpha$ Rotating Direction of Agitation Shaft (Orbiting Direction of Small Vortex Flows)
$\beta$ Spinning Direction of Small Vortex Flows
$\gamma$ Angle defined by two lines as viewed from above, one line connecting the center of the agitation shaft to the lower end of the outer blade portion of the lowest upper agitation blade 16*c*, and the other being the center line of the lower blade in the opposite direction to the rotating direction of the agitation shaft from the lower end of the outer blade portion of the upper agitation blade
$\delta$ Angle between the center line of the lower blade and the line q, as viewed from above, in the opposite direction to the rotating direction of the agitation shaft
$\theta$ Angle defined by the upper end and the lower end of the outer periphery of the blade and the center line of the agitation shaft in the plan view schematically showing the upper agitation blade 6
$\theta_1$ Angle defined by the upper end and the lower end of the outer periphery of the inner blade portion of the upper agitation blade 16 and the center line of the agitation shaft in the plan view schematically showing the upper agitation blade 16
$\theta_2$ Angle defined by the upper end and the lower end of the outer periphery of the outer blade portion of the upper agitation blade 16 and the center line of the agitation shaft in the plan view schematically showing the upper agitation blade 16
$\xi$ Elevation angle of the upper agitation blade 6 with respect to the rotating direction of the agitation shaft
$\xi_1$ Elevation angle of the inner blade portion of the upper agitation blade 16 with respect to the rotating direction of the agitation shaft
$\xi_2$ Downward inclination angle of the outer blade portion of the upper agitation blade 16 with respect to the rotating direction of the agitation shaft
$\psi$ Phase difference angle between the center lines of the upper agitation blades that are vertically adjacent to each other
a Width of the longitudinal plate portion of the upper agitation blade 6
$a_1$ Width of the longitudinal plate portion of the inner blade portion of the upper agitation blade 16
$a_2$ Width of the longitudinal plate portion of the outer blade portion of the upper agitation blade 16
$b_a$, $b_b$ Upper end portion and lower end portion of a cutout portion of the upper agitation shaft 6
d Blade diameter (blade span)
dc Blade diameter of the upper blade set 14
dh Blade diameter of the upper blade set 4
db Blade diameter of the lower blade
$f_a$, $f_b$ Upper and lower ends of the outer peripheral portion of the upper agitation blade 6 as viewed from above
g Center of the agitation shaft
h Proportion of the cutout portion in the plan view schematically showing the upper agitation blade 6 (h=k/J)
i Outer periphery of the upper agitation shaft 6
$i_1$ Outer periphery of the longitudinal plate portion of the inner blade portion of the upper agitation blade 16
$i_2$ Outer periphery of the longitudinal plate portion of the outer blade portion of the upper agitation blade 16
j Surface area of an imaginary arcuate portion in the plan view schematically showing the upper agitation blade 6 ($j=n\times r\times r\times\theta/360°$)
k Total surface area of the cutout portions in the plan view schematically showing the upper agitation blade 6 ($k=ka+kb+\ldots$)
$k_1$ Cutout portion of the inner blade portion in the plan view schematically showing the upper agitation blade 16
$k_2$ Cutout portion of the outer blade portion in the plan view schematically showing the upper agitation blade 16

$m_1$ Longitudinal side portion of the longitudinal plate portion of the inner blade portion of the upper agitation blade 16 at the side corresponding to the agitation shaft $m_2$ Longitudinal side portion of the longitudinal plate portion of the outer blade portion of the upper agitation blade 16 at the side corresponding to the agitation shaft $h_1$ Lateral plate portion of the inner blade portion of the upper agitation blade 16

$h_2$ Lateral plate portion of the outer blade portion of the upper agitation blade 16 q Line extending from the center of the agitation shaft to the lower end portion of the lowest upper agitation blade, as viewed from above r Blade span radius of the upper agitation blade 6 (r=0.5dh)

$r_1$ Blade span radius of the inner blade portion of the upper agitation blade 16

$r_2$ Blade span radius of the upper agitation blade 16 ($r_2$=0.5dc)

$t_1$ Length of the longitudinal plate portion of the inner blade portion of the upper agitation blade 16

$t_2$ Length of the longitudinal plate portion of the outer blade portion of the upper agitation blade 16

$v_1$ Longitudinal plate portion of the inner blade portion of the upper agitation blade 16

$v_2$ Longitudinal plate portion of the outer blade portion of the upper agitation blade 16

A Small vortex flow formed behind the highest upper agitation blade

B Small vortex flow formed behind the middle upper agitation blade

C Small vortex flow formed behind the lowest upper agitation blade

D Inner diameter of the agitation vessel

E Wrap-around flow generated through operation of the outer peripheral portion of the upper agitation blade 6

F Wrap-around flow generated through operation of the longitudinal side portion of the upper agitation blade 6 at the side corresponding to the agitation shaft G Descending flow caused by a sequence of small vortex flows formed by the upper blade sets H Curved flow J Outward flow of the lower blade and the ascending flow formed by the outward flow when the outward flow hits the bottom surface and the wall surface of the vessel $J_c$ Outward flow in the vicinity of the longitudinal plate portion of the inner blade portion of the upper agitation blade 16

$J_{g1}$, $J_{g2}$ Locally circulating flow formed in the gap between the inner blade portion and the outer blade portion of the upper agitation blade 16

K Ascending flow in the vicinity of the vessel wall $K_c$ Ascending flow in the vicinity of the longitudinal plate portion of the outer blade portion of the upper agitation blade 16

L Flow moving from the vessel wall in the vicinity of the fluid level toward the agitation shaft $L_m$, $L_n$ Vertically circulating flow substantially having an oval shape M Locally circulating flow having a particular shape formed in the vicinity of the joint portion between the inner blade portion and the outer blade portion of the upper agitation blade 16

N Wrap-around flow of the longitudinal side portion at the side corresponding to the agitation shaft, which is formed by the longitudinal plate portion of the inner blade portion of the upper agitation blade 16

Q Small vortex flow produced behind the inner blade portion of the upper agitation blade 16 in the rotating direction R Wrap-around flow of the outer peripheral portion generated by the longitudinal plate portion of the inner blade portion of the upper agitation blade 16

S Flow depressed forward in the rotating direction from the positive pressure zone produced on the front surface of the inner blade portion of the upper agitation blade 16 in the rotating direction T Horizontal flow pushed forward in the rotating direction from the positive pressure zone produced on the front surface of the inner blade portion of the upper agitation blade 16 in the rotating direction U Descending flow flowing along the rear surface of the inner blade portion of the upper agitation blade 16

V Descending flow flowing along the front surface of the inner blade portion of the upper agitation blade 16

W Blade span of the inner blade portion of the upper agitation blade 16 illustrated on an imaginary horizontal cross section including the wrap-around flows N, R and the horizontal flow T X Position of the inner wall of the agitation vessel illustrated on an imaginary horizontal cross section including the wrap-around flows N, R and the horizontal flow T

The invention claimed is:

1. An agitation apparatus including an agitation vessel, an agitation shaft, and an upper blade and a lower blade fixed to the agitation shaft, wherein the upper blade is configured by upper agitation blades arranged at a plurality of levels;

as viewed from above, each of the upper agitation blades has cutout portions at positions forward and rearward in a rotating direction in a range between lines connecting two blade ends of the upper agitation blade to a center of the agitation shaft, each upper agitation blade being inclined at an elevation angle with respect to the rotating direction, each of highest upper agitation blades being arranged forward from an adjacent one of lowest upper agitation blades with respect to the rotating direction in such a manner that the highest upper agitation blade has an overlapped portion with respect to the lowest upper agitation blade, and wherein, as viewed from the side, a horizontal cross section including a lower end of the highest upper agitation blade is located below a horizontal cross section including an upper end of the adjacent lowest upper agitation blade;

each of the lowest upper agitation blades is arranged vertically adjacent to the lower blade, wherein, as viewed from above, a line on a plane connecting a lower end portion of the lowest upper agitation blade to the center of the agitation shaft is arranged at a predetermined angle with respect to a center line of the lower blade in a blade radial direction, and wherein, as viewed from the side, a horizontal cross section including the lower end portion of the lowest upper agitation blade being arranged below a horizontal cross section including an upper end portion of the lower blade; and a lower end portion of the lower blade is arranged close to an inner bottom surface of the agitation vessel.

2. The agitation apparatus according to claim 1, wherein the lower blade is a wide retreating paddle blade, wherein, in relation to an inner diameter D of the agitation vessel, a blade diameter db of the lower blade satisfies the expression: $0.4\ D \leqq db \leqq 0.8\ D$, and wherein, in relation to the inner diameter D of the agitation vessel, a blade diameter dh of the lowest upper agitation blade satisfies the expression: $0.35\ D \leqq dh \leqq 0.75\ D$.

3. An agitation apparatus including an agitation vessel, an agitation shaft, and an upper blade and a lower blade fixed to the agitation shaft, wherein the upper blade is configured by upper agitation blades arranged at a plurality of levels;

each of the upper agitation blades is configured by an inner blade portion connected to the agitation shaft and an outer blade portion coupled to a side of the inner blade portion corresponding to an inner wall of the agitation vessel;

as viewed from above, the inner blade portion of each upper agitation blade has cutout portions at positions forward and rearward in a rotating direction in a range between lines connecting two blade ends of the inner blade portion to a center of the agitation shaft, wherein each inner blade portion is inclined at an elevation angle with respect to the rotating direction, wherein each of the highest upper agitation blades are arranged forward from an adjacent one of the lowest upper agitation blades with respect to the rotating direction in such a manner that the highest upper agitation blade has an overlapped portion with respect to the lowest upper agitation blade, and wherein, as viewed from the side, a horizontal cross section including a lower end of the highest upper agitation blade is located below a horizontal cross section including an upper end of the adjacent lowest upper agitation blade;

as viewed from above, the outer blade portion of each upper agitation blade has cutout portions at positions forward and rearward in the rotating direction in a zone from an outer periphery of the inner blade portion toward the inner wall of the agitation vessel and in a range between lines connecting two blade ends of the outer blade portion to the center of the agitation shaft, wherein each outer blade portion is inclined at a downward angle with respect to the rotating direction, and wherein an outer periphery of the outer blade portion of the upper agitation blade is arranged close to and along the inner wall of the agitation vessel;

each of the lowest upper agitation blades is arranged vertically adjacent to the lower blade, wherein, as viewed from above, a line on a plane connecting a lower end portion of the outer blade portion of the lowest upper agitation blade to the center of the agitation shaft is arranged at a predetermined angle with respect to a center line of the lower blade in a blade radial direction, and wherein, as viewed from the side, a horizontal cross section including a lower end of the lowest upper agitation blade is arranged below a horizontal cross section including an upper end of the lower blade as viewed from the side; and a lower end portion of the lower blade is arranged close to an inner bottom surface of the agitation vessel.

4. The agitation apparatus according to claim 3, wherein the lower blade is a wide retreating paddle blade, wherein, in relation to an inner diameter D of the agitation vessel, a blade diameter db of the lower blade satisfies the expression: $0.5\ D \leqq db \leqq 0.9\ D$, and wherein, in relation to the inner diameter D of the agitation vessel, a blade diameter dc of the upper agitation blade satisfies the expression: $0.7\ D \leqq dc \leqq 1.0\ D$.

5. An agitation method for agitating a substance to be agitated using an agitation apparatus including an agitation vessel, an agitation shaft, and an upper blade and a lower blade fixed to the agitation shaft, wherein the agitation method is performed by:

configuring the upper blade with upper agitation blades arranged at a plurality of levels;

forming cutout portions in each of the upper agitation blades at positions forward and rearward in a rotating direction in a range between lines that, as viewed from above, connects two blade ends of the upper agitation blade to a center of the agitation shaft; inclining each upper agitation blade at an elevation angle with respect to the rotating direction; arranging each of the highest upper agitation blades forward from an adjacent one of the lowest upper agitation blades with respect to the rotating direction in such a manner that the highest upper agitation blade has an overlapped portion with respect to the lowest upper agitation blade; and locating a horizontal cross section including a lower end of the highest upper agitation blade below a horizontal cross section including an upper end of the adjacent lowest upper agitation blade as viewed from the side;

arranging each of the lowest upper agitation blades to be vertically adjacent to the lower blade; arranging a line on a plane connecting a lower end portion of the lowest upper agitation blade to the center of the agitation shaft at a predetermined angle with respect to a center line of the lower blade in a blade radial direction as viewed from above; and arranging a horizontal cross section including the lower end portion of the lowest upper agitation blade below a horizontal cross section including an upper end portion of the lower blade as viewed from the side; and arranging a lower end portion of the lower blade close to an inner bottom surface of the agitation vessel.

6. An agitation method for agitating a substance to be agitated using an agitation apparatus including an agitation vessel, an agitation shaft, and an upper blade and a lower blade fixed to the agitation shaft, wherein the agitation method is performed by:

configuring the upper blade with upper agitation blades arranged at a plurality of levels;

configuring each of the upper agitation blades with an inner blade portion connected to the agitation shaft and an outer blade portion connected to a side of the inner blade portion corresponding to an inner wall of the agitation vessel;

forming cutout portions in the inner blade portion of each upper agitation blade at positions forward and rearward in a rotating direction in a range between lines connecting two blade ends of the inner blade portion to a center of the agitation shaft as viewed from above; inclining each inner blade portion at an elevation angle with respect to the rotating direction; arranging each of the highest upper agitation blades forward from an adjacent one of the lowest upper agitation blades with respect to the rotating direction in such a manner that the highest upper agitation blade has an overlapped portion with respect to the lowest upper agitation blade; locating a horizontal cross section including a lower end of the highest upper agitation blade below a horizontal cross section including an upper end of the adjacent lowest upper agitation blade as viewed from the side; and forming cutout portions in the outer blade portion of each upper agitation blade at positions forward and rearward in the rotating direction in a zone from an outer periphery of the inner blade portion toward the inner wall of the agitation vessel and in a range between lines connecting two blade ends of the outer blade portion to the center of the agitation shaft as viewed from above; inclining each outer blade portion at a downward angle with respect to the rotating direction;, and arranging an outer periphery of the outer blade portion of the upper agitation blade close to and along the inner wall of the agitation vessel;

arranging each of the lowest upper agitation blades to be vertically adjacent to the lower blade; arranging, as viewed from above, a line on a plane connecting a lower end portion of the outer blade portion of the lowest upper agitation blade to the center of the agitation shaft at a predetermined angle with respect to a center line of the lower blade in a blade radial direction; and arranging a horizontal cross section including a lower end of the lowest upper agitation blade below a horizontal cross section including an upper end of the lower blade as viewed from the side; and arranging a lower end portion of the lower blade close to an inner bottom surface of the agitation vessel.

* * * * *